US009187897B1

(12) United States Patent
Bergman et al.

(10) Patent No.: US 9,187,897 B1
(45) Date of Patent: Nov. 17, 2015

(54) ASSEMBLY FOR SUPPORTING CEILING PANELS AND CEILING SYSTEM INCORPORATING THE SAME

(71) Applicant: ARMSTRONG WORLD INDUSTRIES, INC., Lancaster, PA (US)

(72) Inventors: Todd M. Bergman, Lititz, PA (US); Scott D. Harnish, Lancaster, PA (US); Jonathan P. Van Dore, Lititz, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 14/555,038

(22) Filed: Nov. 26, 2014

(51) Int. Cl.

| | |
|---|---|
| ***E04B 2/00*** | (2006.01) |
| ***E04B 9/06*** | (2006.01) |
| ***E04B 9/18*** | (2006.01) |
| ***E04B 9/26*** | (2006.01) |

(52) U.S. Cl.
CPC ... *E04B 9/06* (2013.01); *E04B 9/18* (2013.01); *E04B 9/26* (2013.01)

(58) Field of Classification Search
CPC ..... E04B 9/003; E04B 9/125; E04B 9/26; E04B 9/06
USPC ..... 52/506.06, 506.07, 483.1
See application file for complete search history.

(56) References Cited

U.S. PATENT DOCUMENTS

| | | | | |
|---|---|---|---|---|
| 3,784,144 | A | | 1/1974 | Ollinger |
| 4,438,613 | A | | 3/1984 | Hintsa et al. |
| 4,545,166 | A | * | 10/1985 | Kielmeyer ..... 52/506.06 |
| 4,548,010 | A | | 10/1985 | Hintsa |
| 4,624,088 | A | | 11/1986 | Arent |
| 5,428,930 | A | | 7/1995 | Bagley et al. |
| 5,535,566 | A | | 7/1996 | Wilson et al. |
| 5,619,833 | A | * | 4/1997 | Neff ..... 52/506.07 |
| 6,971,210 | B2 | | 12/2005 | Kliegle et al. |
| 7,076,928 | B2 | | 7/2006 | Kliegle et al. |
| 7,805,904 | B2 | | 10/2010 | Clark et al. |
| 7,909,297 | B1 | | 3/2011 | Harris et al. |
| 8,056,294 | B2 | | 11/2011 | Lalonde |
| 8,316,607 | B2 | | 11/2012 | Eisner et al. |
| 8,413,402 | B2 | | 4/2013 | Sareyka |
| 2004/0118068 | A1 | | 6/2004 | Kliegle et al. |
| 2005/0034402 | A1 | | 2/2005 | Johnson |
| 2006/0157297 | A1 | | 7/2006 | D Antonio |
| 2007/0193131 | A1 | | 8/2007 | Ortiz |

FOREIGN PATENT DOCUMENTS

| | | |
|---|---|---|
| FR | 2762630 | 10/1998 |
| GB | 2153407 | 8/1985 |
| JP | 2002054227 | 2/2002 |

* cited by examiner

*Primary Examiner* — Basil Katcheves
(74) *Attorney, Agent, or Firm* — Amy M. Fernandez

(57) ABSTRACT

A ceiling system comprising: a grid support comprising a plurality of struts, each of the struts comprising a flange portion and a web portion, the flange portion having an upper surface and a lower surface. A ceiling panel is mounted to the grid support by a plurality of connection assemblies. The connection assemblies comprise a mounting bracket assembly, a resilient element coupled to the mounting bracket, and a saddle bracket. The saddle bracket is coupled to one of the struts. The resilient element detachably couples to the saddle bracket and biases a mounting bracket so that there is vertical and horizontal registration between the ceiling panel and the grid support.

16 Claims, 48 Drawing Sheets

ASSEMBLY FOR SUPPORTING CEILING PANELS AND CEILING SYSTEM INCORPORATING THE SAME

FIELD

The present invention relates generally to ceiling systems comprising ceiling panels, struts, mounting brackets, and saddle brackets.

BACKGROUND

Many suspended ceiling systems have been proposed and are used extensively in building construction to improve the overall appearance of the office space, to allow access to the area above the ceiling where mechanical equipment and piping is often located, and to improve the acoustics of the space.

The problem with the prior art structures is that the main thrust has been to provide a fairly simple inexpensive suspended ceiling system for use in a variety of applications. However, these systems, although inexpensive, suffer from problems of alignment of the edges of the panels to provide straight lines in both the length and width of the ceiling system; control of the level of the individual panels beneath the grid work within a fairly narrow range as variation in the height of the panels is easily recognized from beneath due to light variations; and an adequate air seal between the support grid and the ceiling panels.

The present invention is designed to alleviate the above problems of concealed suspended ceiling systems.

BRIEF SUMMARY

The invention, in one aspect, is directed to a ceiling system comprising a grid support, a ceiling panel, and a plurality of connection assemblies. The ceiling panel is mounted to the grid support by the plurality of connection assemblies.

The grid support comprises a plurality of struts, each of the struts comprising a flange portion and a web portion. The web portion extends upward from the flange portion, and the flange portion having an upper surface and a lower surface.

Each of the connection assemblies comprises a mounting bracket assembly and a saddle bracket. The mounting bracket assembly comprises a mounting bracket and a resilient element. The mounting bracket is coupled to the ceiling panel and has a first upper surface portion and a second upper surface portion. The resilient element is coupled to the mounting bracket.

The saddle bracket comprises a saddle member and a support flange. The saddle member defines a web receiving cavity. The support flange extends from the saddle member, and comprises a first lower surface portion and a second lower surface portion.

The saddle bracket is coupled to one of the struts so that the saddle member straddles the web portion of the strut and the web portion of the strut is disposed in the web receiving cavity. The saddle bracket is further coupled to one of the struts so that the first lower surface portion overlies the upper surface of the flange portion of the strut. The saddle bracket is also coupled to one of the struts so that the second lower surface portion extends beyond an edge of the flange portion of the strut.

The resilient element is detachably coupled to the saddle bracket. The resilient element biases the mounting bracket, the flange portion of the strut, and the support flange of the saddle bracket together. Specifically, the resilient element bias causes the first upper surface portion of the mounting bracket to be in contact the lower surface of the flange portion of the strut. The resilient element bias further causes the first lower surface portion of the support flange of the saddle member to be in contact with the upper surface of the flange portion of the strut. The resilient element bias also causes the second upper surface portion of the mounting bracket to be in contact with the second lower surface portion of the support flange of the saddle member.

In another embodiment, the present invention is directed to a grid assembly for hanging a ceiling panel, the grid assembly comprising a grid support and a saddle bracket. The grid support comprises at least one strut comprising a flange portion and a web portion. The web portion extends upward from the flange portion, and the flange portion has an upper surface and a lower surface.

The saddle bracket comprises a saddle member and a support flange. The saddle member defines a web receiving cavity. The support flange extends from the saddle member. The support flange comprises a first lower surface portion and a second lower surface portion that is vertically offset from the first lower surface portion.

The saddle bracket is coupled to one of the struts so that the saddle member straddles the web portion of the strut and the web portion of the strut is disposed in the web receiving cavity. The saddle bracket is further coupled to one of the struts so that the first lower surface portion contacts the upper surface of the flange portion of the strut. The saddle bracket is also coupled to one of the struts so that the second lower surface portion extends beyond an edge of the flange portion of the strut and is substantially coplanar with the lower surface of the flange portion of the strut.

In another embodiment, the present invention is directed to a saddle bracket for a ceiling system, wherein the saddle bracket comprises a saddle member and a first support flange. The saddle member comprises a first wall plate, a second wall plate, and a bight portion. The bight portion connects the first and second wall plates. The bight portion, the first wall plate, and the second wall plate collectively define a web receiving cavity that extends along a central vertical plane.

The first support flange extends from the first wall plate. The first support flange comprises a stepped lower surface comprising a first lower surface portion and a second lower surface portion that is vertically offset from the first lower surface portion.

In another embodiment, the present invention is directed to a ceiling system comprising a grid support, a ceiling panel, and a plurality of connection assemblies. The ceiling panel is mounted to the grid support by the plurality of connection assemblies.

The grid support comprises a plurality of struts, each of the struts comprising a flange portion and a web portion. The web portion extends upward from the flange portion.

Each of the connection assemblies comprises a mounting bracket assembly and a saddle bracket. The mounting bracket assembly comprises a mounting bracket and a resilient element coupled to the mounting bracket. The saddle bracket comprises a saddle member defining a web receiving cavity and a stepped support flange extending from the saddle member. The saddle bracket is coupled to one of the struts so that the web portion of the strut is disposed in the web receiving cavity.

The resilient element is detachably coupled to the saddle bracket. The resilient element biases the mounting bracket, the flange portion of the strut, and the support flange of the saddle bracket together. Specifically, the resilient element bias causes the mounting bracket and the stepped support flange of the saddle bracket to be in contact with one another.

The resilient element bias further causes the flange portion of the strut to be sandwiched between and in contact with each of the mounting bracket and the stepped support flange.

Another embodiment of the present invention includes a grid assembly for hanging a ceiling panel. The grid assembly comprises a grid support and a saddle bracket. The grid support comprises at least one strut. The strut comprises a flange portion and a web portion. The web portion extends upward from the flange portion. A bulb portion is located on the web portion, and the bulb portion comprises an undersurface. The saddle bracket comprises a horizontal locking feature, a vertical locking feature, a panel mounting feature, and a web receiving cavity.

The saddle bracket is mounted to the strut so that the web portion of the strut is disposed in the web receiving cavity. The saddle bracket is further mounted to the strut so that the vertical locking feature of the saddle bracket engages the undersurface of the bulb portion, thereby vertically locking the saddle bracket to the strut.

The horizontal locking feature of the saddle bracket is alterable between a first state and a second state. In the first state, the saddle bracket can slide horizontally along the strut while the saddle bracket remains vertically locked to the strut. In the second state, the horizontal locking element engages the web portion of the strut, thereby horizontally locking the saddle bracket to the strut.

In another embodiment, the present invention is directed to a ceiling system comprising a grid support, a ceiling panel, and a plurality of connection assemblies. The ceiling panel is mounted to the grid support by the plurality of connection assemblies.

The grid support comprises a plurality of struts, each of the struts comprising a flange portion, a web portion. The web portion extends upward from the flange portion. A bulb portion is on the web portion, wherein the bulb portion comprising an undersurface.

Each of the connection assemblies comprises a mounting bracket assembly and a saddle bracket. The mounting bracket assembly comprises a mounting bracket and a resilient element. The mounting bracket is coupled to the ceiling panel and the resilient element is coupled to the mounting bracket.

The saddle bracket comprises a saddle member, a horizontal locking feature, a vertical locking feature, and a support flange. The saddle member defines a web receiving cavity. The support flange extends from the saddle member.

The saddle bracket mounted to one of the struts so that the saddle member straddles the web portion of the strut and the web portion of the strut is disposed in the web receiving cavity. The saddle bracket is further mounted to one of the struts so that the vertical locking feature of the saddle bracket engages an undersurface of the bulb portion, thereby vertically locking the saddle bracket to the strut.

The horizontal locking feature of the saddle bracket alterable between a first state and a second state. In the first state, the saddle bracket can slide horizontally along the strut while the saddle bracket remains vertically locked to the strut. In the second state, the horizontal locking element engages the web portion of the strut, thereby horizontally locking the saddle bracket to the strut. Additionally, the resilient element detachably coupled to the saddle bracket.

In another embodiment, the present invention includes a saddle bracket for a ceiling system. The saddle bracket comprises a first wall plate, a second wall plate, a bight portion, a first support flange, a second support flange, a vertical locking feature, and a horizontal locking feature.

The first wall plate extends from a first side edge to a second side edge, the first and second side edges of the first wall plate being free edges. The second wall plate extends from a first side edge to a second side edge, the first and second side edges of the second wall plate being free edges. The bight portion connects the first and second wall plates. The bight portion, the first wall plate, and the second wall plate collectively defining a web receiving cavity that extends along a central vertical plane. The first support flange extends from a lower end the first wall plate. The second support flange extends from a lower end of the second wall plate.

The vertical locking feature extends into the receiving cavity. The vertical locking feature is configured to engage an undersurface of a bulb portion of a strut to vertically lock the saddle bracket to the strut upon a web portion of the strut being inserted into the web receiving cavity.

The horizontal locking feature comprising a barb portion configured to penetrate the bulb portion of the strut upon. The horizontal locking feature alterable between a first position and a second position. In the first position, the barb portion does not extend into the web receiving cavity. In the second position, the barb portion is located within the web receiving cavity.

In another embodiment, the present invention is directed to a ceiling panel apparatus comprising a ceiling panel, a plurality of mounting bracket assemblies, and a multi-purpose fastener. The plurality of mounting bracket assemblies are coupled to the ceiling panel.

The mounting bracket assemblies comprise a mounting bracket and a torsion spring. The mounting bracket comprises a base plate, a hook member, and a receiving slot. The base plate comprises a multi-purpose aperture. The hook member is coupled to the based plate and comprises a free end. The receiving slot is formed between the free end of the hook member and an upper surface of the base plate.

The torsion spring comprises a ring portion, a first spring leg, and a second spring leg. The hook member of the mounting bracket extends through a central opening of the ring portion of the torsion spring to mount the torsion spring to the mounting bracket.

The multi-purpose fastener is alterable between a locked state and an unlocked state. In the locked state, the multi-purpose fastener extends through the multi-purpose aperture of the base plate and fastens the mounting bracket to the ceiling panel. In the locked state, the multi-purpose fastener also obstructs the receiving slot so as to prohibit the ring portion of the torsion spring from passing through the receiving slot, thereby locking the torsion spring to the mounting bracket. In the unlocked state, the multi-purpose fastener does not obstruct the receiving slot to allow the ring portion of the torsion spring to pass through the receiving slot.

The present invention includes another embodiment directed to a suspended ceiling system comprising a plurality of struts, a plurality of connection assemblies, and a ceiling panel. The ceiling panel mounted to the struts by the plurality of connection assemblies. The plurality of struts is arranged in a grid support plane.

Each of the struts comprising a web portion and a flange portion. Each of the connection assemblies comprises a mounting bracket, a torsion spring, a multi-purpose fastener, and a mounting slot.

The mounting bracket comprises a base plate, a hook member, and a hook member. The base plate comprises a multi-purpose aperture, a hook member, and a receiving slot. The hook member is coupled to the base plate and the hook member comprising a free end. The receiving slot is formed between the free end of the hook member and an upper surface of the base plate.

The torsion spring comprises a ring portion, a first spring leg, and a second spring leg. The hook member of the mounting bracket extends through a central opening of the ring portion of the torsion spring to mount the torsion spring to the mounting bracket.

The multi-purpose fastener alterable between a locked state and an unlocked state. In the locked state, the multi-purpose fastener extends through the multi-purpose aperture of the base plate and fastens the mounting bracket to the ceiling panel. In the locked state, the multi-purpose fastener also obstructs the receiving slot so as to prohibit the ring portion of the torsion spring from passing through the receiving slot, thereby locking the torsion spring to the mounting bracket. In the unlocked state, the multi-purpose fastener does not obstruct the receiving slot to allow the ring portion of the torsion spring to pass through the receiving slot.

The mounting slot is located in one of a flange portion of one of the struts or a saddle bracket that is coupled to one of the struts. The first and second spring legs of the torsion spring extending through the mounting slot.

Another embodiment of the present invention includes a mounting bracket assembly for supporting a ceiling panel. The mounting bracket assembly comprising a mounting bracket, a torsion spring, and a multi-purpose fastener.

The mounting bracket comprises a base plate, a hook member, and a receiving slot. The base plate comprises a multi-purpose aperture. The hook member is coupled to the base plate, and the hook member comprises a free end. The receiving slot is formed between the free end of the hook member and an upper surface of the base plate.

The torsion spring comprises a ring portion, a first spring leg, and a second spring leg. The hook member of the mounting bracket extends through a central opening of the ring portion of the torsion spring to mount the torsion spring to the mounting bracket.

The multi-purpose fastener alterable between a locked state and an unlocked state. In the locked state, the multi-purpose fastener extends through the multi-purpose aperture of the base plate. In the locked state, the multi-purpose fastener also obstructs the receiving slot so as to prohibit the ring portion of the torsion spring from passing through the receiving slot, thereby locking the torsion spring to the mounting bracket. In the unlocked state, the multi-purpose fastener does not obstruct the receiving slot to allow the ring portion of the torsion spring to pass through the receiving slot.

The present invention includes an additional embodiment directed to a ceiling system comprises a grid support, a ceiling panel, and a plurality of connection assemblies. The ceiling panel is mounted to the grid support by the plurality of connection assemblies.

The grid support comprising a plurality of struts. Each of the struts comprises a flange portion and a web portion extending upward from the flange portion. The flange portion has an upper surface and a lower surface.

Each of the connection assemblies comprises a mounting bracket assembly and a saddle bracket. The mounting bracket assembly comprises a mounting bracket and a resilient element. The mounting bracket is coupled to the ceiling panel. The mounting bracket comprising an upper surface and a wall surface. The resilient element is coupled to the mounting bracket.

The saddle bracket comprises a saddle member and a support flange. The saddle member defines a web receiving cavity. The support flange extends from the saddle member. The saddle bracket is coupled to one of the struts so that the saddle member straddles the web portion of the strut and the web portion of the strut is disposed in the web receiving cavity. The saddle bracket is also coupled to one of the struts so that the support flange is located above and spaced from the flange portion of the strut. The saddle bracket is further coupled to one of the struts so that a portion of the support flange extends beyond an edge of the flange portion of the strut.

The resilient element is detachably coupled to the saddle bracket. The resilient element biases the mounting bracket so that the upper surface of the mounting bracket contacts the portion of the support flange that extends beyond the edge of the flange portion of the strut to provide vertical registration between the ceiling panel and the grid support. The resilient element further biases the mounting bracket so that the wall surface of the mounting bracket is located adjacent the edge of the flange portion of the strut to provide horizontal registration between the ceiling panel and the grid support.

Further areas of applicability of the present invention will become apparent from the detailed description provided hereinafter. It should be understood that the detailed description and specific examples, while indicating some embodiments of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION

Figure 1:
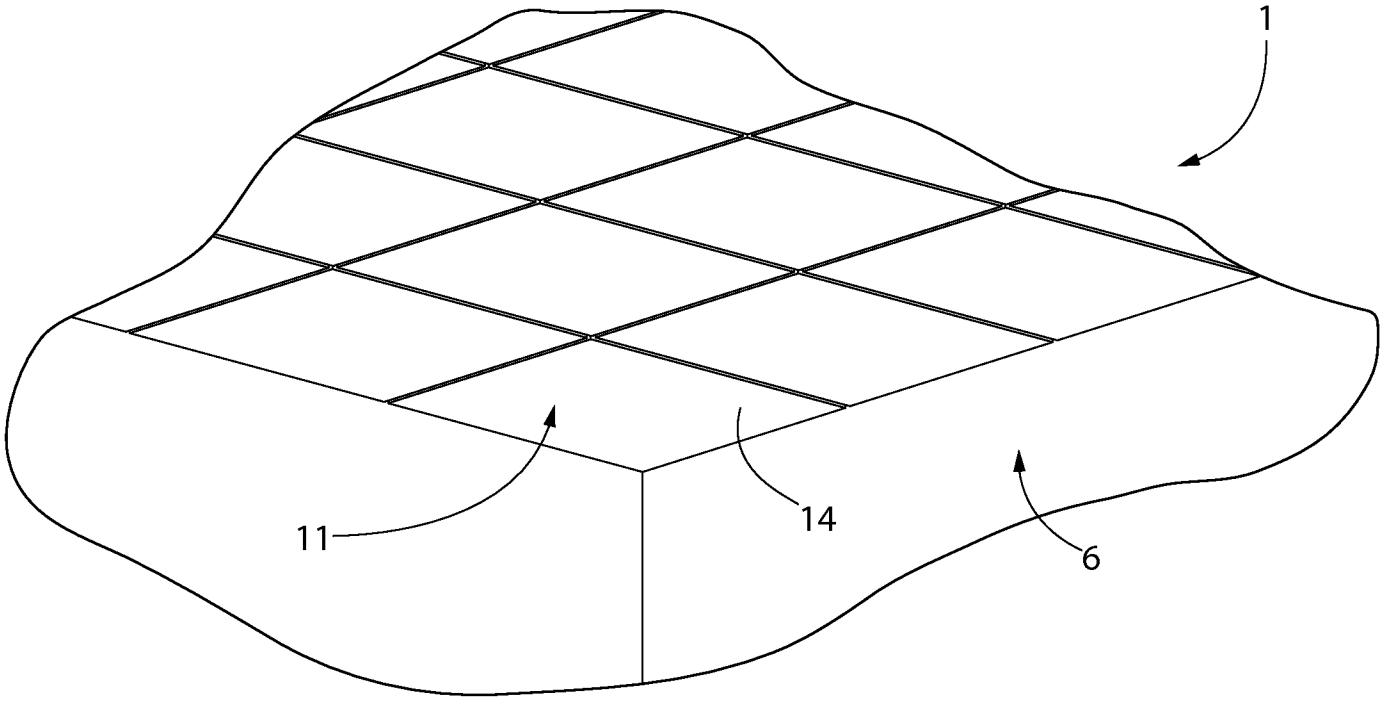
FIG. 1 is a front partial perspective view of the ceiling system in a first state according to the present invention.
Figure 2:
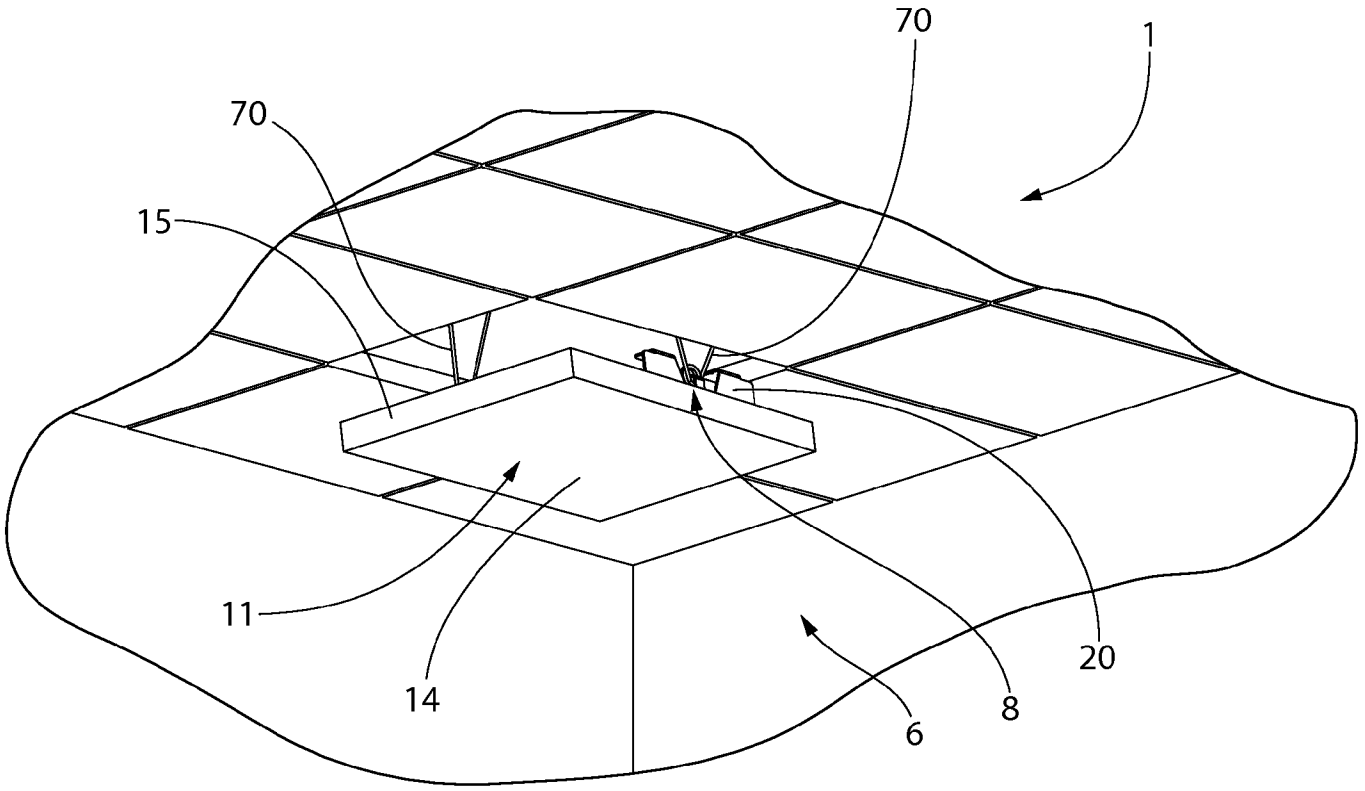
FIG. 2 is a front partial perspective view of the ceiling system in a second state according to the present invention.

The following description of some embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

FIGS. 1-5 show a suspended ceiling system 1 ("ceiling system") comprising at least one ceiling panel 11, a grid support 2, a plurality of connection assemblies 3, and at least one ceiling panel 11. As shown in FIG. 6, each ceiling panel 11 comprises an upper surface 13, a lower surface 14, and a peripheral surface 15. A crawl space 5 is located above the grid support 2 and an active room environment 6 is located beneath the grid support 2. When the ceiling system 1 is fully installed, the upper surface 13 of the ceiling panel 11 faces the crawl space 5 and the lower surface 6 of the ceiling panel 11 faces the active room environment 6.

Figure 3:
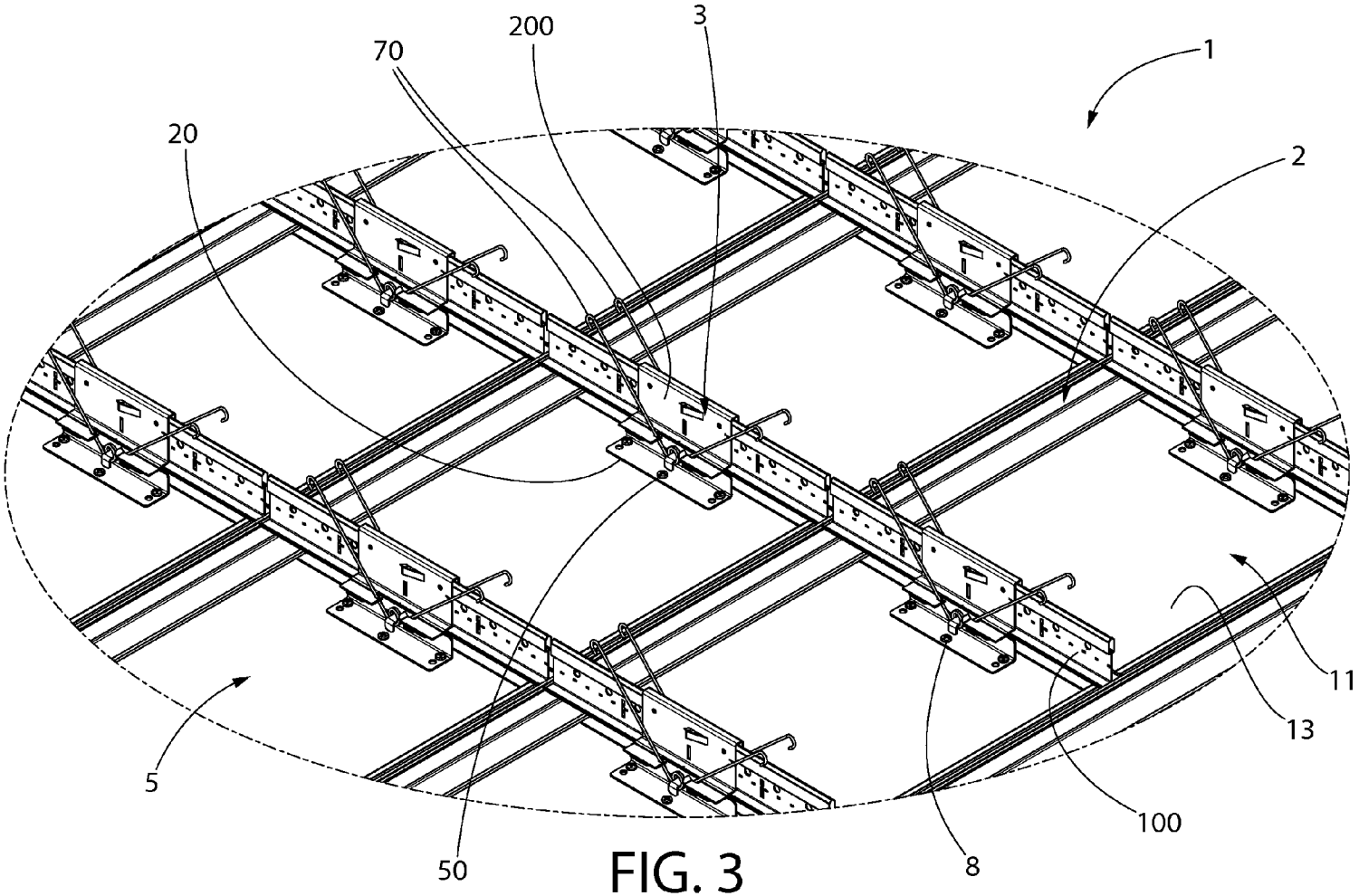
FIG. 3 is a rear partial perspective view of the ceiling system in the first state according to a first embodiment of the present invention.
Figure 4:
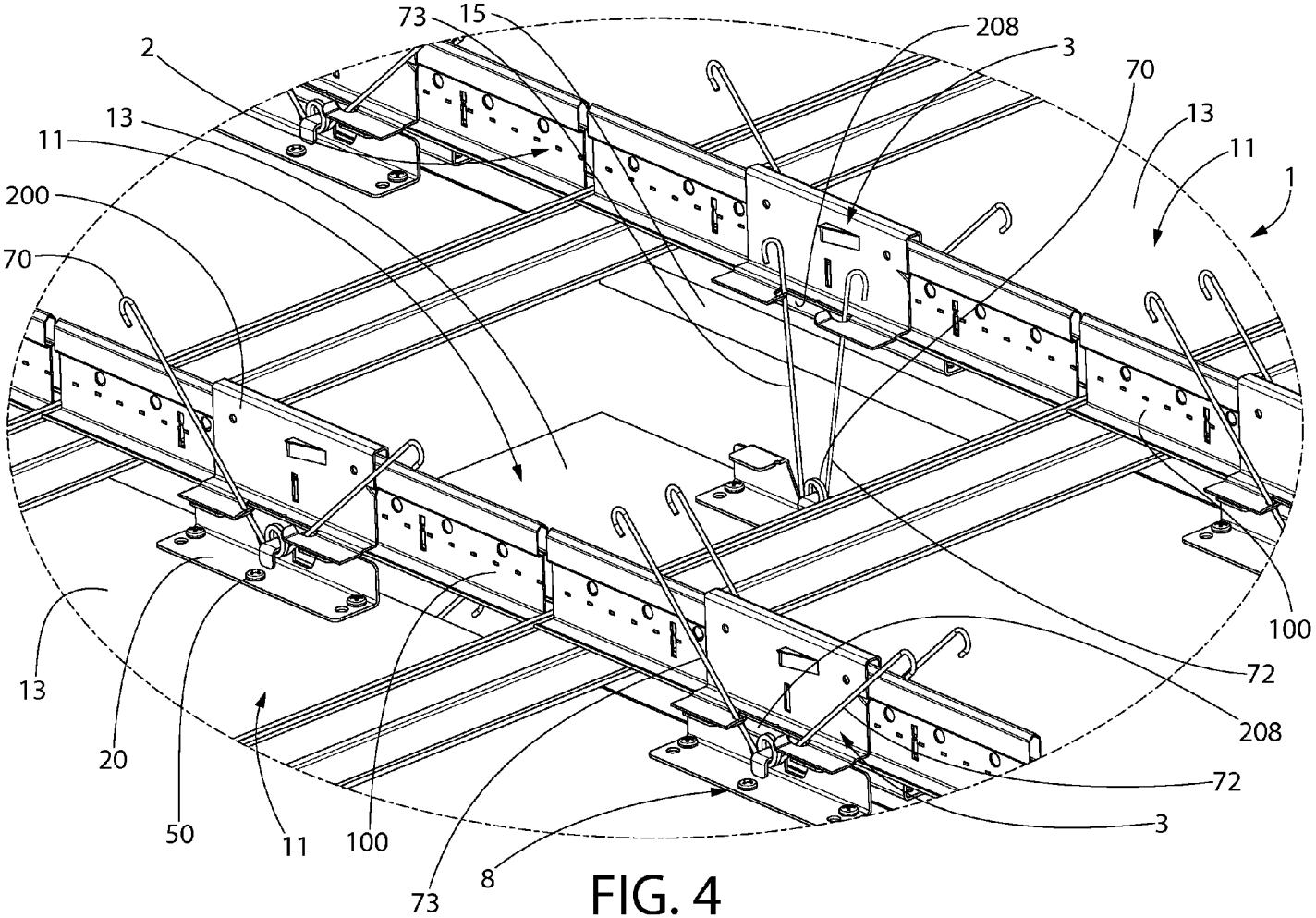
FIG. 4 is a rear partial perspective view of the ceiling system in the second state according to the first embodiment of the present invention.
Figure 5:
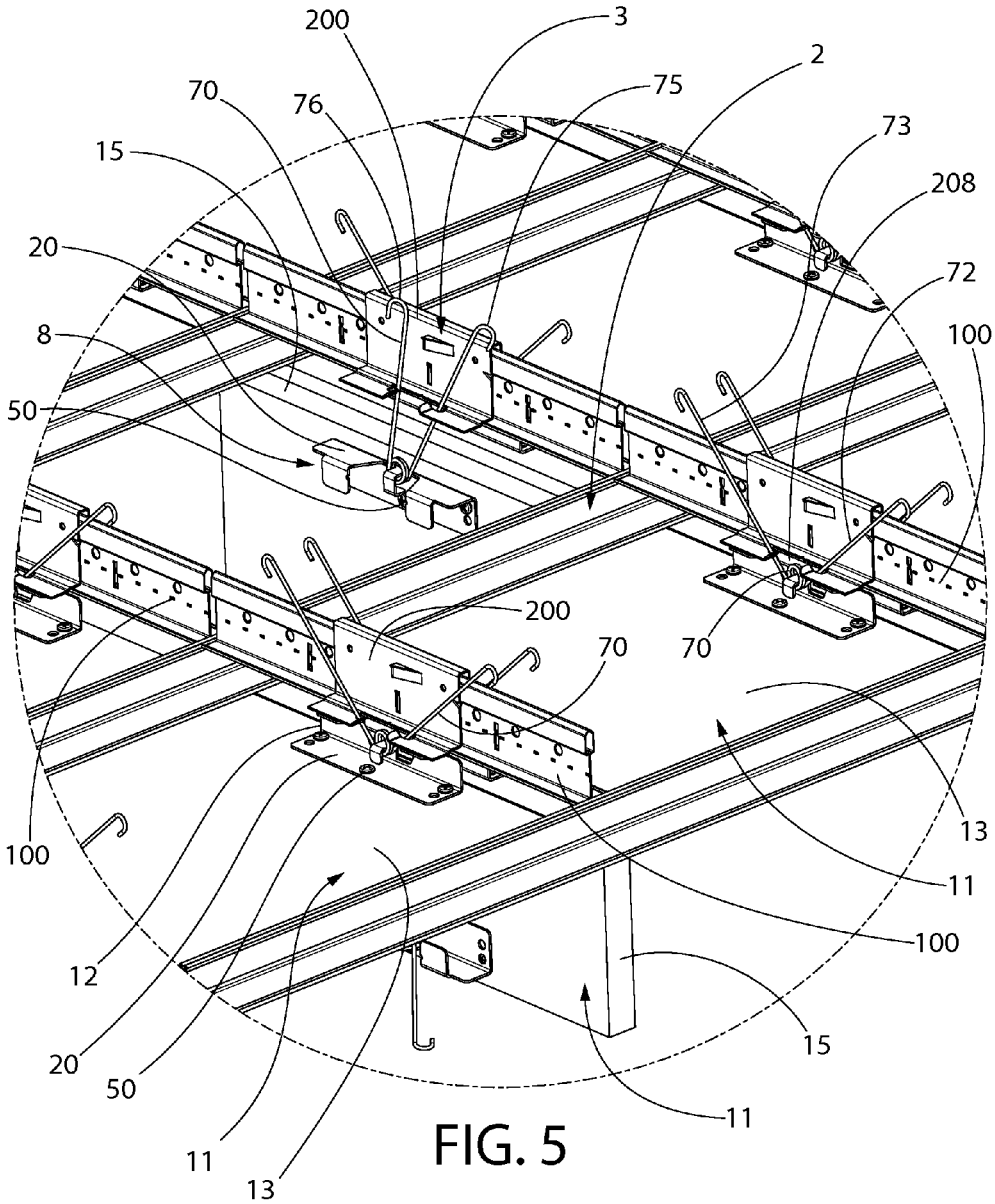
FIG. 5 is a rear partial perspective view of the ceiling system in a third state according to the first embodiment of the present invention.
Figure 6:
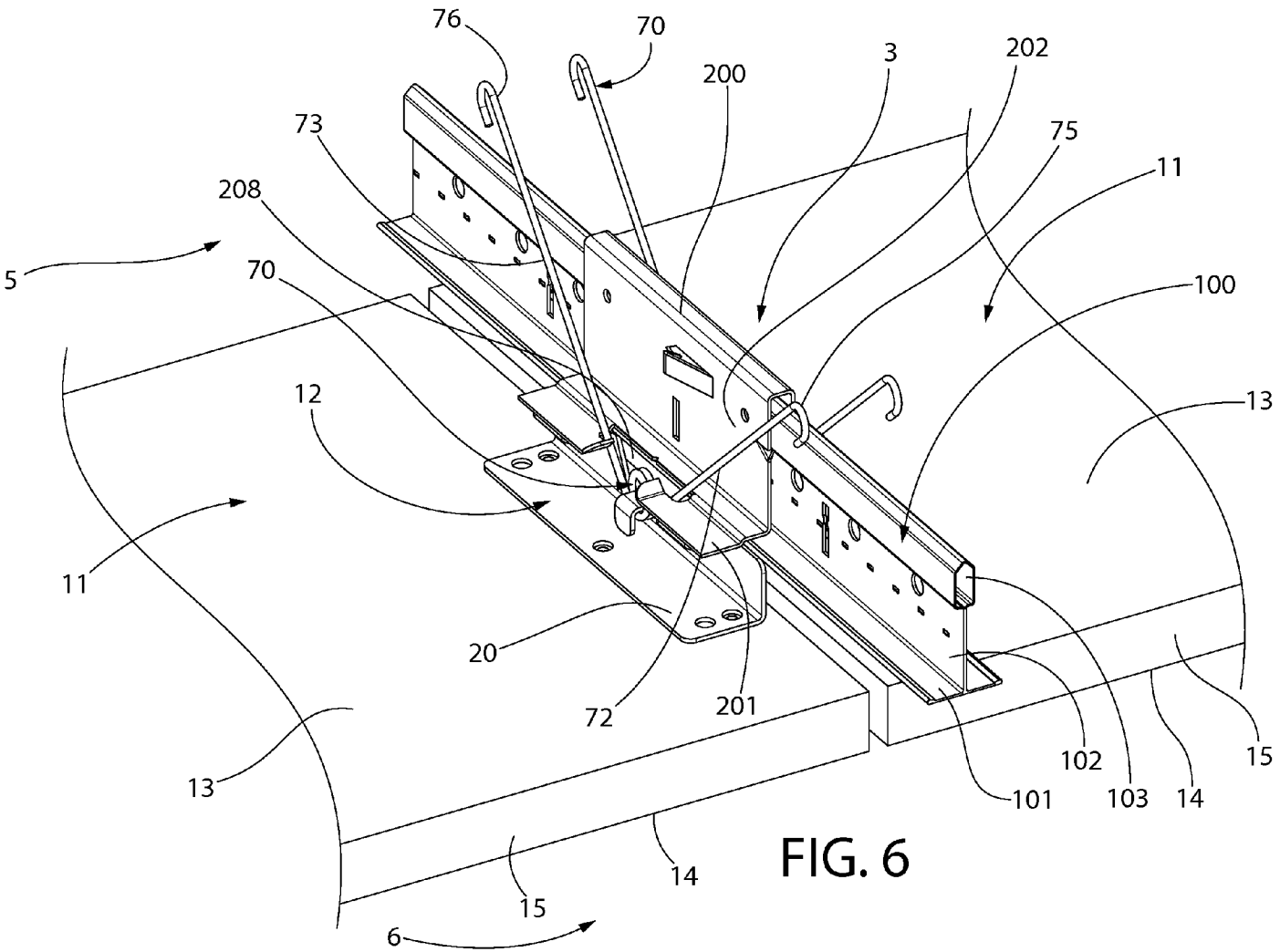
FIG. 6 is a close-up rear partial perspective view of the ceiling system in the first state according to the first embodiment of the present invention.

FIGS. 3-5 show the grid support 2, which comprises a plurality of struts 100 arranged in an intersecting manner to create a grid support plane. The intersecting struts 100 may be offset from each other by an offset angle. In non-limiting examples, the offset angles between intersecting struts 100 may be 20°, 30°, 35°, 45°, 60°, 65°, 70°, 90°, and combinations thereof. The plurality of connection assemblies 3 are coupled to the plurality of struts 100 and the ceiling panels 11 are coupled to the connection assemblies 3, thereby mounting the ceiling panels 11 to the grid support 2 via the plurality of connection assemblies 3.

As shown in FIG. 6, each of the plurality of connection assemblies 3 comprises a mounting bracket assembly 12 and a saddle bracket 200. As shown in FIGS. 8, 9, 10A, 12, and 13 the mounting bracket assembly 12 comprises a mounting bracket 20, a resilient element 70, and a multi-purpose fastener 50 (the multi-purpose fastener 50 is not shown in the mounting bracket assembly 12 of FIGS. 8 and 9).

Figure 31:
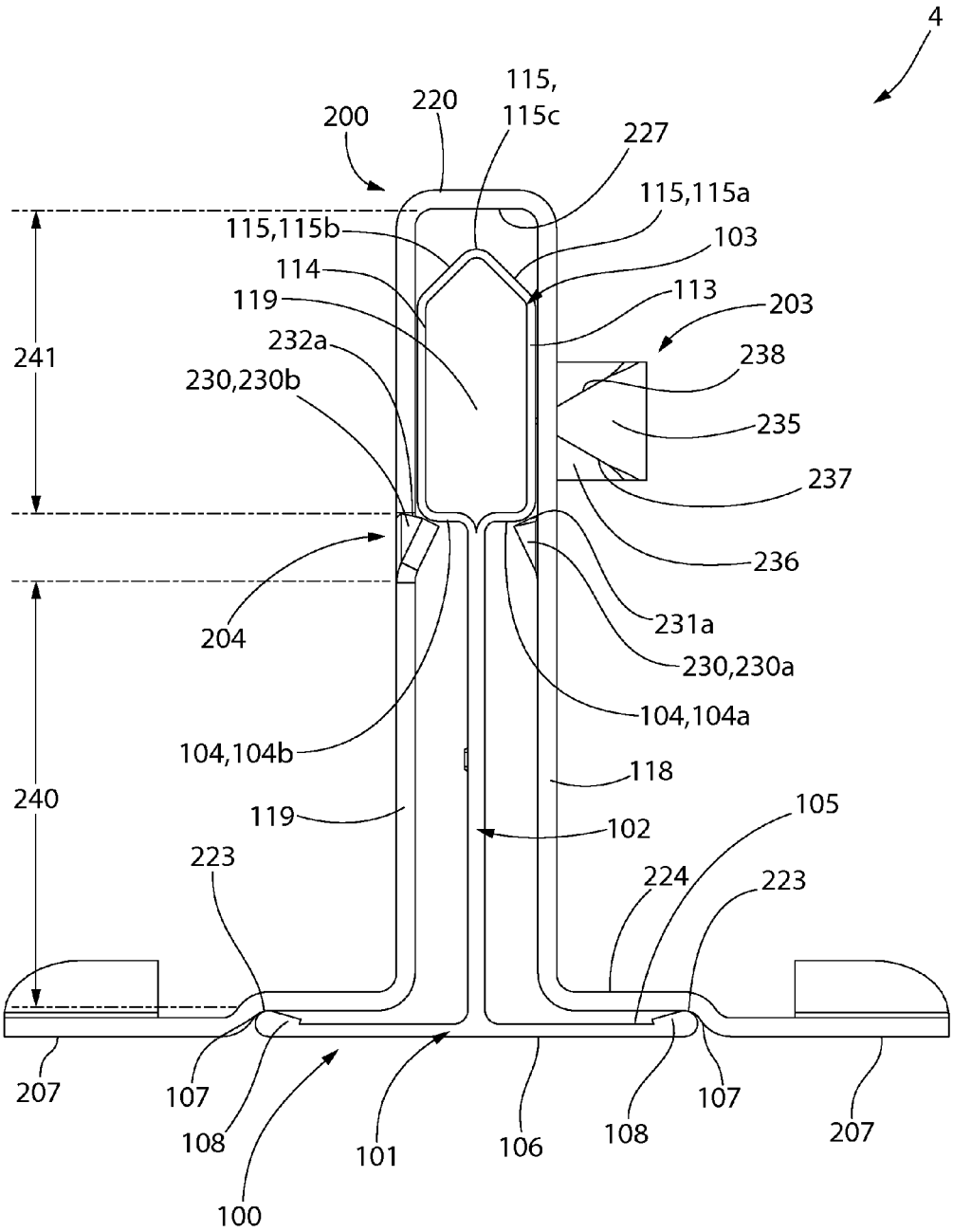
FIG. 31 is a left side view of the grid assembly according to the first embodiment of the present invention.
Figure 32A:
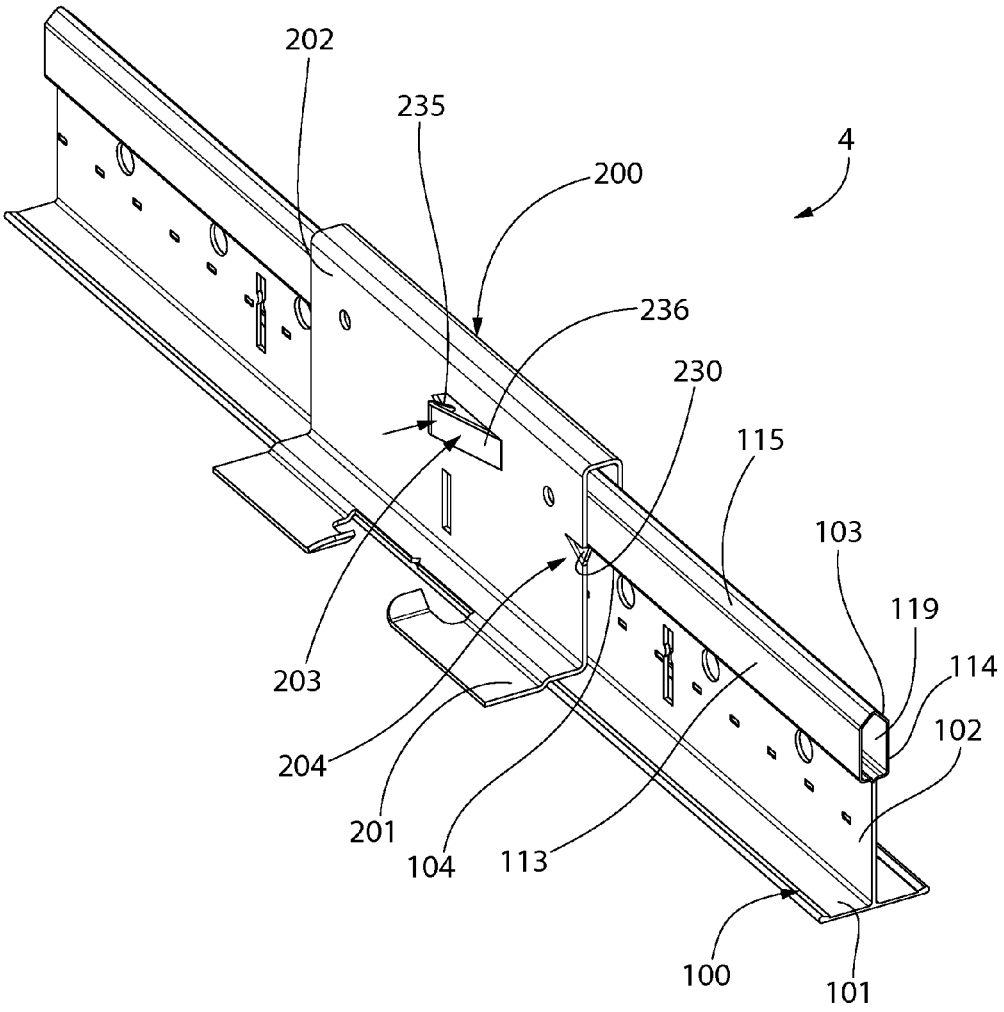
FIG. 32A is a downward front perspective view of the grid assembly according to the first embodiment of the present invention.
Figure 32B:
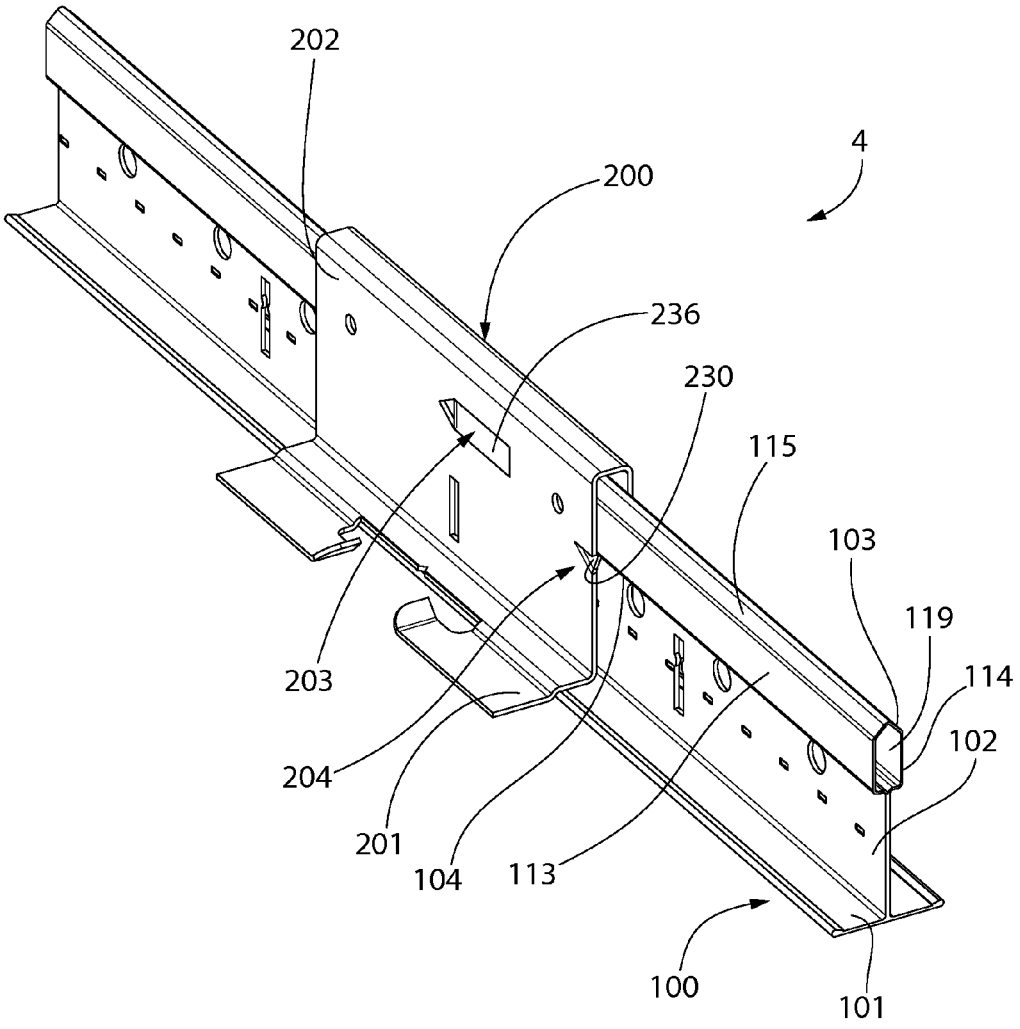
FIG. 32B is a downward front perspective view of the grid assembly according to the first embodiment of the present invention.

As shown in FIGS. 31, 32A, and 32B, the current invention further comprises a grid assembly 4. Each grid assembly 4 comprises the saddle bracket 200 mounted to the strut 100.

As shown in FIGS. 12-14 and 16-17, the current invention further comprises a plurality of ceiling panel apparatuses 8. Each of the plurality of ceiling panel apparatuses 8 comprises the ceiling panel 11, the mounting bracket 20, the resilient element 70, and a multi-purpose fastener 50.

Figure 30:
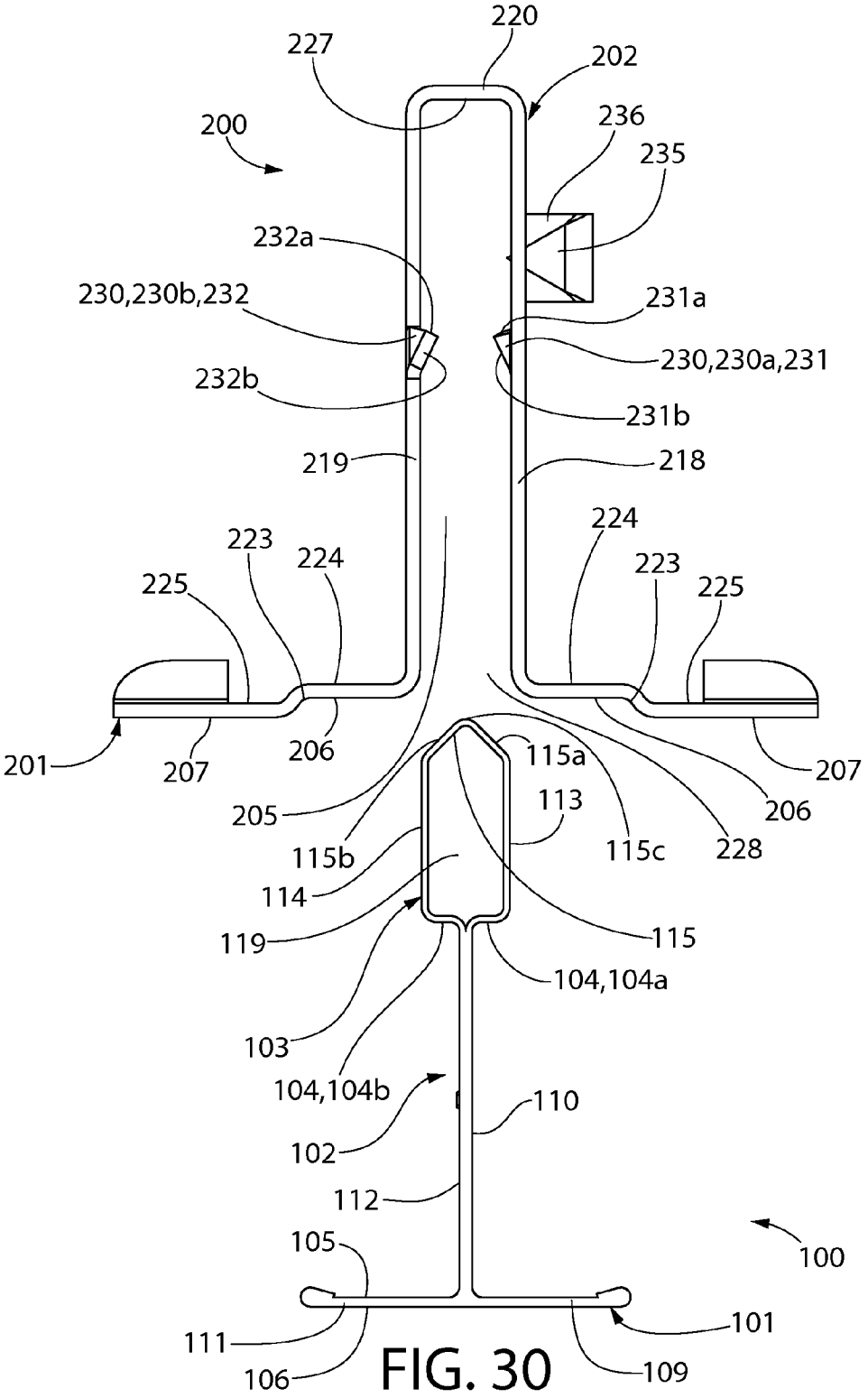
FIG. 30 is a left side view of the strut and the saddle bracket in the first saddle state according to the first embodiment of the present invention.

As shown in FIGS. 6, 30, and 31, each of the struts 100 comprises a flange portion 101, a web portion 102, and a bulb portion 103 that extends from the web portion 102. As shown in FIGS. 30, 31, 49, and 50, the flange portion 101 comprises an upper surface 105, a lower surface 106, an edge 107, and a bead 108. The flange portion 101 further comprising a first portion 109 of the flange portion 101 that extends from a first side 110 of the web portion 102. The flange portion 101 further comprises a second portion 111 of the flange 101 that extends from a second side 112 of the web portion 102. The bead 108 is located adjacent to the edge 107 of the flange portion 101, and the bead 108 comprises the upper surface 105 of the flange portion 101. The strut 100 may comprise a mounting slot formed in the flange portion 101 of the strut 100. The mounting slot of the strut 100 may be located on the first portion 109, the second portion 111, or both portions 109, 111 of the flange portion 101.

The web portion 102 extends upward from the flange portion 101. The bulb portion 103 is on the web portion 102 as the upward most portion of the strut 100. The bulb portion 103 comprises an undersurface 104, first and second side surface 113, 114, and a top surface 115. The undersurface 104 has a first undersurface portion 104*a* and a second undersurface portion 104*b*. The first undersurface portion 104*a* is located on the first side 110 of the web portion 102 and the second undersurface portion 104*b* is located on the second side 112 of the web portion 102. The undersurface 104 of the bulb portion 103 faces the upper surface 105 of the flange portion 101. The edge 107 of the support flange 101 extends outwardly in a horizontal direction from the web portion 102 further than the first and second side surfaces 113, 114 of the bulb portion 103.

The first side surface 113 of the bulb portion 103 extends from the first undersurface 104*a* and the second side surface 114 of the bulb portion 103 extends from the second undersurface 104*b*. The first and second side surfaces 113, 114 face outward in an opposite direction from each other. The upper surface 115 extends from the first and second side surfaces 113, 114 and encloses the bulb portion 103. The top surface comprises a first sloped portion 115*a* and a second sloped portion 115*b* that converge at an apex 115*c*. The first sloped portion 115*a* extends from the first side surface 113 of the bulb portion 103 and the second sloped portion 115*b* extends from the second side surface 114. The apex 115*c* of the bulb portion 103 is the transitional point from the first side 110 of the web portion 102 to the second side 112 of the web portion 102 of the strut 100.

Each of the struts 100 comprises a first height measured from the lower surface 106 of the flange portion 101 to an upper most surface 115*c* (apex of the bulb portion 103) of the web portion 102 of the strut.

Figure 34:
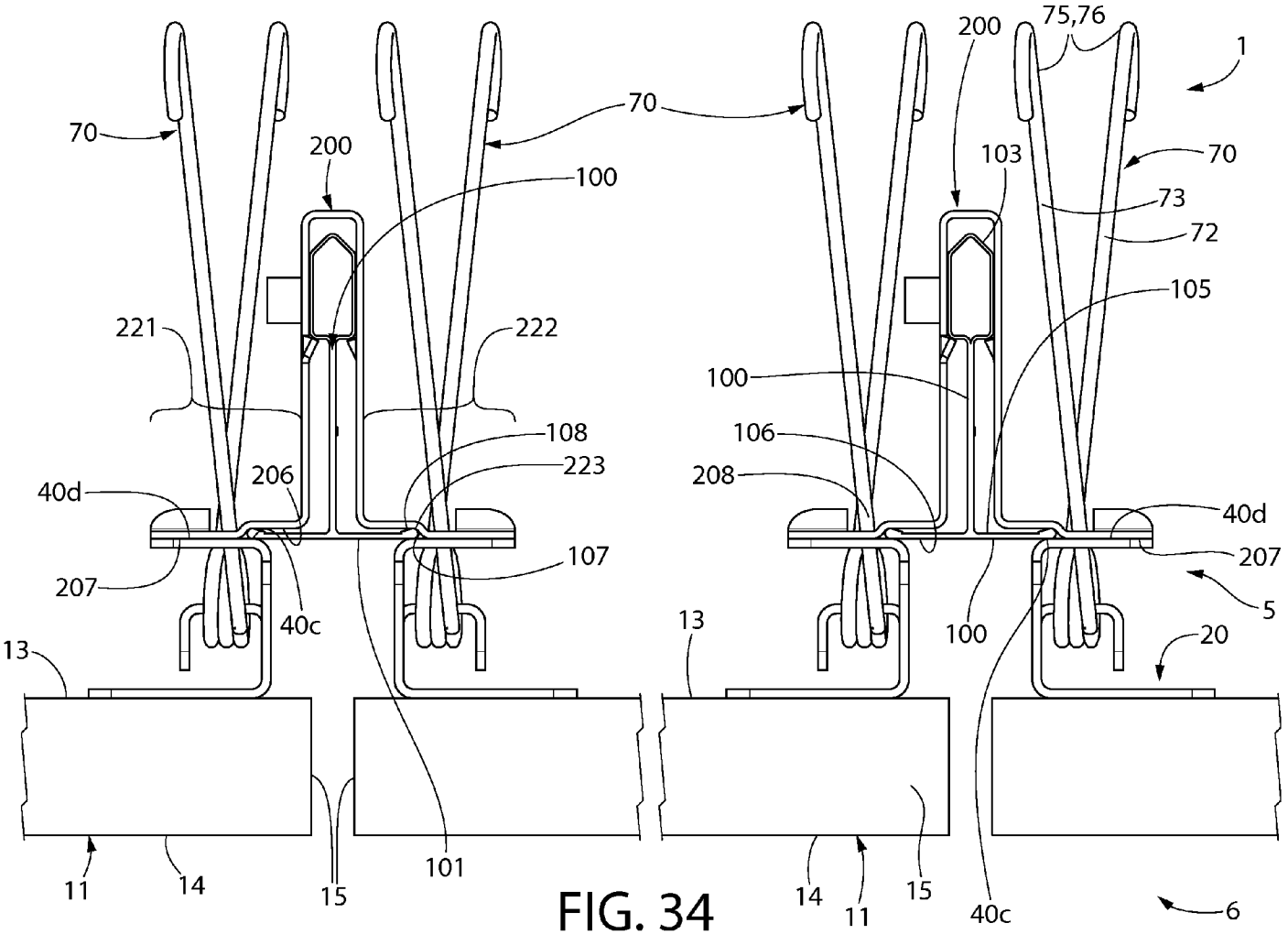
FIG. 34 is a right side view of the ceiling system in the first state according to the first embodiment of the present invention.

As shown in FIGS. 6 and 34, the connection assemblies 3 comprise the mounting bracket assembly 12 and the saddle bracket 200. The mounting bracket assembly 12 comprises the mounting bracket 20 and a resilient element 70. As shown in FIGS. 12-14 and 16-17, each of the plurality of ceiling panel apparatuses 8 comprises the ceiling panel 11, the mounting bracket 20, the resilient element 70, and a multi-purpose fastener 50.

As shown in FIGS. 7-9, 10B, 11B, 18, and 19, each mounting bracket 20 comprises a base plate 21, a hook member 23, a receiving slot 26, a wall plate 35, and an upper plate 40. The base plate 21 comprises an upper surface 21*a*, a lower surface 21*b*, a first longitudinal edge 21*c*, a second longitudinal edge 21*d*, a first transverse edge 21*e*, and a second transverse edge 21*f*. The base plate 21 further comprises a longitudinal base plate axis A-A extending from the first transverse edge 21*e* to the second transverse edge 21*f*. The base plate 21 also comprises a transverse base plate axis B-B extending from the first longitudinal edge 21*c* to the second transverse edge 21*d*.

The base plate 21 has a length that extends parallel to the longitudinal base plate axis A-A. The base plate 21 length is measured from the first transverse edge 21*e* to the second transverse edge 21*f* of the base plate 21. The base plate 21 has a width that extends parallel to the transverse base plate axis B-B. The base plate 21 width is measured from the first longitudinal edge 21*c* to the second longitudinal edge 21*d* of the base plate 21. The base plate 21 has a thickness that is measured from the upper surface 21*a* to the lower surface 21*b* of the base plate 21.

The base plate 21 further comprises a multi-purpose aperture 22 and one or a plurality of coupling apertures 27 that extend from the upper surface 21*a* to the lower surface 21*b* of the base plate 21. In some embodiments, the multi-purpose aperture 22 and the coupling apertures 27 circular or polygonal perimeters.

As shown in FIGS. 7 and 18-21, the hook member 23 is coupled to the base plate 21. The hook member 23 comprises a first portion 32 that extends upward from the upper surface 21*a* of the base plate 21. The hook member 23 also comprises a second portion 33 that extends from the first portion 32 and above the base plate 21. The hook member 23 further comprises a third portion 34 extending downward from the second portion 33 toward the base plate 21 and terminates in a free end 24. The first portion 32 and the second portion 33 are substantially perpendicular to each other. The second 33 and third portion 34 are substantially perpendicular to each other. The first 32 and the third portion 34 are substantially parallel to each other.

Figure 20:
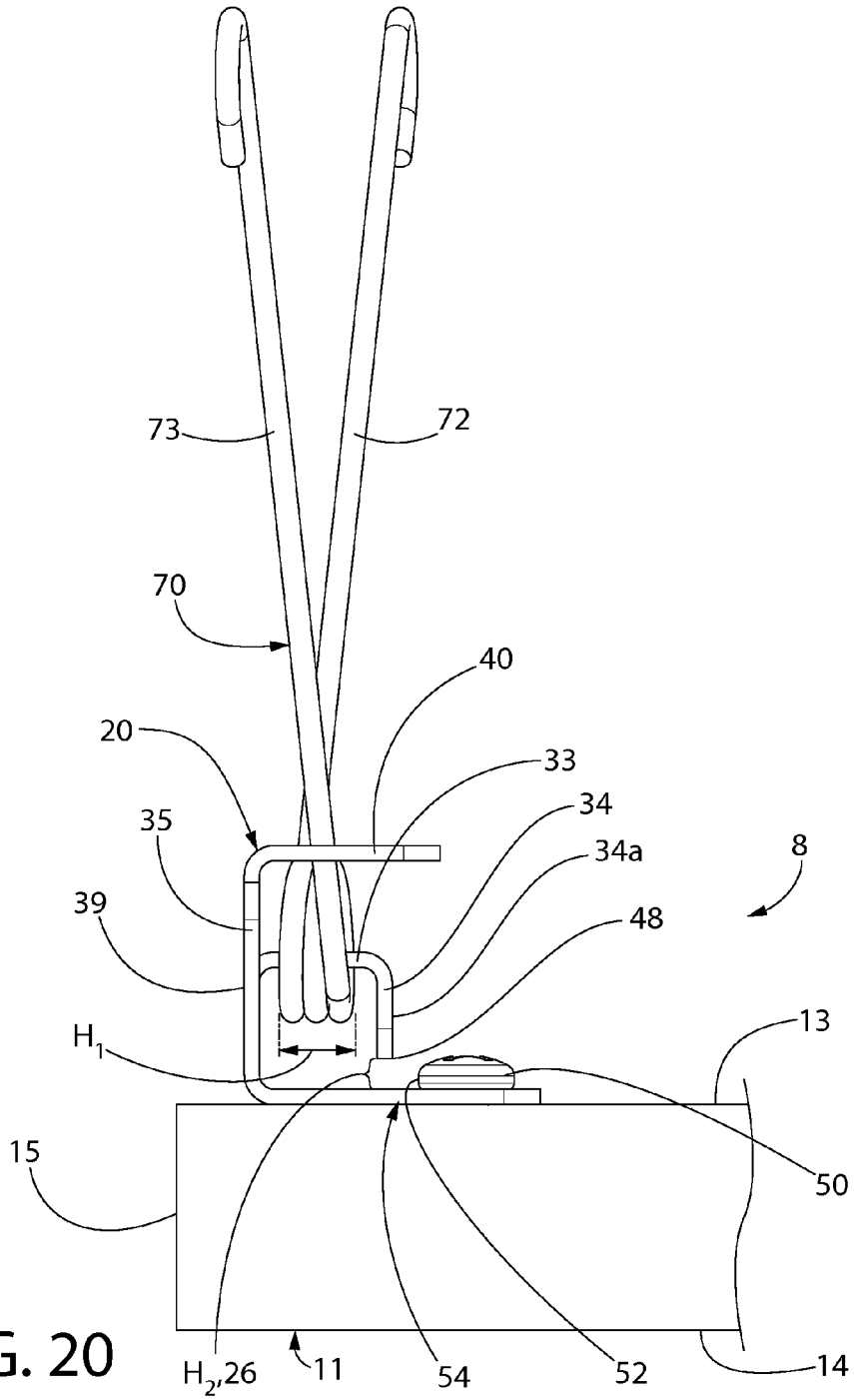
FIG. 20 is a side view of the ceiling panel apparatus according to the present invention.
Figure 21:
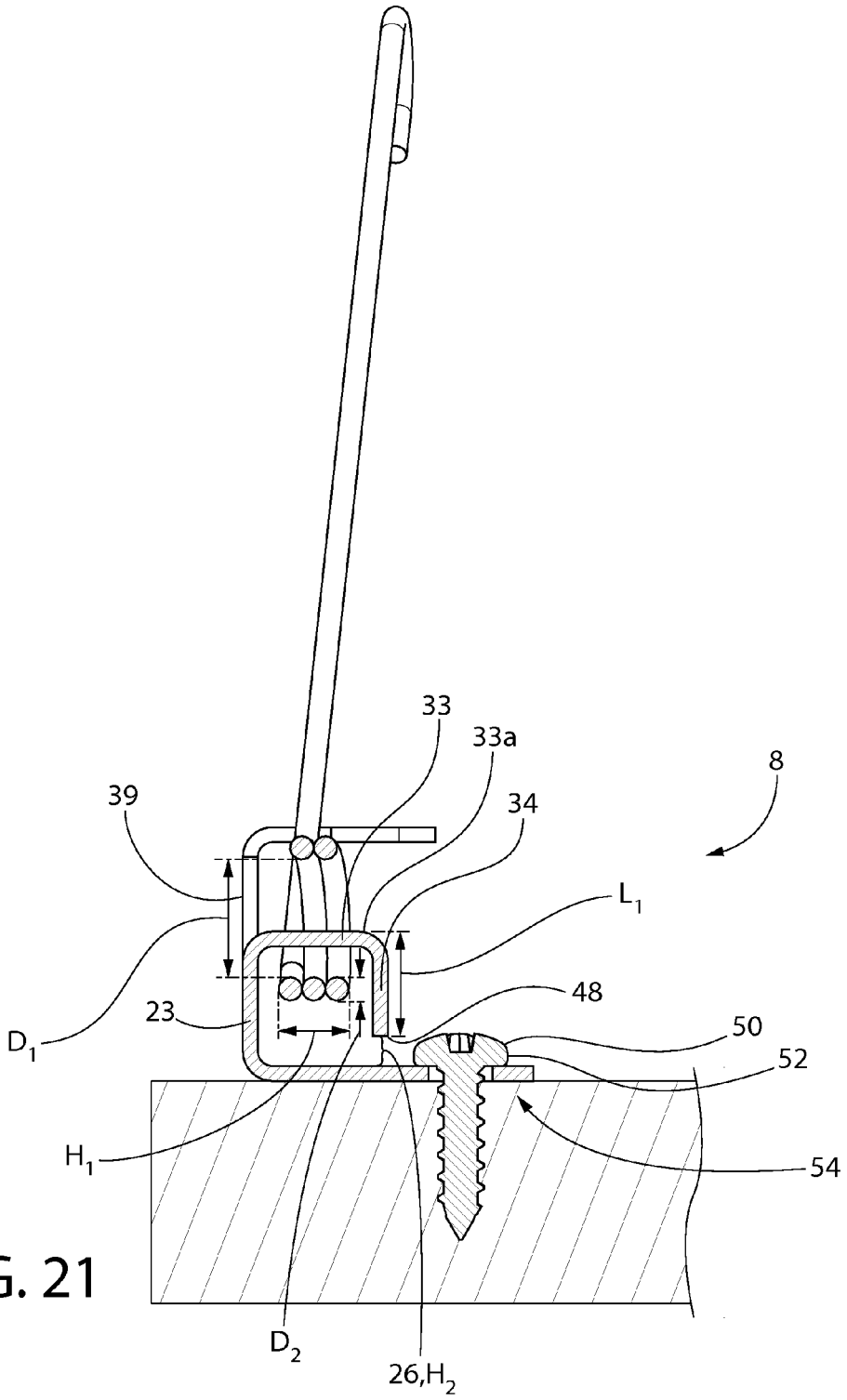
FIG. 21 is a cross-sectional view of the ceiling panel apparatus according to the present invention along the XXI-XXI of FIG. 16.
Figure 22A:
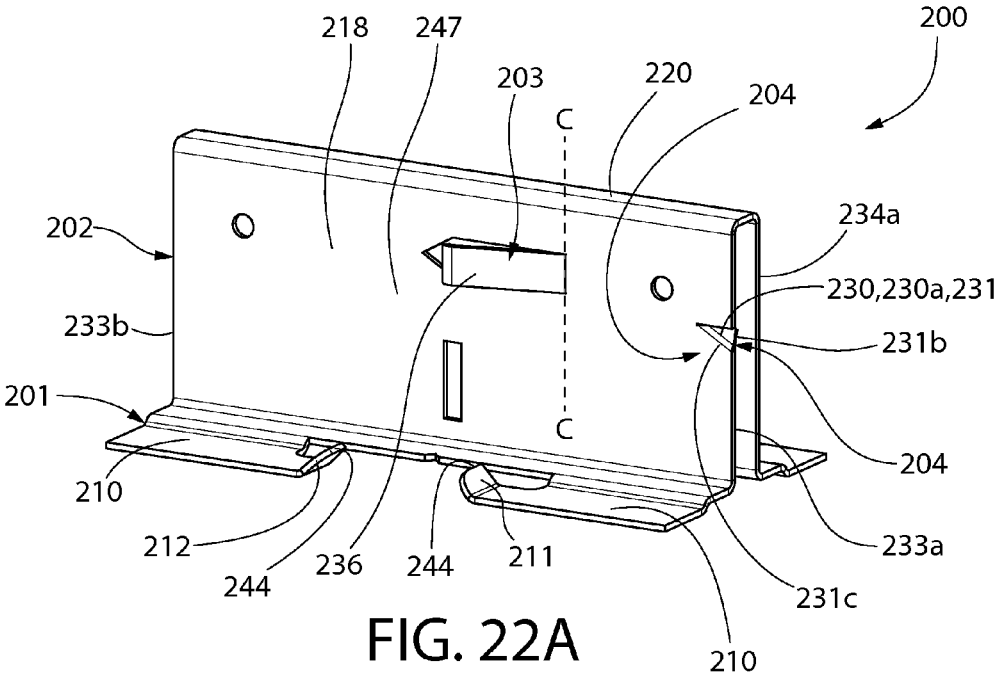
FIG. 22A is a downward front perspective view of the saddle bracket according to the first embodiment of the present invention.
Figure 22B:
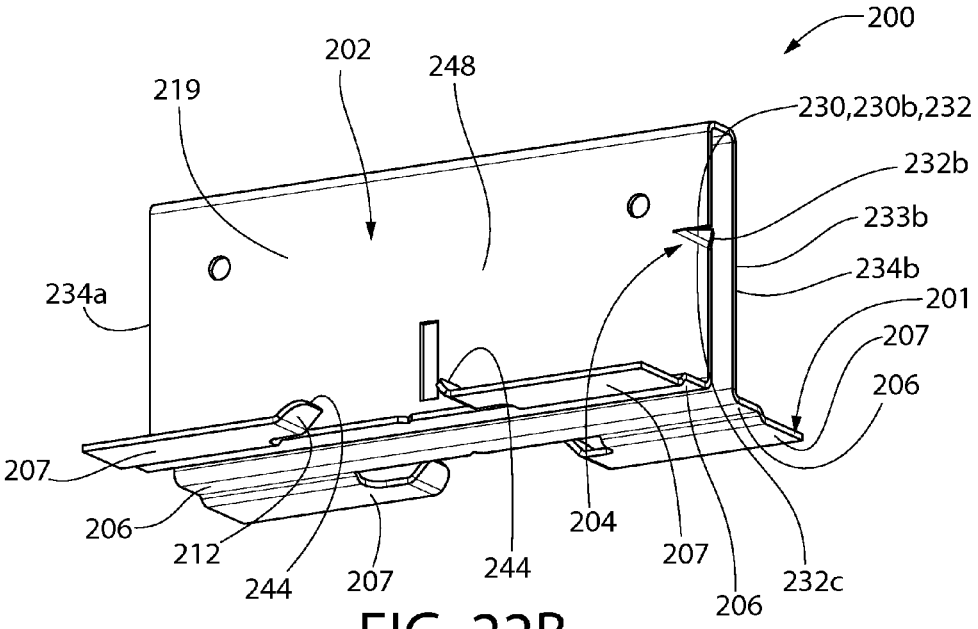
FIG. 22B is an upward rear perspective view of the saddle bracket according to the first embodiment of the present invention.

The first portion 32 of the hook member 23 extends a length that spans from the upper surface 21*a* of the base plate 21 to the second portion 33. The second portion 33 of the hook member 23 extends a length that spans from the first section 32 to the third section 33. As shown in FIG. 21, the third portion 34 of the hook member 23 has a length L1, which is measured from a top surface 33*a* of the second portion 33 to the free end 24 of the hook member 23. As shown in FIG. 20, the third portion 34 has a front face 34*a* that faces away from a rear surface 39 (also referred to otherwise as "wall surface") of the wall plate 35. The front face 34*a* of the third portion 34 and the free end 24 of the hook member 23 intersect at point 48 (as shown in FIGS. 18-21).

As shown in FIGS. 18-21, the receiving slot 26 is formed between the free end 24 of the hook member 23 and the upper surface 21*a* of the base plate 21 and has a height of H2. The multi-purpose mounting aperture 22 and the free end 24 of the hook member 23 are in transverse alignment along the transverse base plate axis B-B.

As shown in FIGS. 7, 13, and 15-17, the wall plate 35 of each mounting bracket 20 extends upward from the upper surface 21*a* of the base plate 21. The wall plate 35 extends a length from the base plate 21 to the upper plate 40. In some embodiments of the present invention, at least a portion of the hook member 23 is co-planar with the wall plate 35. In some embodiments the length of the wall plate 35 is greater than the length of the first section 32 of the hook member 23.

Each wall plate 35 comprises the rear surface 39 and a notch 36, wherein the hook member 23 extends upward from the base plate 21 into the notch 36. The notch 36 separates the wall plate 35 into a first wall plate section 37 and a second wall plate section 38. The notch 36 is located between the first and second wall plate sections 37, 38. The first and second wall plate sections 37, 38 are located opposite each other across the transverse axis B-B.

Figure 7:
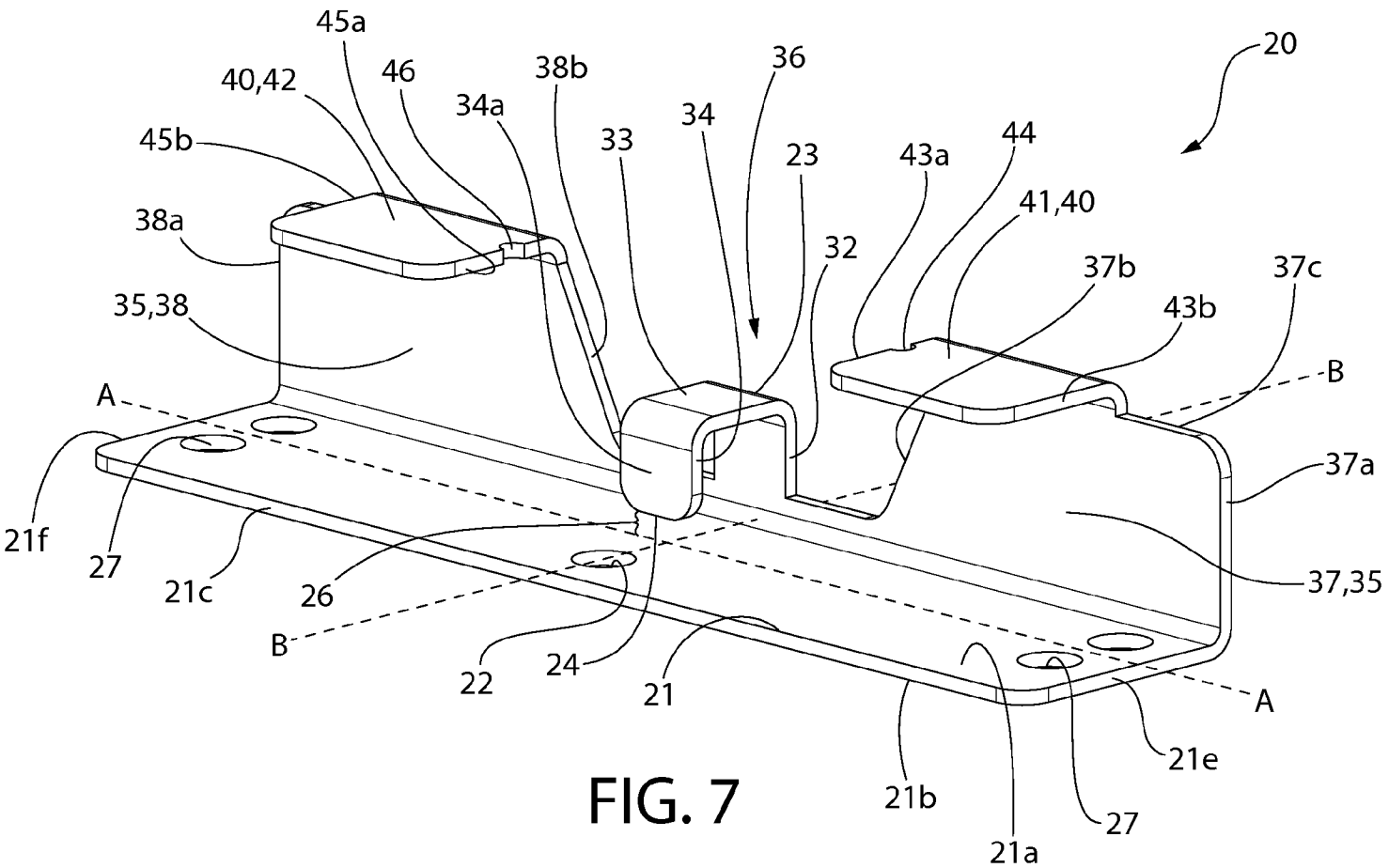
FIG. 7 is a front perspective view of the mounting bracket according to the present invention.

As shown in FIG. 7, the first wall plate section 37 has a first edge 37*a* and a second edge 37*b*. The second wall plate section 38 has a first edge 38*a* and a second edge 37*a*. The first and second edges 37*a*, 37*b* of the first wall plate section 37 may extend at a parallel or oblique angle. The second edges 37*b*, 38*b* of the first and second wall plate sections 37, 38 make up the lateral boundaries of the notch 36. The first and second edges 38*a*, 38*b* of the second wall plate section 38 may extend at a parallel or oblique angle. The first edge 37*a* of the first wall plate section 37 forms a continuous surface with the first transverse edge 21*e* of the base plate 21. The first edge 38*a* of the second wall plate section 38 forms a continuous surface with the second transverse edge 21*f* of the base plate 21.

A width of the first plate section 37 extends from the first edge 37*a* to the second edge 37*b* of the first wall plate section 37 in a direction that is parallel to the longitudinal base plate axis A-A. A width of the second plate section 38 extends from the first edge 38*a* to the second edge 38*b* of the second wall plate section 38 in a direction that is parallel to the longitudinal base plate axis A-A.

For each of the mounting brackets 20, the upper plate 40 extends from the wall plate 35 and above the upper surface 21*a* of the base plate 21. The upper plate 40 is substantially parallel to the base plate 21. The upper plate 40 is substantially perpendicular to the wall plate 35. The upper plate 40 comprises an upper surface 40*a* and a lower surface 40*b*, wherein a space is formed between the lower surface 40*a* of the upper plate 40 and the upper surface 21*a* of the base plate 21.

The widths of the first and second plate sections 37, 38 may each, independently, be constant or varying. If one or both of the first and second plate sections 37, 38 have varying widths, each width may decrease in size as measured from the upper surface 21*a* of the base plate 21 to the lower surface 40*b* of the upper plate 40.

Figure 9:
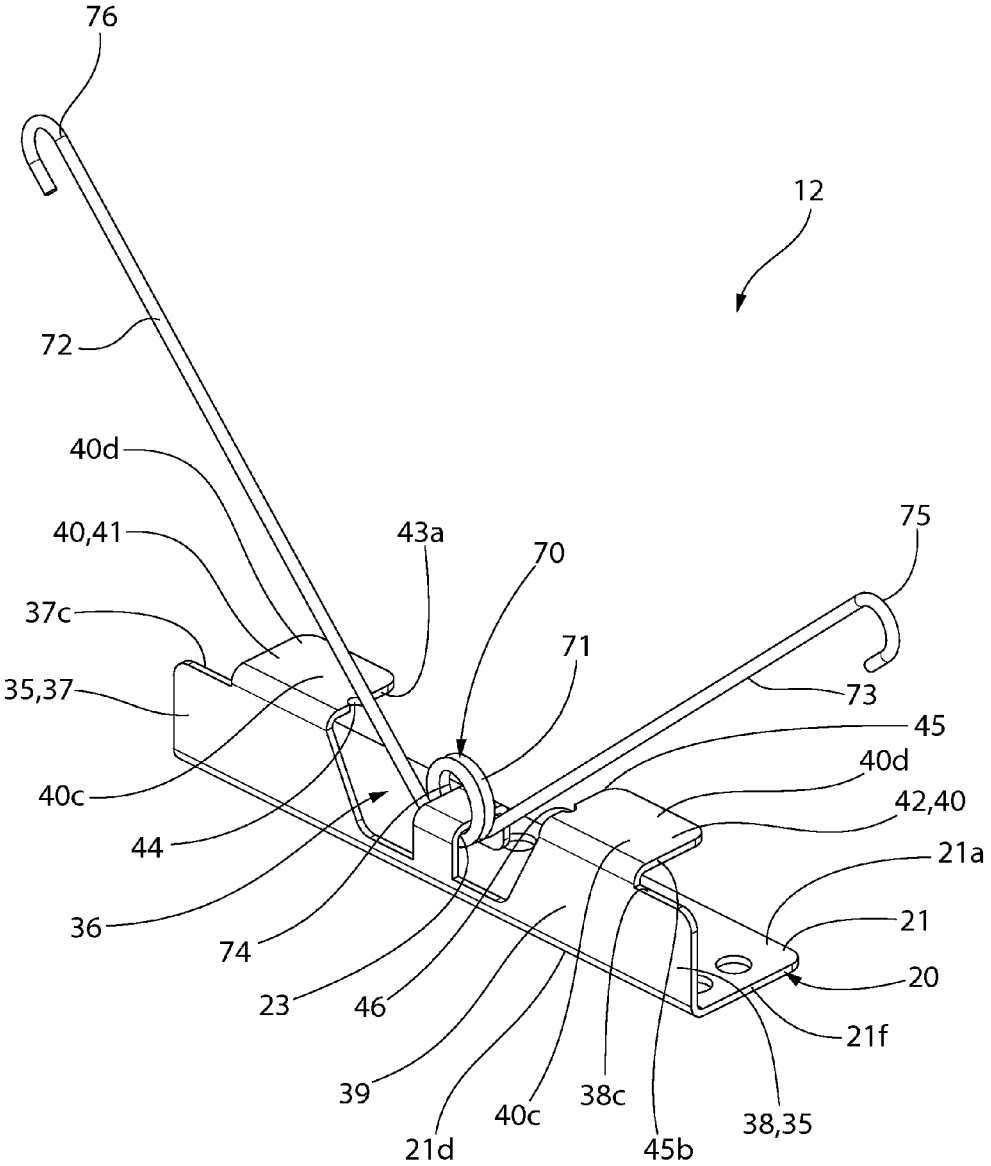
FIG. 9 is a rear perspective view of the mounting bracket assembly without the multi-purpose fastener according to the present invention.
Figure 10A:
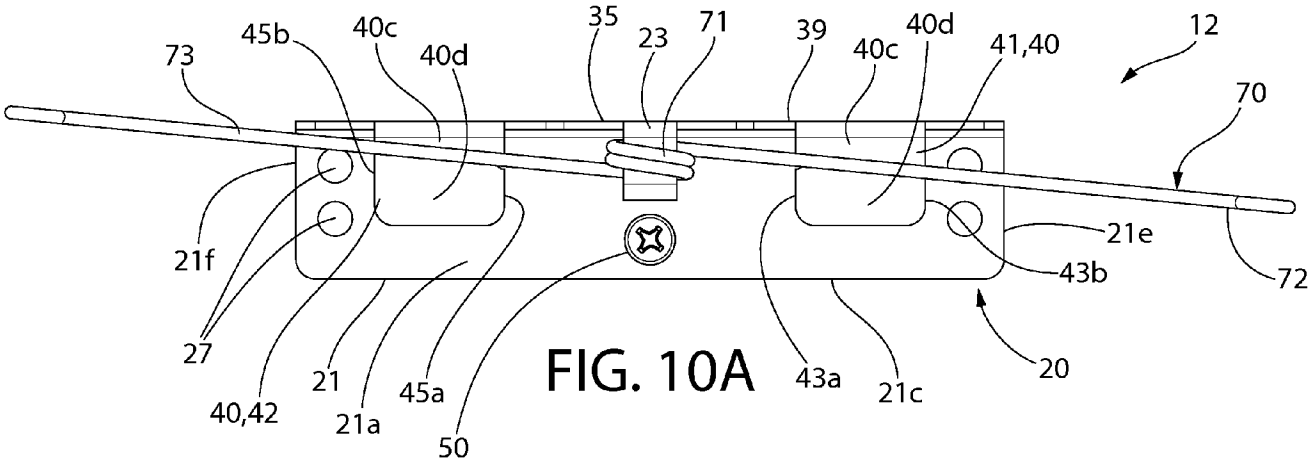
FIG. 10A is a top view of the mounting bracket assembly according to the present invention.
Figure 10B:
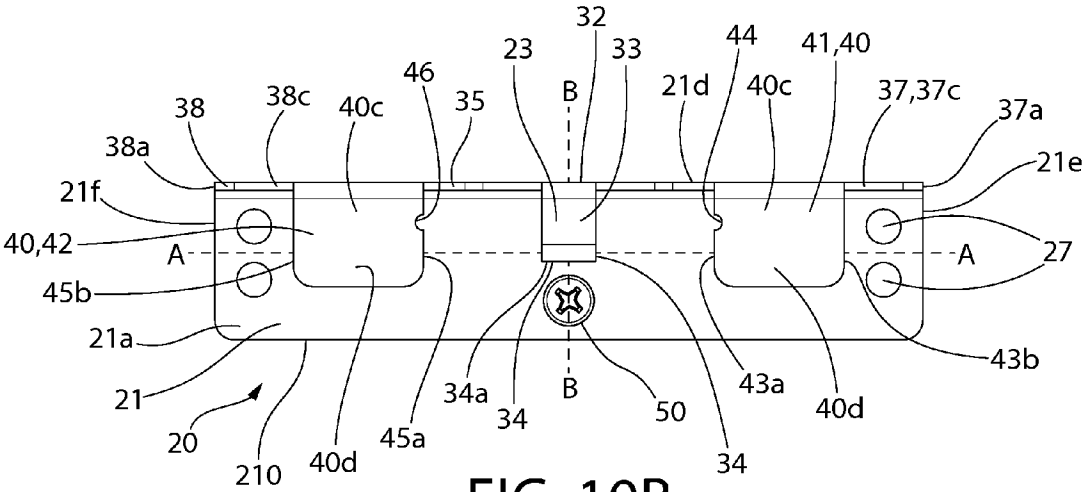
FIG. 10B is a top view of the mounting bracket and the multi-purpose fastener according to the present invention.
Figure 11A:
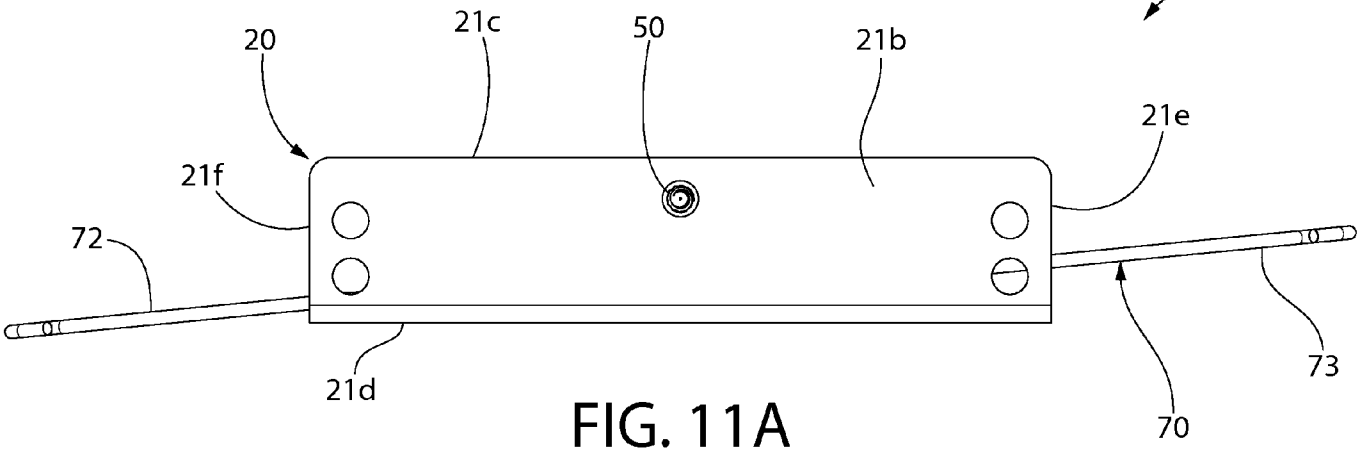
FIG. 11A is a bottom view of the mounting bracket assembly according to the present invention.
Figure 11B:
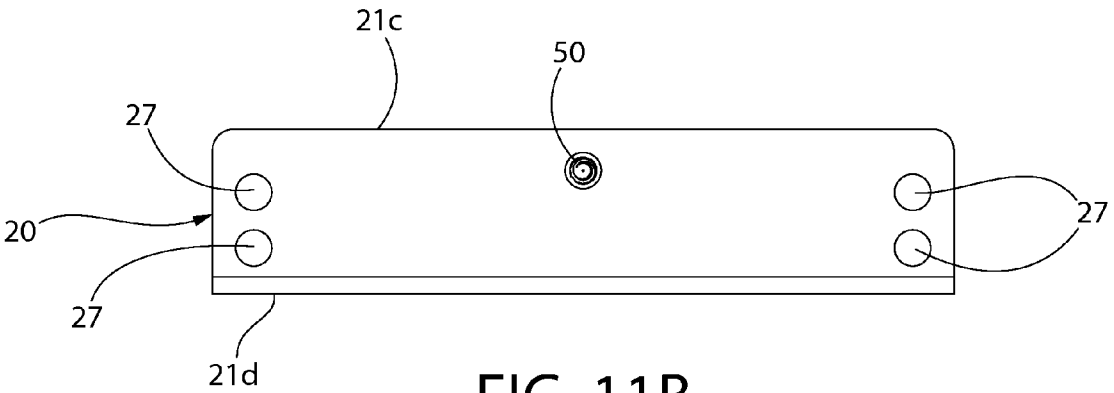
FIG. 11B is a bottom view of the mounting bracket and the multi-purpose fastener according to the present invention.

As shown in FIGS. 9, 10A, and 10B, the upper plate 40 comprises a first upper surface portion 40*c* and a second upper surface portion 40*d*. In some embodiments the first upper surface portion 40*c* is coplanar with the second upper surface portion 40*d*. The first upper surface portion 40*c* extends from the wall plate 35 and the second upper surface portion 40*d* extends from the first upper surface portion 40*c*. The first upper surface portion 40*c* extends a length that is measured along a direction parallel to transverse axis B-B. The second upper surface portion 40*d* extends a length that is measured along a direction that is parallel to the transverse axis B-B.

In some embodiments, the length of the first upper surface portion 40*c* is greater than the length of the second upper surface portion 40*d*. In some embodiments, the length of the first upper surface portion 40*c* is less than the length of the second upper surface portion 40*d*. In some embodiments the length of the first upper surface portion 40*c* is equal to than the length of the second upper surface portion 40*d*.

In some embodiments, the length of the first upper surface portion 40*c* is less than the length of the second portion 33 of the hook member 23. In some embodiments, the length of the first upper surface portion 40*c* is greater than the length of the second portion 33 of the hook member 23. In some embodiments, the length of the first upper surface portion 40*c* is equal to the length of the second portion 33 of the hook member 23. In some embodiments, the combined length of the first upper surface portion 40*c* and the second upper surface 40*d* is greater than the length of the second portion 33 of the hook member 23. In some embodiments, the combined length of the first upper surface portion 40*c* and the second upper surface 40*d* is equal to the length of the second portion 33 of the hook member 23.

Figure 8:
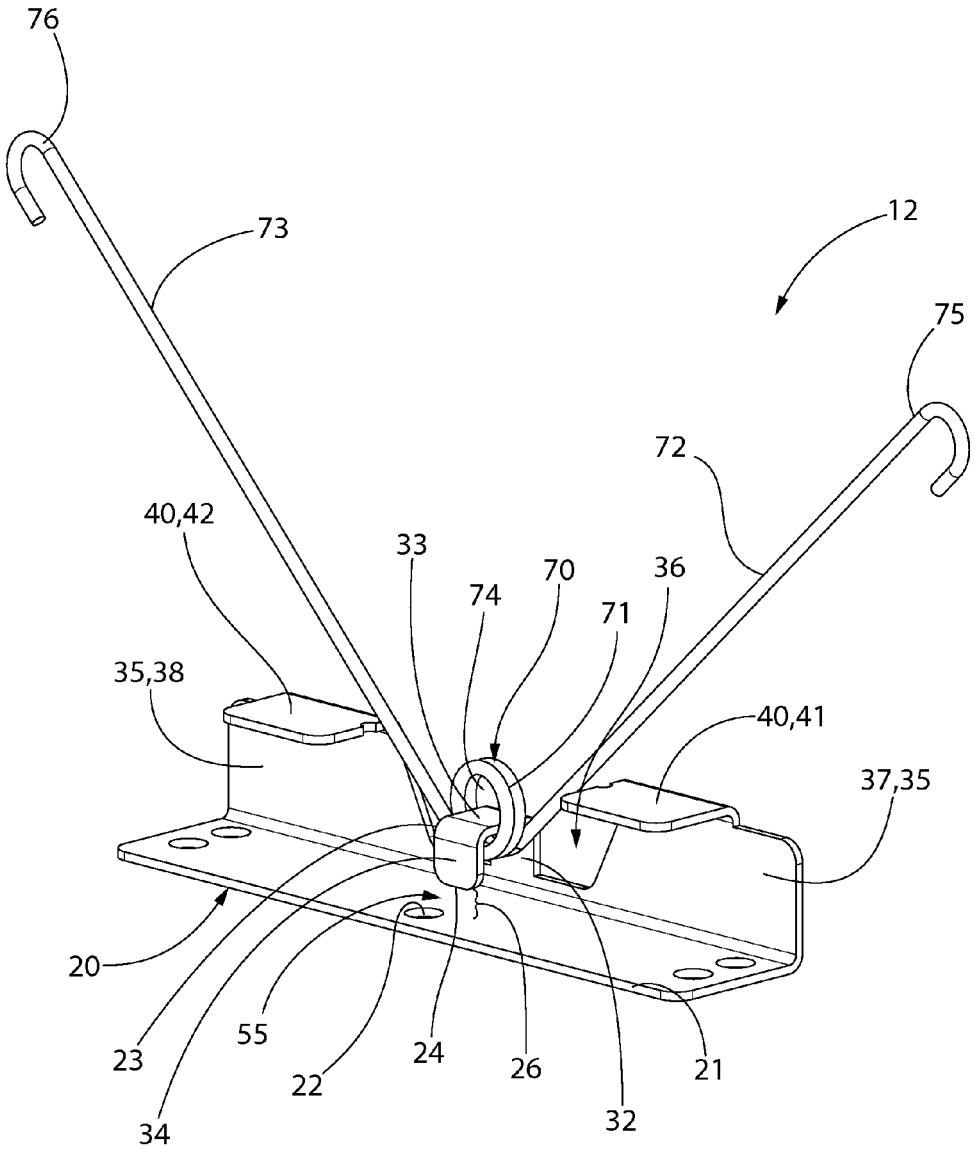
FIG. 8 is a front perspective view of the mounting bracket assembly without the multi-purpose fastener according to the present invention.

As shown in FIGS. 7 and 8, the upper plate 40 further comprises a first upper plate section 41 and a second upper plate section 42. The first upper plate section 41 extends from first wall plate section 37 and the second upper plate section 42 extends from the second wall plate section 38. The hook member 23 is located longitudinally between the first and second upper plate sections 41, 42. The first and second upper plate sections 41, 42 are located opposite each other across the transverse axis B-B.

Figure 15:
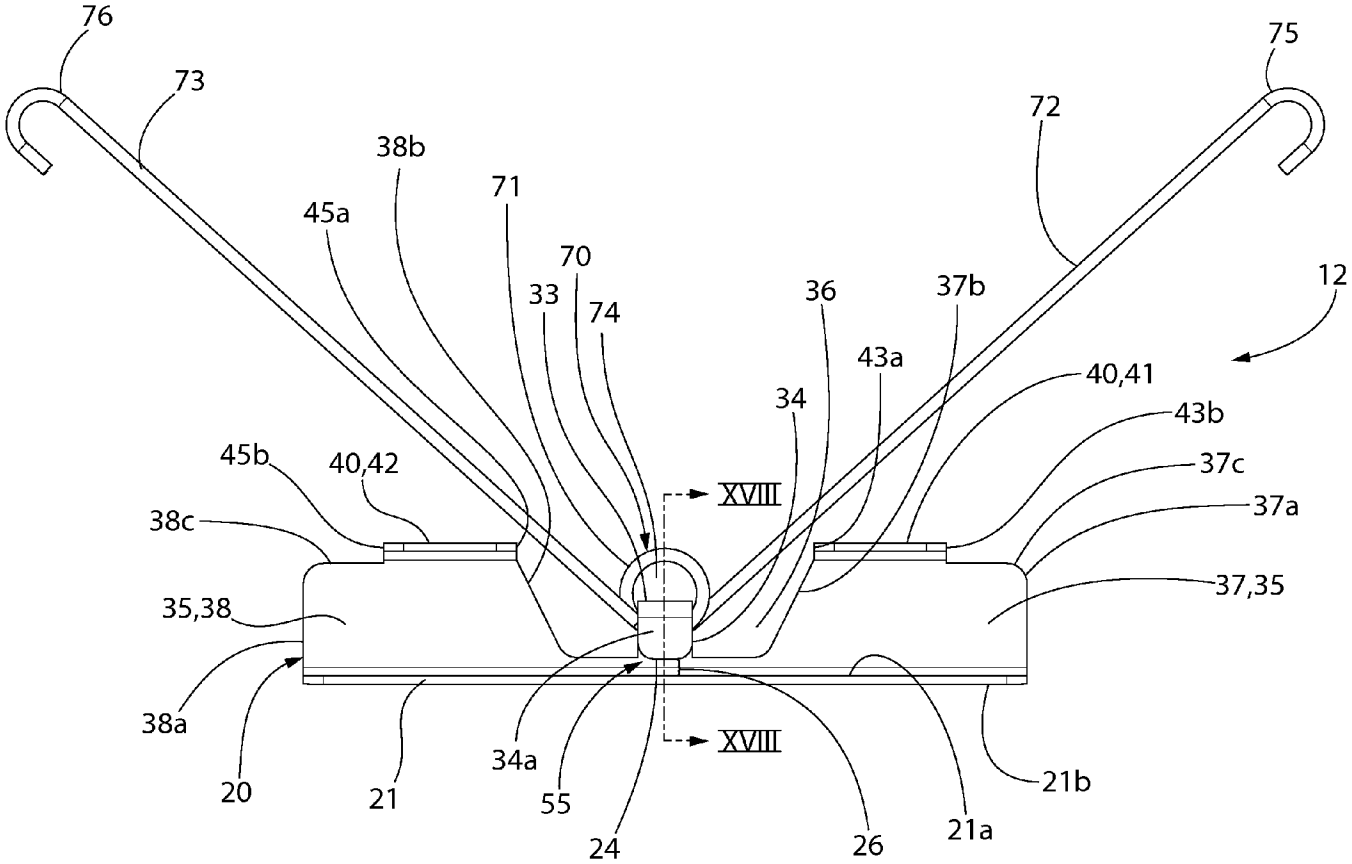
FIG. 15 is a front view of the mounting bracket assembly without the multi-purpose fastener according to the present invention.
Figure 16:
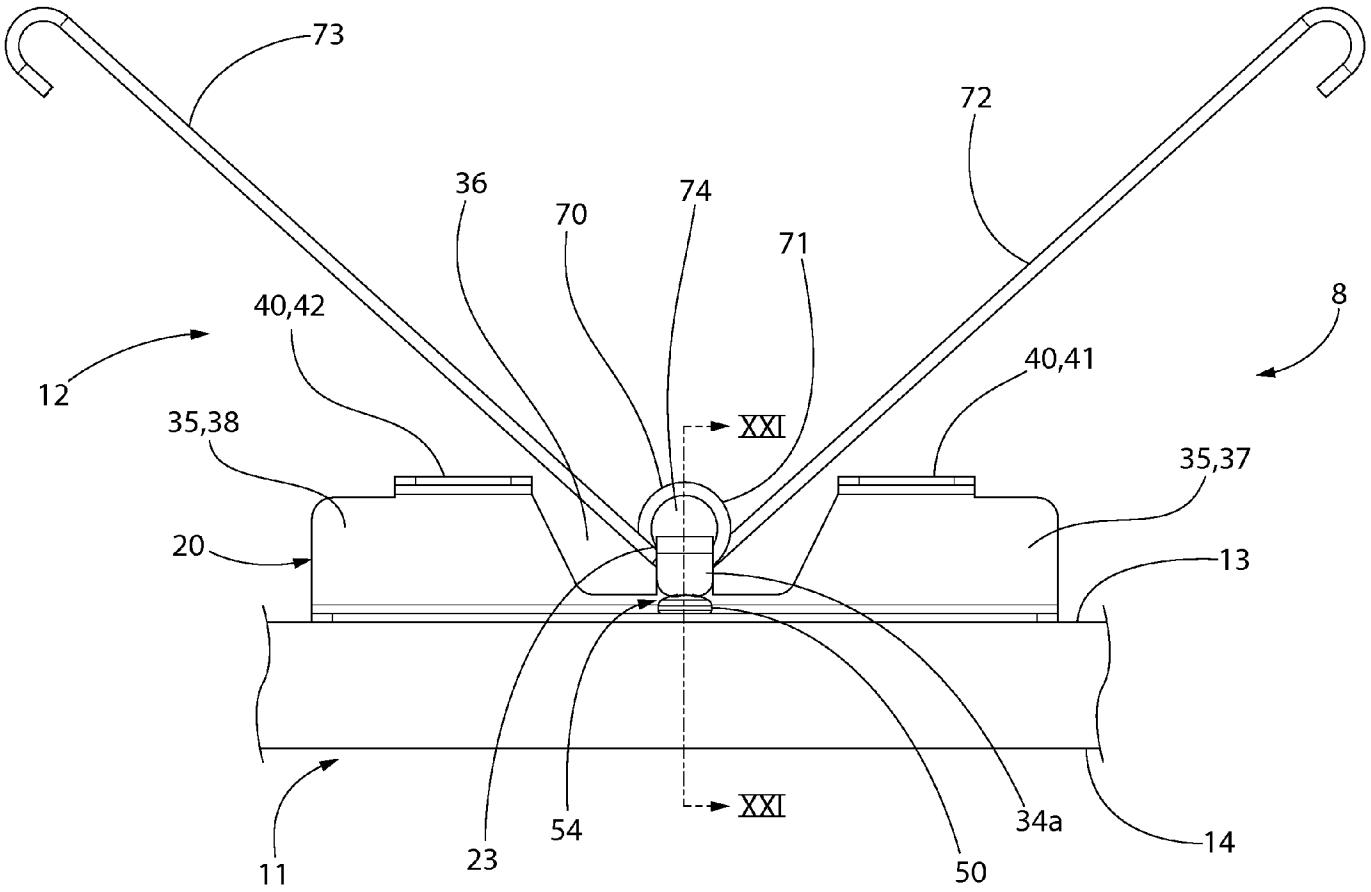
FIG. 16 is a is a front view of the ceiling panel apparatus according to the present invention.
Figure 17:
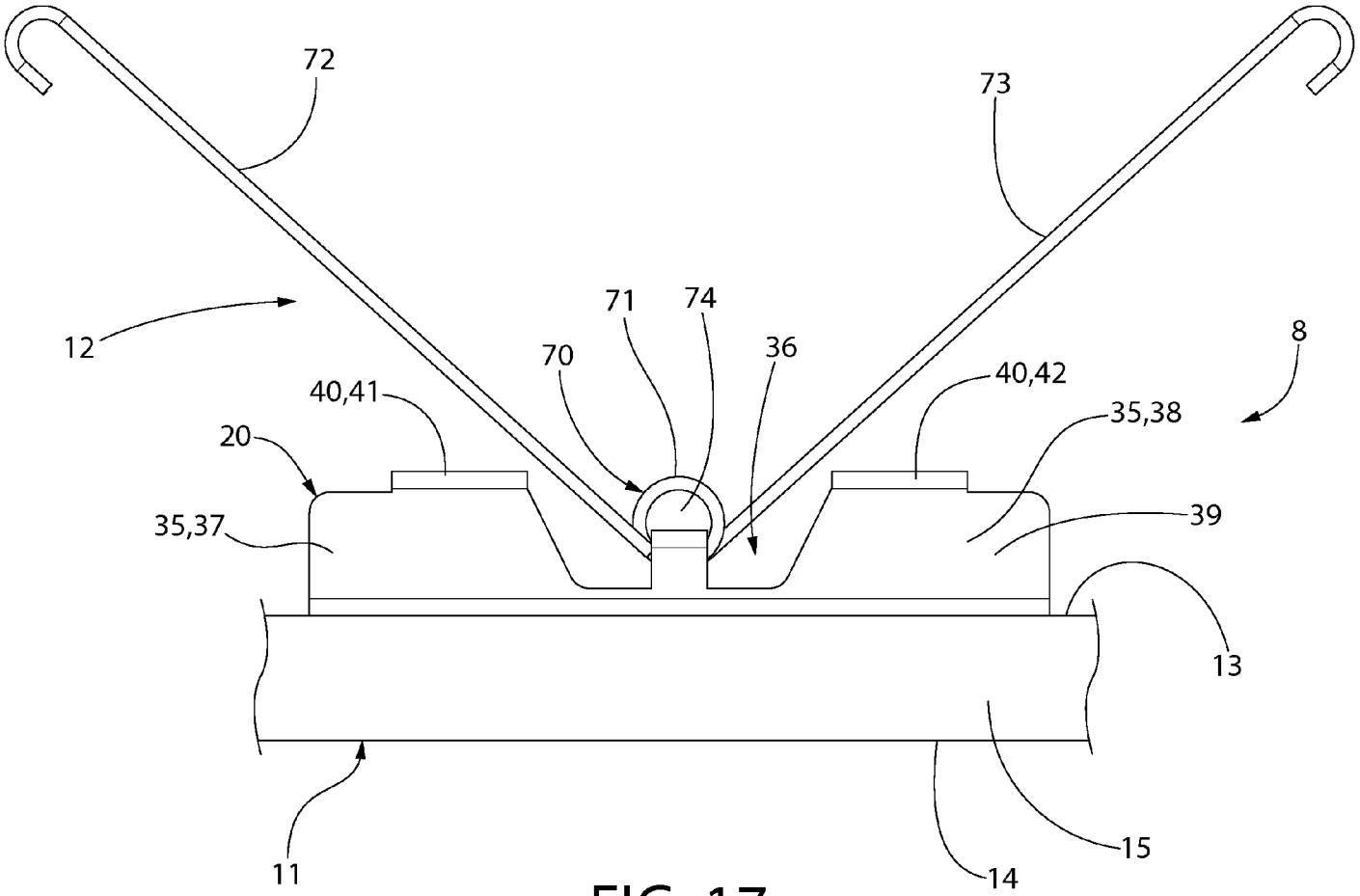
FIG. 17 is a is a rear view of the ceiling panel apparatus according to the present invention.

As shown in FIGS. 7, 10B, and 15, the first upper plate section 41 comprises a first outer edge 43*b* and a first inner edge 43*a*. The first inner edge 43*a* includes a first spring leg nesting groove 44. The second upper plate section 42 comprises a second outer edge 45*b* and a second inner edge 45*a*. The second inner edge 45*a* includes a second spring leg nesting groove 46. The first and second spring leg nesting grooves 44, 46 may have semi-circular or polygonal edge geometries.

A width of the first upper plate section 41 is measured from the first inner edge 43*a* to the first outer edge 43*b* in a direction that is parallel to the longitudinal base plate axis A-A. A width of the second upper plate section 42 is measured from the first inner edge 45*a* to the first outer edge 45*b* in a direction that is parallel to the longitudinal base plate axis A-A. In some embodiments the width of the first upper plate section 41 is equal to the width of the first plate section 37. In some embodiments the width of the first upper plate section 41 is less than the width of the first plate section 37. In some embodiments the width of the second upper plate section 42 is equal to the width of the second plate section 38. In some embodiments the width of the second upper plate section 42 is less than the width of the second plate section 38.

In some embodiments the first outer edge 43*b* of the first upper plate section 41 is longitudinally offset from the first edge 37*a* of the first plate section 37 by a first offset distance, thereby exposing a top surface 37*c* of the first wall plate 37. In some embodiments the second outer edge 45*b* of the second upper plate section 42 is longitudinally offset from the second edge 38*a* of the second plate section 38 by a second offset distance, thereby exposing a top surface 38*c* of the second wall plate 38.

In some embodiments, the combined length of the first offset distance and the width of the first upper plate section 41 is equal to the width of the first wall plate 37. In some embodiments, the combined length of the first offset distance and the width of the first upper plate section 41 is less than the width of the first wall plate 37. In some embodiments, the combined length of the second offset distance and the width of the second upper plate section 42 is less than the width of the second wall plate 38. In some embodiments, the combined length of the second offset distance and the width of the second upper plate section 42 is equal to the width of the second wall plate 38.

The mounting bracket 12 is coupled to the upper surface 13 of the ceiling panel 11 by fastening elements via the coupling apertures 27. The mounting bracket 12 may also be coupled to the ceiling panel 11 by the multi-purpose fastener 50 via the multi-purpose aperture 22, as discussed herein. The multi-purpose fastener 50 has an outer edge 52 that is located above the upper surface 21*a* of the base plate 21.

Figure 12:
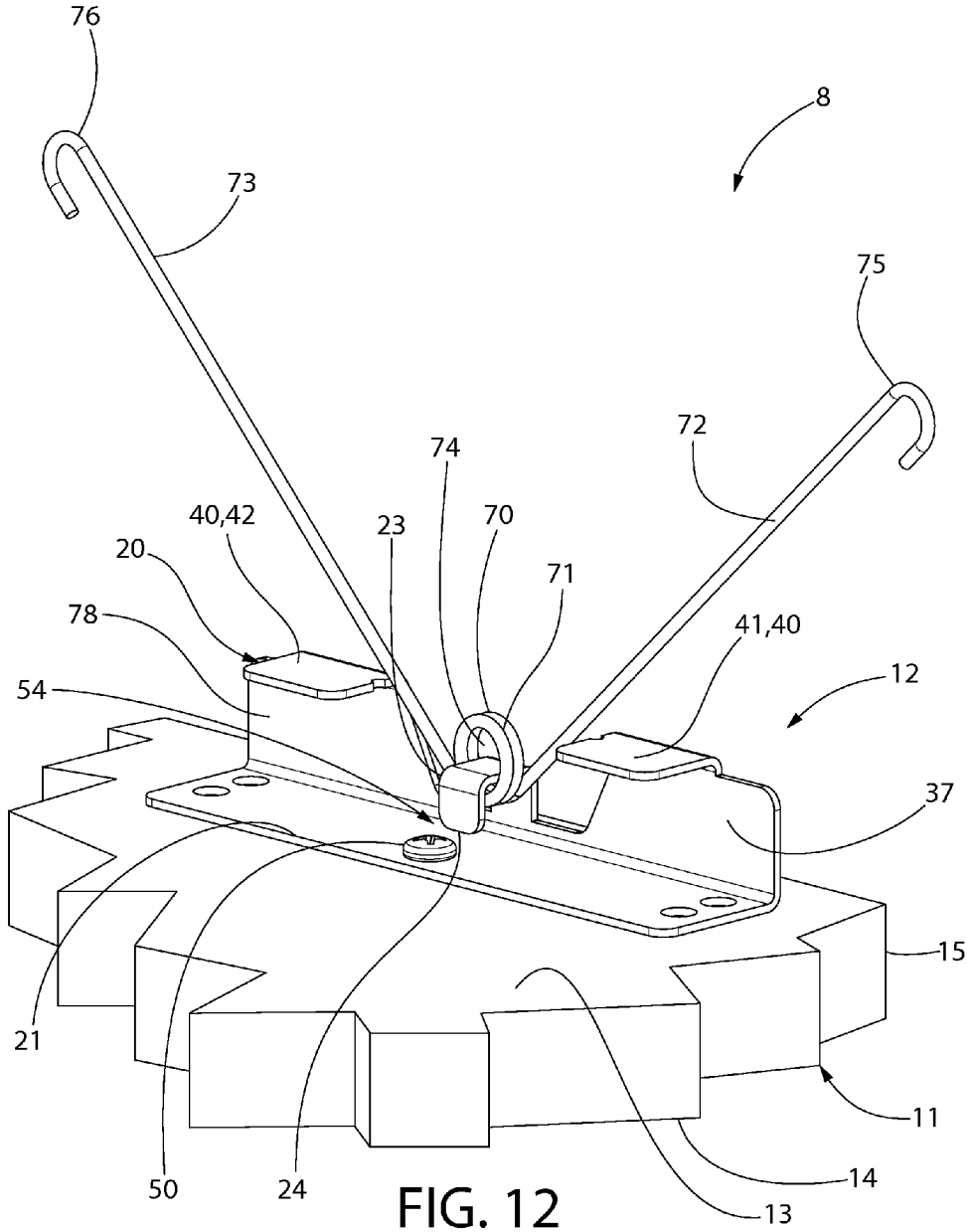
FIG. 12 is a front perspective view of the ceiling panel apparatus according to the present invention.
Figure 13:
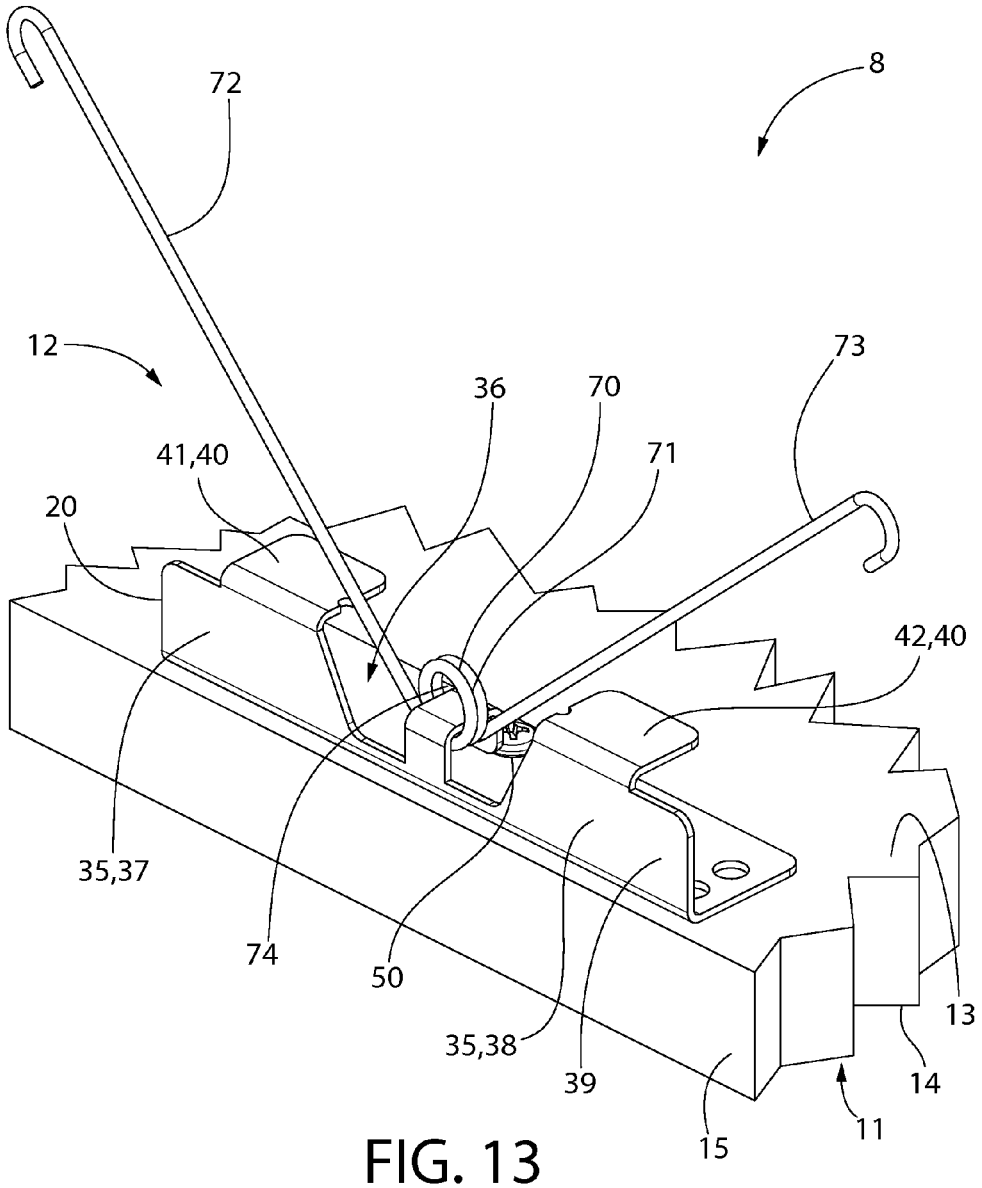
FIG. 13 is a rear perspective view of the ceiling panel apparatus according to the present invention.

As shown in FIGS. 12 and 13, the resilient element 70 may include a biased torsion spring. The torsion spring 70 comprises a ring portion 71, a first spring leg 72 and a second spring leg 73. The ring portion 71 may be a coiled spring that has a central opening 74. The ring portion 71 has a height of H1 (as shown in FIG. 20) and the central opening 74 has a diameter of D1 (as shown in FIG. 21). The ring portion 71 has a wall thickness of D2 (as shown in FIGS. 19 and 21).

The torsion spring 70 may be an offset torsion spring having two 30° to 60° bends in each of the first and second spring legs 72, 73, thereby creating a portion of each of the first and second spring legs 72, 73 that is substantially parallel to the ceiling panel 11 after the ceiling system 1 is installed.

To mount the torsion spring 70 to the mounting bracket 20, the hook member 23 of the mounting bracket 20 extends through the central opening 74 of the ring portion 71 of the torsion spring 70. The first and second spring legs 71, 72 may be located between the first and second upper plate sections 41, 42 and extend upward beyond the first and second upper plate sections 41, 42. The first and second spring legs 71, 72 are biased outward by the ring portion 71, thereby causing the first and second spring legs 71, 72 to rest in the first and second spring leg nesting grooves 46 when the ring portion 71 of the torsion spring 70 is attached to the hook member 23 of the mounting bracket 20. The torsion spring 70 also biases the ceiling panel 11 into a fully-installed state, as discussed herein.

As can be seen in FIGS. 8 and 12, the multi-purpose fastener 50 is alterable between a locked state 54 and an unlocked state 55. As shown in FIGS. 20 and 21, in the locked state 54 the multi-purpose fastener 50 performs two functions. First, the multi-purpose fastener 50 extends through the multi-purpose aperture 22 of the base plate 21 and fastens the mounting bracket 20 to the ceiling panel 11. Second, the multi-purpose fastener 50 obstructs the receiving slot 26, thereby locking the ring portion 71 of the torsion spring 70 to the hook member 23. Specifically, in the locked state 54, the distance between the point 48 and the outer edge 52 of the multi-purpose fastener 50 is smaller than a height H1 of the ring portion 71 of the torsion spring 70, thereby preventing the ring portion 71 from pass through the receiving slot 26 and de-attaching from the hook member 23.

In some embodiments, the torsion spring 70 and the mounting bracket 20 are each independent, integrally formed singular components; thus by way of the multi-purpose fastener 50 locking the ring portion 71 to the hook member 23, the multi-purpose fastener 50 also locks the torsion spring 70 to the mounting bracket 20.

Figure 18:
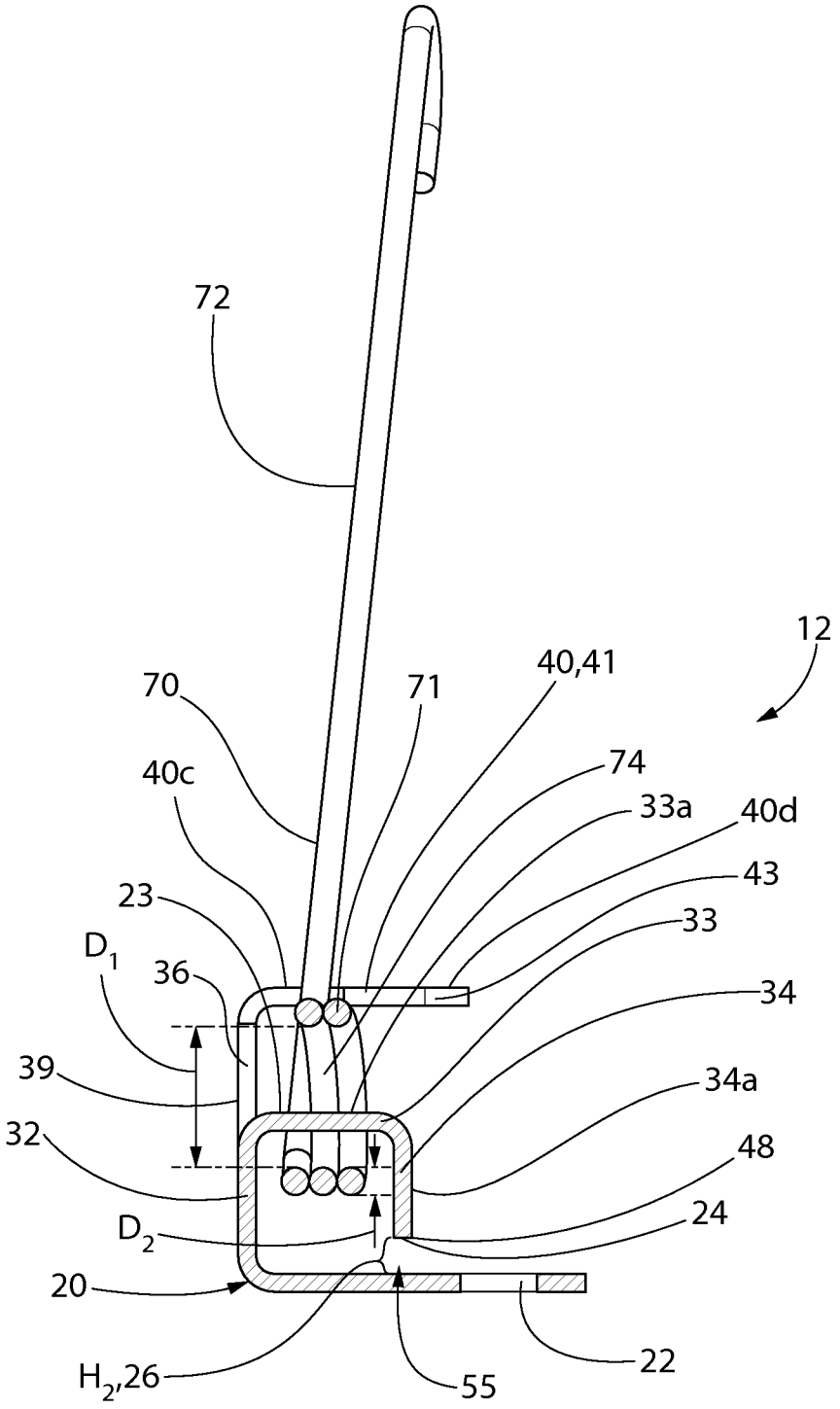
FIG. 18 is a cross-sectional view of the mounting bracket assembly without the multi-purpose fastener along line XVIII-XVIII of FIG. 15 according to the present invention.
Figure 19:
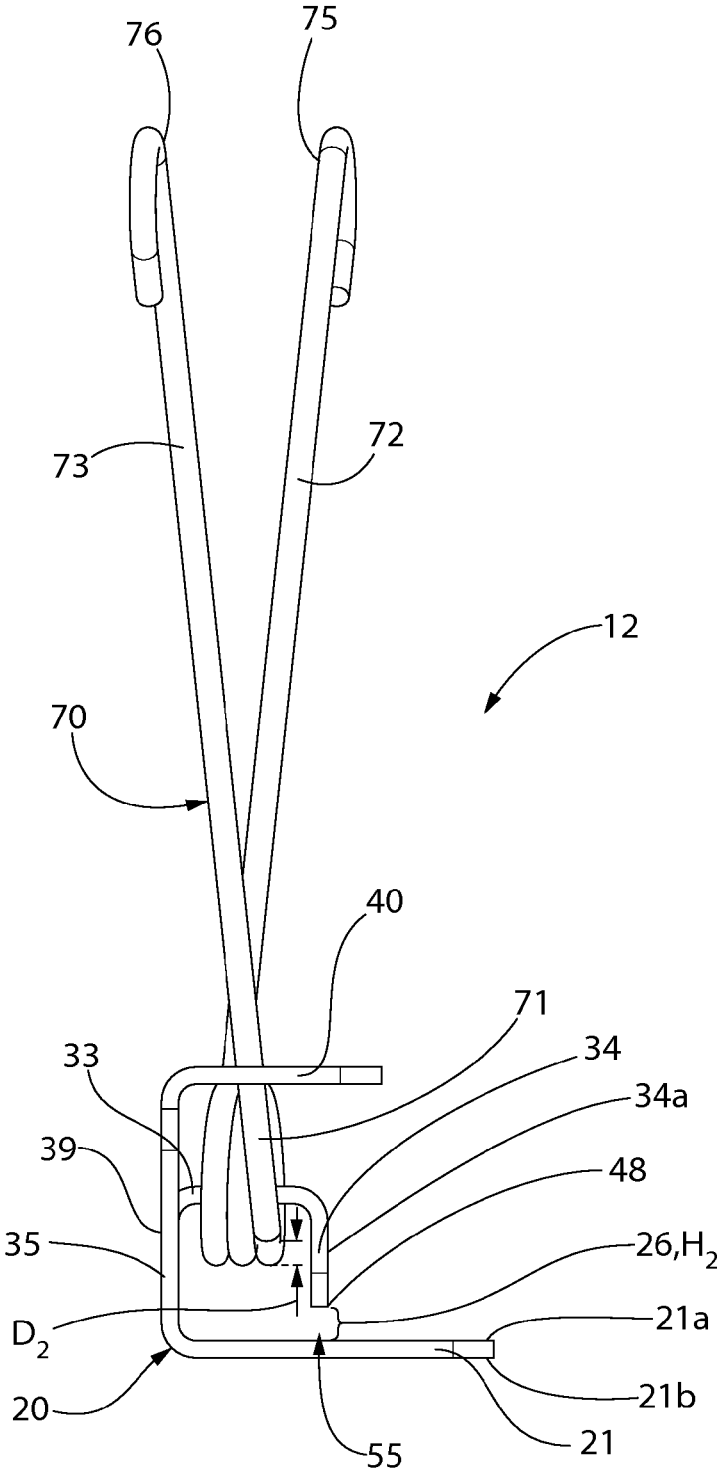
FIG. 19 is a side view of the mounting bracket assembly without the multi-purpose fastener according to the present invention.

As shown in FIGS. 18 and 19, in the unlocked state 55, the multi-purpose fastener 50 does not obstruct the receiving slot 26. Specifically, the wall thickness D2 of ring portion 71 is smaller than the height of the receiving slot H2 and the diameter D1 of the central opening 74 of the torsion spring 70 is greater than length L1 of the third portion 34 of the hook member 23, thereby allowing the torsion spring 71 to pass through the receiving slot 26 and decouple from the hook member 23.

By passing the ring portion 71 of the torsion spring 70 from the hook member 23 and through receiving slot 26, the torsion spring 70 is detached from the mounting bracket 20. Similarly by passing the ring portion 71 through the receiving slot 26 and onto the hook member 23, the torsion spring 70 is attached to the mounting bracket 20.

For each of the mounting bracket assemblies 12, when the multi-purpose fastener 50 is in the unlocked state 55, the multi-purpose fastener 50 will no longer extend through the multi-purpose aperture 11 of the base plate 21. Furthermore, for each of the mounting bracket assemblies 12, when the multi-purpose fastener 50 is in the unlocked state 55, the multi-purpose fastener 50 no longer fastens the mounting bracket 20 to the ceiling panel 11. However, mounting bracket 20 can still be independently fastened to the ceiling panel 11 by a plurality of fasteners (not pictured) that extend through the plurality of coupling apertures 27 and into the ceiling panel 11 in a manner similar to how the multi-purpose fastener 50 extends through the multi-purpose aperture 22 of the base plate 21.

Figure 14:
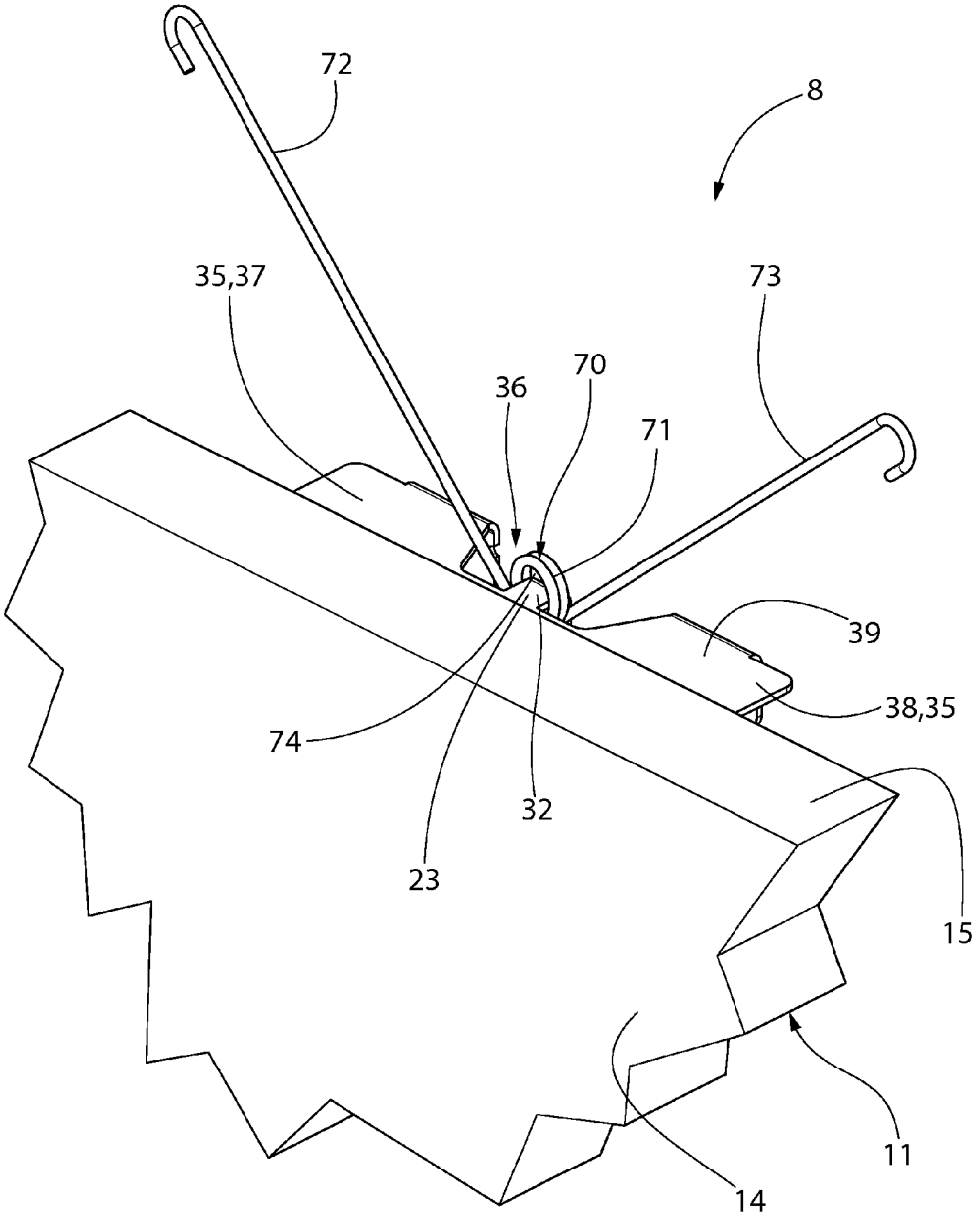
FIG. 14 is a rear perspective view of the ceiling panel apparatus corresponding to the ceiling system being in the third state according to the present invention.

As shown in FIGS. 5 and 14, the torsion spring 70 can be tilted relative to the mounting bracket 20 while the mounting bracket assembly 12 remains in the locked state 54. Specifically, the first and second spring legs 72, 73 of the torsion spring 71 can be alternated between two orientations. In the first orientation (1), as shown in FIGS. 12, 13, 19, and 20, the first and second spring legs 72, 73 of the torsion spring 71 extend substantially parallel to the wall plate 35. The term "substantially parallel" means an offset angle ranging from about −10° to 10°—wherein 0° is perfectly parallel. In the second orientation (2), as shown in FIGS. 5 and 14, the first and second spring legs 72, 73 of the torsion spring 71 extend through the notch 36 and protrude from the rear surface 39 of the wall plate 35 so that the first and second spring legs 72, 73 extend substantially perpendicular to the wall plate 35. The term "substantially perpendicular" means an offset angle ranging from about 80° to 100°—wherein 90° is perfectly perpendicular. The first and second orientations (1), (2) of the torsion spring 70 will be discussed further herein.

As shown in FIGS. 22-29, the saddle bracket 200 of the present invention is an integrally formed singular component comprising a support flange 201, a saddle member 202, a horizontal locking feature 203, and a vertical locking feature 204. The saddle member 202 defines a web receiving cavity 205 for receiving the web portion 102 of the struts 100, wherein the web receiving cavity 205 has a closed top end 227 and an open lower end 228.

The saddle member 202 comprises a first wall plate 218, a second wall plate 219, and a bight portion 220. The bight portion 220 connects the first and second wall plates 218, 219, and the first wall plate 218, second wall plate 219, and bight portion 220 collectively define the web receiving cavity 205 that extends along a central vertical plane D-D.

As shown in FIGS. 22A, 22B, 26 and 27, the first wall plate 218 comprises first and second edges 233*a*, 233*b*. The second wall plate 219 comprises first and second edges 234*a*, 234*b*. The first and second edges 233*a*, 233*b*, 234*a*, 234*b* of the first and second wall plates 218, 219 are each free edges. The first side edge 233*a* of the first wall plate 218 and the second side edge 234*b* of the second wall plate 219 are located on opposite sides of the saddle bracket 200.

Figure 23:
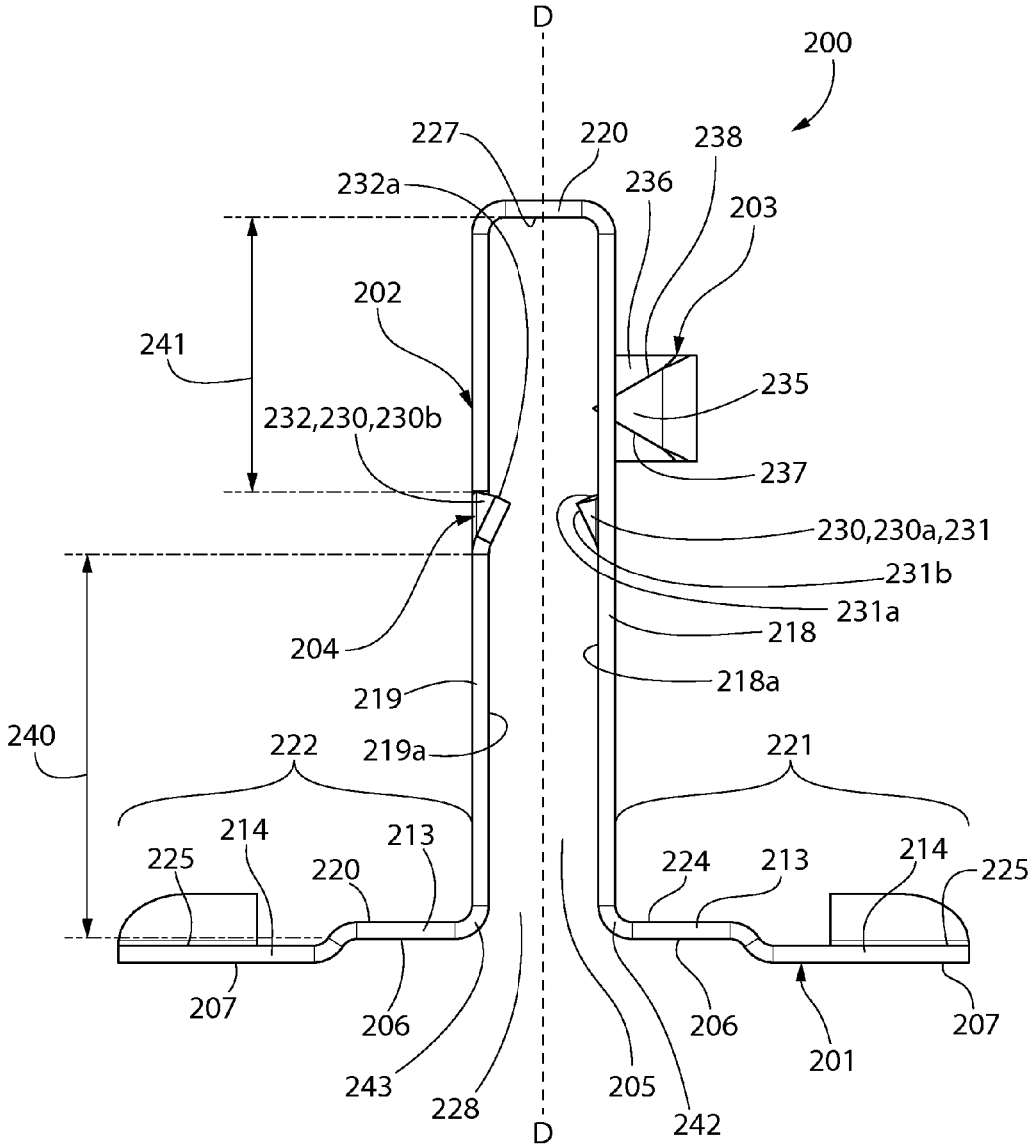
FIG. 23 is a left side view of the saddle bracket in a first horizontal locking state according to the first embodiment of the present invention.

As shown in FIG. 23, the first wall plate 218 comprises an inner surface 218*a* that faces the web receiving cavity 205. The second wall plate 219 comprises an inner surface 219*a* that faces the web receiving cavity 205. The inner surfaces 218*a*, 219*a* of the first and second wall plates 218, 219 face toward the central vertical plane D-D as well as face each other. The first wall plate 218 and the second wall plate 219 are substantially parallel with the central vertical plane D-D. The web receiving cavity 205 comprises at least two sections: an entry section 240 and a bulb nesting section 241, the location of which will be discussed herein. The bight portion 220 encloses the top end 227 of the web receiving cavity 205.

As shown in FIGS. 22-29, the horizontal locking feature 203 comprises a barb portion 235 and an arm portion 236, wherein the barb portion 235 is located at the distal end of the arm portion 236. The barb portion 235 comprises a lower edge 237 and an upper edge 238 that converge at an apex 239. In some non-limiting embodiments, the horizontal locking feature 203 is formed as an integral piece of the first wall plate 218 of the saddle member 202. Specifically, the outline of the horizontal locking feature 203 is punched out of the first wall plate 218, wherein only a proximal end of the arm portion 236 is integrally formed with the first wall plate 218.

The vertical locking feature 204 comprises a resilient element 230 that can be altered between a locking state and an access state. The resilient element 230 is biased into the locking state. The resilient element 230 including a first resilient element 230*a* and a second resilient element 230*b*. The first resilient element 230*a* is located on the first wall plate 218 of the saddle bracket 200 and the second resilient element 230*b* is located on the second wall plate 219 of the saddle bracket 200.

The vertical position of the resilient element 230 along the first wall plate 218 and the second wall plate 219 defines boundaries of the entry section 240 and the bulb nesting section 241. Specifically, the entry section 240 extends from the open lower end 228 of the saddle member 202 to the resilient member 230. The bulb nesting section 241 extends from the resilient element 230 to the closed top end 227 of the saddle member 202. As a result, the entry section 240 is located below the resilient element 230 and the bulb nesting section 241 is located above the resilient element 230. The bulb nesting section 241 has a height that is equal to or greater than the height of the bulb section 103 of the strut 100.

The first resilient element 230*a* comprises a first tab 231 that is formed into the first side edge 233*a* of the first wall plate 218. The first resilient element 230*a* protrudes from the inner surface 218*a* of the first wall plate 218 into the web receiving cavity 205. The second resilient element 230*b* comprises a second tab 232 that is formed into the second side edge 234*b* of the second wall plate 219. The second resilient element 230*b* protrudes from the inner surface 219*a* of the second wall plate 219 into the web receiving cavity 205.

The first tab 231 is an integrally formed portion of the first wall plate 218 and the second tab 232 is an integrally formed portion of the second wall plate 219. The first tab 231 is created by making a substantially perpendicular cut into the first wall plate 218 from the first side edge 233*a*. A portion of first wall plate 218 below the perpendicular cut is then bent out of plane with a main body portion 247 of the first wall plate 218 in a direction inward toward the web receiving cavity 205. The second tab 232 is created by making a substantially perpendicular cut into the second wall plate 219 from the second side edge 234*b*. A portion of second wall plate 219 below the perpendicular cut is then bent out of plane with a main body portion 248 of the second wall plate 219 in a direction inward toward the web receiving cavity 205.

The resulting first tab 231 is a triangular element having a free upper edge 231*a*, a free lateral edge 231*b*, and a bend 231*c*. The bend 231*c* integrally connects the first tab 231 to the main body portion 247 of the first wall plate 218. The free lateral edge 231*b* of the first tab 231 is a portion of the first side edge 233*a* of the first wall plate 218. The resulting second tab 232 is a triangular element having a free upper edge 232*a*, a free lateral edge 232*b*, and a bend 232*c*. The bend 232*c* integrally connects the second tab 232 to the main body portion 248 of the second wall plate 219. The free lateral edge 232*b* of the second tab 232 is a portion of the second side edge 234*b* of the second wall plate 219. The resulting vertical locking feature extends into the web receiving cavity 205. Specifically, the The support flange 201 of the present invention may comprise a first support flange 221. The first support flange 221 extends from a lower end 242 of the first wall plate 218 of the saddle member 202 in a first direction that is substantially orthogonal to the central vertical plane D-D. The support flange 201 also comprises a second support flange 222. The second support flange 222 extends from a lower end 243 of the second wall plate 219 of the saddle member 202 in a second direction that is substantially orthogonal to the central vertical plane D-D. The first and second directions are opposite of each other.

Each of the first and second support flanges 221, 222 comprise a stepped profile and that include a first plate portion 213 and a second plate portion 214. The first plate portion 213 extending from the lower end 242 of the first wall plate 218 and includes a first upper surface portion 224 and a first lower surface portion 206. The second plate portion 214 extends from the first plate portion 213 and includes a second upper surface portion 225 and a second lower surface portion 207.

The first and second lower surface portions 206, 207 of the support flange 201 are vertically offset from each other. The first and second upper surface portions 224, 225 of the support flange 201 are vertically offset from each other. The first lower surface portion 206 of the first support flange 221 and the first lower surface 206 of the second support flange 222 are substantially coplanar with one another. The second lower surface portion 207 of the first support flange 221 and the second lower surface 207 of the second support flange 222 are substantially coplanar with one another.

The first plate portion 213 extends from the lower end 242 of the first wall plate 218 in a first direction that is substantially orthogonal to the central vertical plane D-D. The second plate portion 214 extends from the first plate portion 213 in the first direction that is orthogonal to the central vertical plane D-D. The second upper surface portions 224, 225 of the support flange 201 are vertically offset from each other.

As shown in FIGS. 30 and 31, to mount the saddle bracket 200 to the strut 100, the saddle bracket 200 is positioned above the strut 100 causing the top surface 118 of the bulb portion 103 to face the open lower end 228 of the saddle bracket 200. The bulb portion 103 of the web portion 102 enters the entry section 240 of the saddle member 202, followed by the first and second sides 110, 112 of the web portion 102. As the web portion 102 continues through the web receiving cavity, the vertical locking feature 204 alternates between at least two states: a locking state and an access state. Entering the access state includes the following: the free lateral edges 231*b*, 232*b* of the first and second tabs 231, 232 as well as the interior surfaces 218*a*, 219*a* of the first second tabs 231, 232 of the first and second resilient elements 230*a*, 230*b* contact the first and second sloped portions 115*a*, 115*b* of the upper surface 115 of the bulb portion 103. As the web portion 102 continues to travel upward relative to the saddle member 202 and toward the bulb nesting section 241, the vertical locking features 204 deflect into at least one of three access states.

In the first access state, the resilient members 230 deflect outward relative to the first and second plate walls 218, 219. The deflection accommodates for the volume being occupied by the bulb portion 103 as the bulb portion 103 vertically passes the resilient members 230 and moves the bulb portion 103 from the entry section 240 to the bulb nesting section 241. In the first access state, the first wall plate 218 and the second wall plate 219 remain parallel to each other as well as the central vertical plane D-D of the web receiving cavity 205.

In the second access state, the resilient members 230 do not deflect relative to the first and second wall plates 218, 219. Rather, the entire vertical locking feature 204 deflects outward, causing portions of the first and second wall plates 218, 219 to deflect outward to accommodate for the volume being occupied by the bulb portion 103 as the bulb portion 103 vertically passes the resilient members 230 and moves the bulb portion 103 from the entry section 240 to the bulb nesting section 241. In the second access state, at least portions of the first wall plate 218 and the second wall plate 219 for an oblique angle with the central vertical plane D-D of the web receiving cavity 205.

In the third access state, the saddle bracket 200 undergoes a combination of two distortions. First, the resilient members 230 deflect outward relative to the first and second wall plates 218, 219 in a direction away from the central vertical plane D-D of the web receiving cavity 205. Second, the second and first wall plates 218, 219 deflect outward relative to central vertical plane D-D of the web receiving cavity 205. In the third access state, the entire vertical locking feature 204 deflects outward, causing portions of the first and second wall plates 218, 219 to deflect outward to accommodate for the volume being occupied by the bulb portion 103 as the bulb portion 103 vertically passes the resilient members 230 and moves the bulb portion 103 from the entry section 240 to the bulb nesting section 241. In the third access state, at least portions of the first wall plate 218 and the second wall plate 219 form an oblique angle with the central vertical plane D-D of the web receiving cavity 205 that is smaller than the oblique angle formed between the first and second wall plates 218, 219 with the central vertical plane D-D of the web receiving cavity 205 in the second access state.

In the first, second, and third access state, the resilient elements 230, 230*a*, 230*b* are located at a first mounting distance from the central vertical plane D-D of the web receiving cavity 205.

As shown in FIG. 31, once the bulb portion 103 has fully entered the bulb nesting portion 241 the vertical locking feature 204 will return from the access state to the locking state. Specifically, once the undersurface 104, 104*a*, 104*b* of the bulb portion 103 is positioned above the resilient members 230, 230*a*, 230*b*, the resilient members 230, first wall plate 218, and/or second wall plate 219 will return to a substantially un-deflected state that resembles the positioning of the vertical locking feature 204 and the first and second wall plates 218, 219 before transitioning to the access state. In the locking state, the resilient elements 230, 230*a*, 230*b* are a second mounting distance from the central vertical plane D-D of the web receiving cavity 205. The first distance of the first, second and third access state is greater than the second distance of the locking state.

As shown in FIG. 31, with the bulb portion 103 being located entirely within the bulb nesting section 241, the undersurface 104 of the bulb section 103 engages the resilient members 230. The first undersurface portion 104*a* of the bulb portion 103 on the first side 110 of the web portion 103 engages the first resilient member 230*a* and the second undersurface portion 104*b* of the bulb portion 103 on the second side 112 of the web portion 102 engages the second resilient member 230*b*. Specifically, the free upper edge 231*a* of the first tab 231 engages the first undersurface portion 104*a* of the bulb portion 103 and the free upper edge 232*a* of the second tab 232 engages the second undersurface portion 104*b* of the bulb portion 103.

Figure 28:
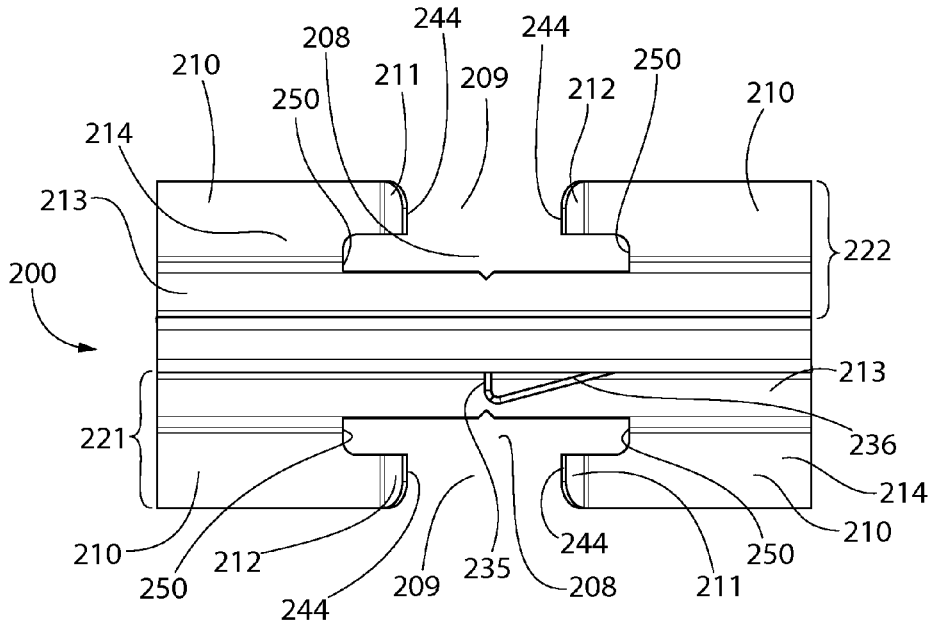
FIG. 28 is a top view of the saddle bracket in the first saddle state according to the first embodiment of the present invention.
Figure 29:
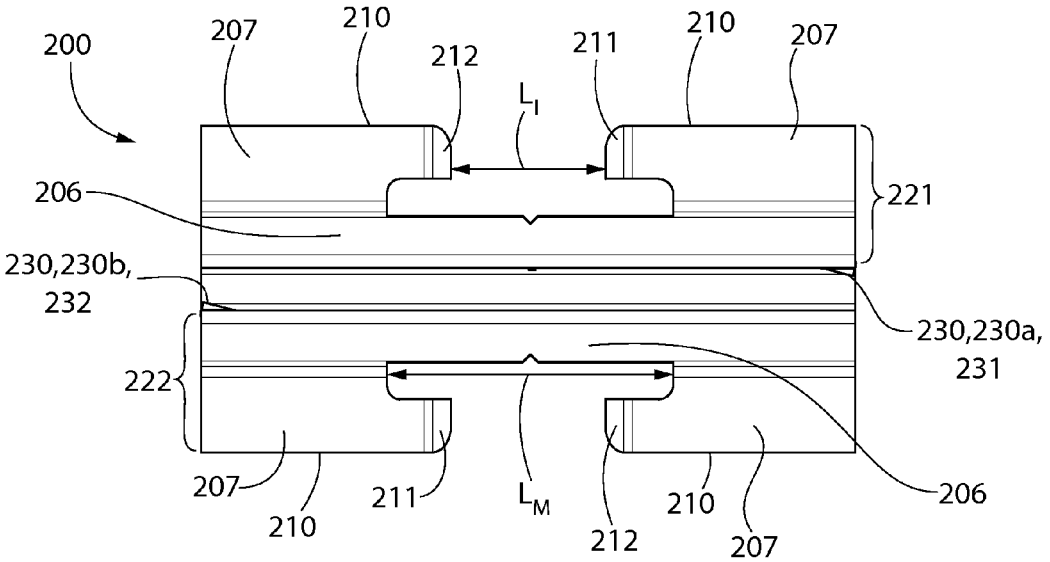
FIG. 29 is a bottom view of the saddle bracket according to the first embodiment of the present invention.

As shown in FIGS. 28 and 29, the support flange 201 of the saddle bracket 200 further comprises a mounting slot 208 (also referred to as a ceiling panel mounting feature), an insertion slot 209, a flat portion 210, and first and second raised portions 211, 212 of the support flange 201. The second plate portion 214 of the support flange 201 comprises the flat portion 210. The mounting slot 208 is formed in the flat portion 210. The raised portions 211, 212 extend upward from the flat portion 210 in an inclined manner and terminate in distal edges 244 that define the insertion slot 209.

As shown in FIGS. 4-6, with the saddle bracket 200 mounted to the strut 100, thereby forming the grid assembly 4, the mounting slot 208 can receive the first and second spring legs 72, 73 of the torsion spring 70 of either the mounting bracket assembly 12 or the ceiling panel apparatus 8, depending on whether the ceiling panel 11 has been coupled to the mounting bracket 20.

The saddle bracket 200 may comprises mounting slots 208 on the second plate portion 213 of the first and second support flanges 221, 222. Each mounting slot 208 comprises edges 250. The second plate portion 213 of the first and second support flanges 221, 222 further comprises the insertion slot 209, wherein the insertion slot 209 extends from the edge 250 of each of the first and second support flanges 221, 222 to the mounting slot 208. The mounting slot 208 has a length LM and the insertion slot 209 has a length LI, wherein the length LM of the mounting slot 208 is greater than the length LI of the insertion slot 209.

Once the saddle bracket 200 is mounted to one of the struts 100—thereby creating the grid assembly 4 in the locking state, a number of element configurations and surface engagements are created.

First, the saddle member 202 straddles the web portion 102 of the strut 100 and the web portion 102 is disposed in the web receiving cavity 205. Second, the first lower surface portion 206 of the support flange 202 overlies the upper surface 105 of the flange portion 101 of the strut 100. Third, the second lower surface portion 207 extends beyond the edge 107 of the flange portion 101 of the strut 100 and is substantially coplanar with the lower surface 106 of the flange portion 101 of the strut 100. Fourth, the support flange 201 comprises a portion 223 that engages the edge 107 of the flange portion 101 of the strut 100.

When the resilient elements 230 of the vertical locking feature 204 engage the undersurface 104, 104*a*, 104*b* of the bulb portion 103 of the strut 100, the saddle bracket 200 is vertically locked to the strut 100. Specifically, the first resilient element 230*a* of the vertical locking feature 204 engages the first undersurface 104*a* of the bulb portion 101 and the second resilient element 230*b* engaged the second undersurface 104*b* of the bulb portion 101.

The engagement between the resilient elements 230, 230*a*, 230*b*, and the undersurface 104, 104*a*, 104*b* of the bulb portion 103 further maintains contact between the support flange 201 of the saddle bracket 200 and the flange portion 101 of the strut 100—thereby vertically locking the saddle bracket 200 to the strut 100. Specifically, the first lower surface 206 of the first plate portion 213 of the support flange 201 contacts the bead 108 of the upper surface 105 of the flange portion 101 of the strut 100 and the edge 107 of the flange portion 101 of the strut 100 contacts the portion 223 of the support flange 201.

Additionally, when the height of the bulb nesting section 241 and the height of the bulb section 103 are substantially equal (not shown), the engagement between the resilient element 230 and the undersurface 104, 104*a*, 104*b* of the bulb portion 103 causes the apex 115*c* of the upper surface 115 of the bulb portion 103 to contact the closed top end 227 of the web receiving cavity 205—thereby further preventing vertical movement between the saddle bracket 200 and the strut 100.

When the height of the bulb nesting section 241 is greater than the height of the bulb section 103 of the strut 100—as shown in FIG. 31—the engagement between the first lower surface 206 of the first plate portion 213 of the support flange 201 and the bead 108 of the top surface 105 of the flange portion 101 of the strut 100 prevents the apex 115*c* of the upper surface 115 of the bulb section 103 from contacting the closed top end 227 of the web receiving cavity 205.

As shown in FIGS. 24A, 24B, 25, 32A, and 32B, after the saddle bracket 200 is mounted to the strut 100, the horizontal locking feature 203 of the saddle bracket 200 can be altered between two states. In the first state, represented by FIGS. 24A, 25, 28, and 32A, the barb portion 235 is in a first position that does not extend into the web receiving cavity 205 or penetrate the bulb portion 103 of the strut 100. In the first state, the saddle bracket 200 can slide horizontally along the strut 100 while the saddle bracket 200 remains vertically locked to the strut 100. In the first state, an acute angle is formed between the barb portion 235 and the arm portion 236 and the barb portion 235 extends substantially perpendicular to the first side surface 113 of the bulb portion 103.

Figure 24A:
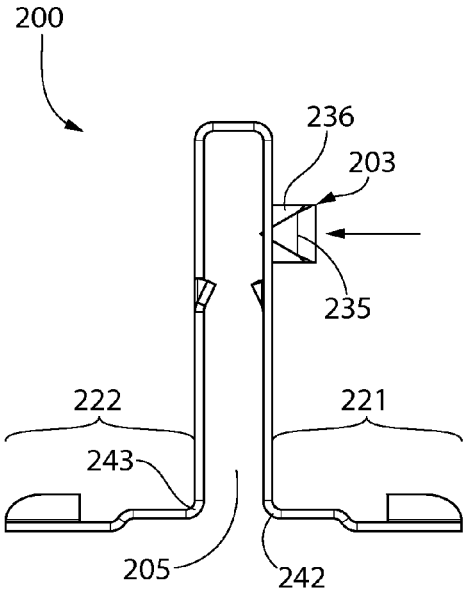
FIG. 24A is a left side view of the saddle bracket in the first horizontal locking state according to the first embodiment of the present invention.
Figure 24B:
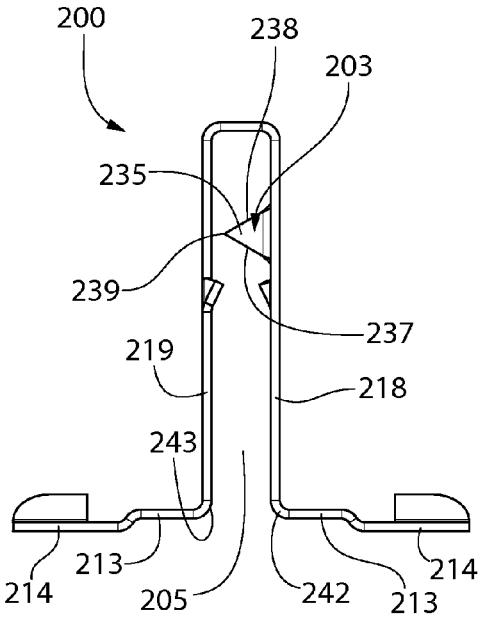
FIG. 24B is a left side view of the saddle bracket in a second horizontal locking state according to the first embodiment of the present invention.
Figure 25:
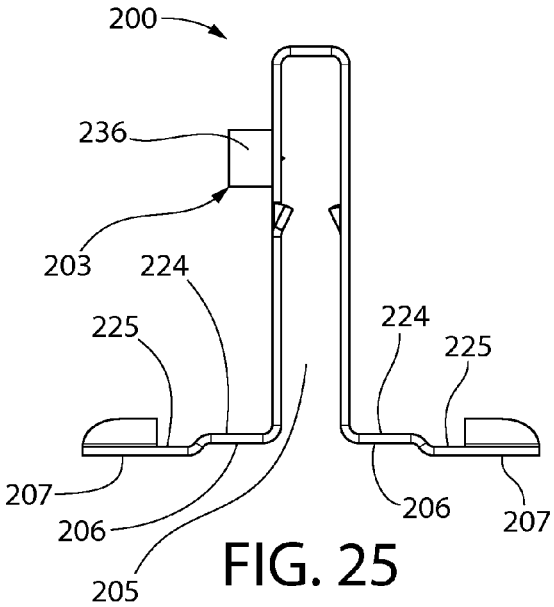
FIG. 25 is a right side view of the saddle bracket in the first horizontal locking state according to the first embodiment of the present invention.
Figure 26:
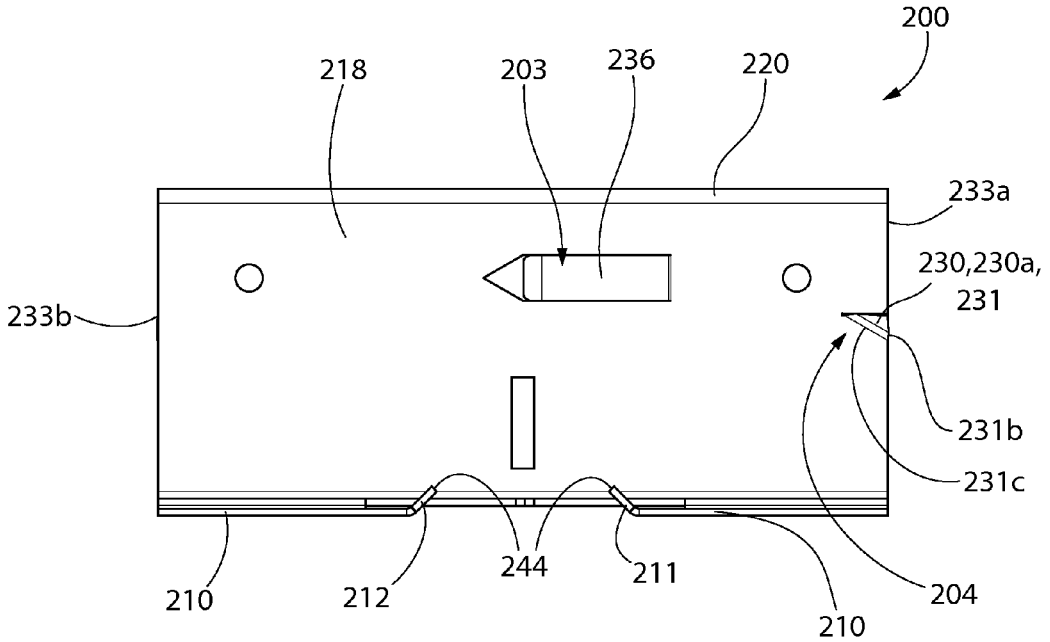
FIG. 26 is a front view of the saddle bracket according to the first embodiment of the present invention.
Figure 27:
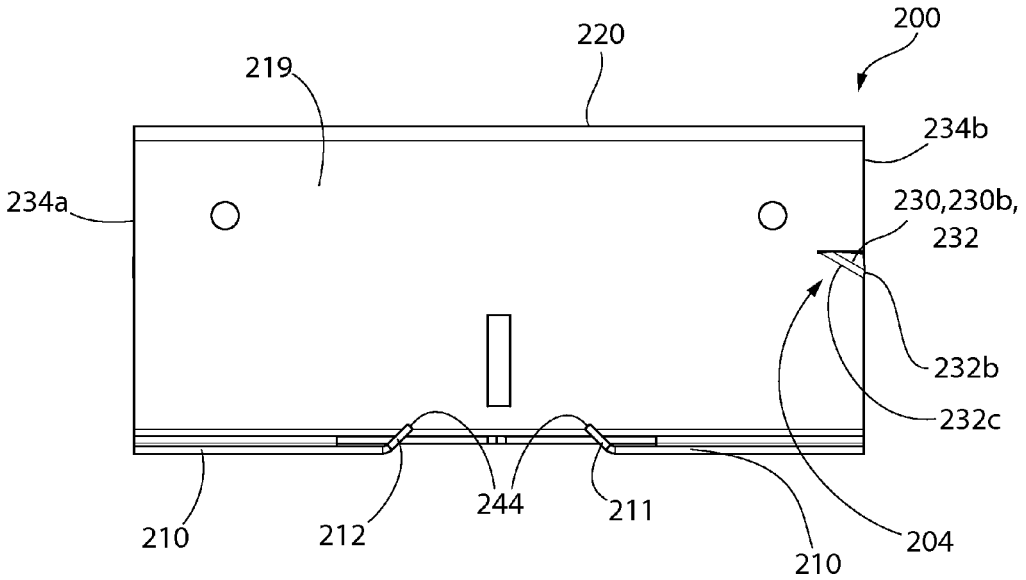
FIG. 27 is a rear view of the saddle bracket according to the first embodiment of the present invention.

In the second state, represented in FIGS. 24B and 32B, the horizontal locking element 203 engages the web portion 102 of the strut 100. Specifically, the barb portion 235 of the horizontal locking feature 203 is in a second position in which the barb portion 235 punctures the bulb portion 103 of the strut 100 causing the barb portion 235 to be located at least partially within the bulb portion 103. The apex 239 of the barb portion 235 perforates the first side surface 113 of the bulb portion 103 and the upper and lower edge 237, 238 of the bar portion slice the first side surface 113 as the barb portion 235 passes through the first side surface 113 into an interior of the bulb portion 119. In the second state, the saddle bracket 200 is horizontally locked to the strut 100. Upon altering the horizontal locking feature 203 from the first state to the second state, the horizontal locking feature 203 rotates about an axis C-C that is substantially parallel to the web portion 102 of the strut 100.

After the saddle bracket 200 has been mounted to the struts 100 of the grid support, the ceiling apparatus 8 or mounting bracket assembly 12 can be attached, thereby forming the connection assemblies 3. It should be noted that the ceiling apparatus 8 or the mounting bracket assembly 12 can be attached to the saddle bracket 200 before or after the horizontal locking feature 203 has been placed in the second position. Placing the horizontal locking feature 203 in the second position after the ceiling apparatus 8 has been attached to the saddle bracket 200 allows the user to adjust the horizontal placement of the ceiling panel 11 within the ceiling system 1, thereby allowing for more accurate positioning of the ceiling panel 11.

In a non-limiting embodiment, the ceiling apparatus 8 is formed by attaching the resilient element 70 to the mounting bracket 20 by inserting the hook member 23 through the central opening 74 of the ring portion 71 via the receiving slot 26. To attach the torsion spring 70 to the hook member 23, the multi-purpose fastener 50 cannot be inserted into the multi-purpose aperture 22 of the mounting bracket 20. However, at the time the torsion spring 70 is attached to the spring member 23 via the receiving slot 26, the mounting bracket 20 may already be coupled to the ceiling panel 11 by one or more fasteners (identical or substantially similar to the multi-purpose fastener 50).

One or more fasteners can be inserted through one or more coupling apertures 27, thereby passing from the upper surface 21*a* of the base plate 21 of the mounting bracket 20, thorough the coupling apertures 27 and into the ceiling panel 11 via the upper surface 13. Once the torsion spring 70 is attached to the hook member 23 of the mounting bracket 20, the multi-purpose fastener 50 is inserted into the multi-purpose aperture 22. Together, the ceiling panel 11, mounting bracket 20, and multi-purpose fastener 50 create the ceiling apparatus 8 and inserting the multi-purpose fastener 50 into the multi-purpose aperture 22 converts the ceiling apparatus 8 from the unlocked state 55 to the locked state 55. Each ceiling panel 11 may be coupled to at least two mounting assemblies 12.

In some embodiments, each ceiling panel 11 is attached to two mounting assemblies 12, and correspondingly coupled to the grid support 2 by two connection assemblies 3, the two mounting assemblies 12 being positioned on opposite sides of the ceiling panel 11 in a parallel configuration, as shown in FIGS. 3 and 4. In other embodiments, each ceiling panel 11 is attached to four mounting assemblies 12 (not shown), and correspondingly coupled to the grid support 2 by four connection assemblies 3, wherein each pair of mounting assemblies 12 are positioned along a single edge of the ceiling panel 11. The two pairs of mounting assemblies 12 are positioned on opposite edges of the ceiling panel 11 in a parallel configuration. Specifically, for each of the mounting bracket assemblies 12, a first part of the mounting bracket assemblies 12 are located adjacent to a first edge of the ceiling panel and a second pair of mounting bracket assemblies are located adjacent to a second edge of the ceiling panel, wherein the first edge of the ceiling panel is opposite the second edge of the ceiling panel. The first edge and the second edge extending in parallel directions.

In either embodiment, the mounting brackets 12 are positioned along parallel edges of the ceiling panel 11, thereby allowing the connection assemblies 3 to slide along the struts 100 before the horizontal locking feature 203 has been converted into the second position, thereby horizontally locking the saddle 200 to the strut 100. The mounting brackets 12 coupled to a single ceiling panel 11 are not oriented in a perpendicular manner as that would prevent the connection assemblies 3 from being able to slide horizontally along the strut 100.

The ceiling apparatus 8 (or mounting bracket assembly 12 if the ceiling panel 11 is not yet attached to the mounting bracket 12) is coupled to the saddle bracket 200 of the grid assembly 4 by the following non-limiting embodiments. The resilient element 70 (torsion spring 70) is detachably coupled to the saddle bracket 200 by the first and second spring legs 72, 73 extending through the mounting slot 208 of the saddle bracket 200. Stated otherwise, the mounting slot 208 on the saddle bracket 200 receives the torsion spring 70 of the ceiling apparatus 8.

Specifically, a user can grasp or use a tool to apply pressure to the first and second spring legs 72, 73, thereby causing the first and second spring legs 72, 73 to pivot about the ring portion 71 toward each other. As the first and second spring legs 72, 73 move toward each other, the first and second ends 75, 76 of the first and second legs 72, 73 become closer. Eventually with enough pressure, the first and second ends 75, 76 of the first and second legs 72, 73 become close enough that at least a portion of the first and second spring legs 72, 73 are separated by a distorted distance that is smaller than the length LI of the insertion slot 209 of the support flange 201. At the distorted distance, at least a portion of the first and second spring legs 72, 73 can be inserted past the distal edges 244 that define the insertion slot 209.

The first and second legs 72, 73 enter and pass through the insertion slot 209, followed by the first and second legs 72, 73 entering the mounting slot 208. After entering the mounting slot 208, the user may remove the pressure applied to the torsion spring 70. Without the applied pressure, the spring bias causes the first and second legs 72, 73 pivot outward toward their original position and the first and second ends 75, 76 of the first and second legs 72, 73 spread apart. The first and second legs 72, 73 will continue to pivot outward until making contact with the edges 250 of the mounting slot 208. The biased torsion spring 70 will exert an outward pressure on the edges 250 of the mounting slot 208, thereby holding the ceiling apparatus 8 (or the mounting bracket 12 if the ceiling panel 11 is not yet attached) in vertical and horizontal place relative to the saddle bracket 200. Together, the mounting bracket 20, torsion spring 70 and saddle bracket 200 create the connection assembly 3. The connection assembly 3 is used to couple the ceiling panel 11 to the grid support 2 of the ceiling system 1. This process is repeated until all torsion springs 70 are coupled to the corresponding saddle brackets 200.

Once the ceiling panels 11 have been attached to the connection assemblies 3, the corresponding ceiling system 1 may be converted between two ceiling states. The first state ("raised state") is shown in FIGS. 1, 3, 34, and 36. The second state ("lowered state") is shown in FIGS. 2, 4, 33, and 35.

Figure 36:
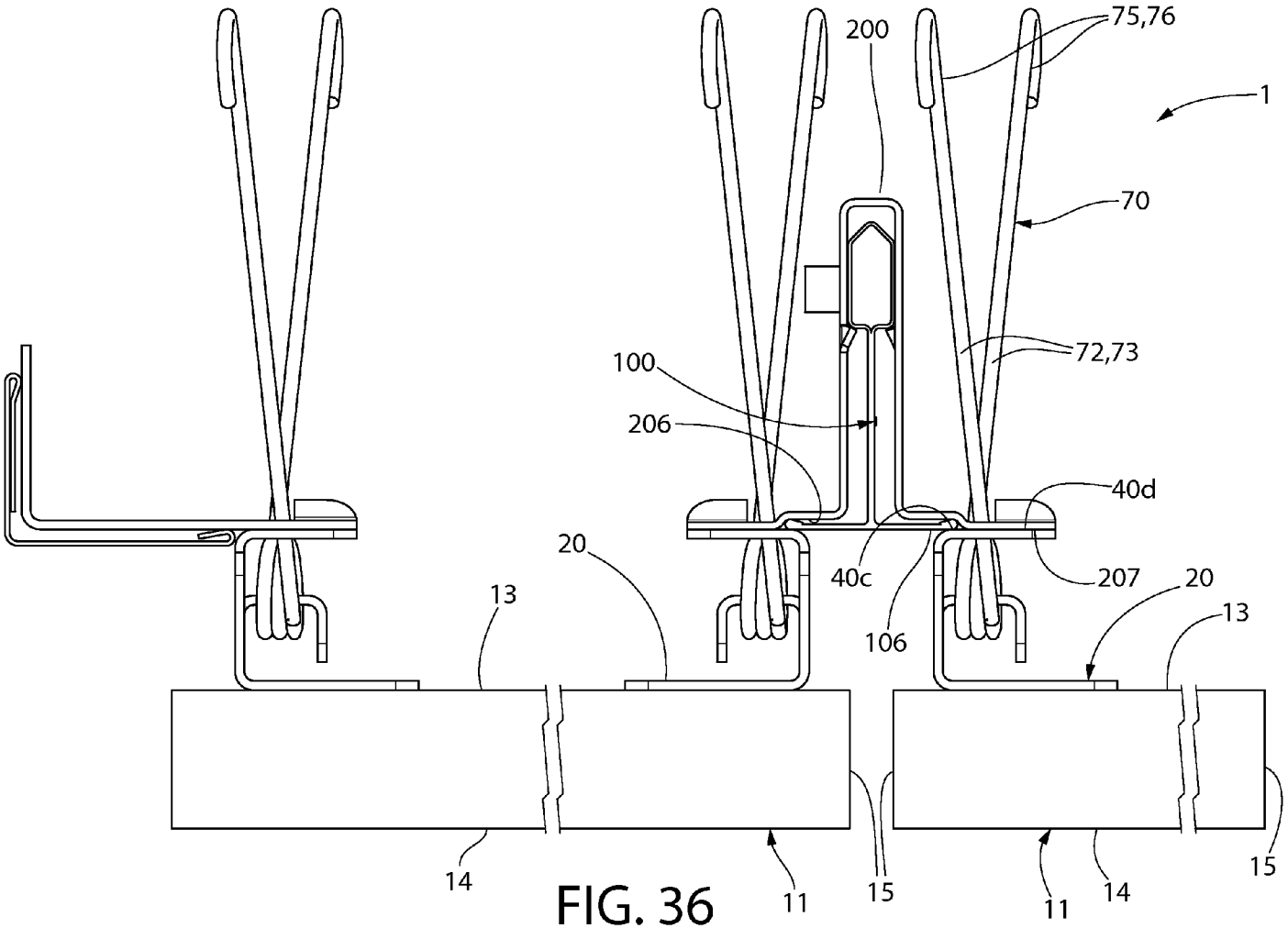
FIG. 36 is a right side view of the ceiling system in the first state according to the first embodiment of the present invention.

As shown in FIGS. 34 and 36, in the raised state the bias of the first and second spring legs 72, 73 against the edges 250 of the mounting slot 208 of the saddle bracket 200 cause the mounting bracket 20, the flange portion 101 of the strut 100, and the support flange 201 of the saddle bracket 200 to be biased toward each other thereby creating at number of engagements. The engagements include contact between the mounting bracket 20 and the stepped support flange 201, as well as the flange portion 101 of the strut 100 being sandwiched between and in contact with the mounting bracket 20 and the stepped support flange 201.

Specifically, the first upper surface portion 40*c* of the upper plate 40 of the mounting bracket 20 contacts the lower surface 106 of the flange portion 101 of the strut 100. The first lower surface portion 206 of the first plate portion 213 of the support flange 201 contacts the upper surface 105 of the flange portion 101 of the strut 100. The second upper surface portion 40*d* of the mounting bracket 20 contacts the second lower surface portion 207 of the support flange 201 of the saddle member. The edge 107 of the flange 101 contacts the portion 223 of the support flange 201, wherein the portion 223 being the transition between the first plate portion 213 and the second plate portion 214 of the support flange 201 of the saddle bracket 200.

In the raised state, the ceiling system 1 will further include at least one of the following configurations. The first and second upper surface portions 40*c*, 40*d* of the mounting bracket 20 are substantially parallel to the upper surface 13 of the ceiling panel 11. The first and second lower surface portions 206, 207 of the support flange 201 of the saddle bracket 200 are substantially parallel to the upper surface 13 of the ceiling panel 11. The lower surface of the flange portion 106 of the strut 100 is substantially parallel to the upper surface 13 of the ceiling panel 11. The first and second upper surface portions 40*c*, 40*d* of the upper plate 40 of the mounting bracket 20 are substantially parallel to the upper surface 13 of the ceiling panel. The first and second lower surface portions 206, 207 of the support flange 201 of the saddle bracket 200 are substantially parallel to the lower surface 106 of the flange portion 101 of the strut 100.

In the raised state, the second lower surface portion 207 of the support flange 201 of the saddle bracket 200 is substantially flush with the lower surface 106 of the flange portion 101 of the strut 100. In the raised state, the second lower surface portion 207 of the support flange 201 of the saddle bracket 200 and the lower surface 106 of the flange portion 101 of the strut 100 are substantially coplanar. In the raised state, the first and second lower surface portions 206, 207 of the support flange 201 are substantially parallel. In the raised state, the first and second upper surface portions 224, 225 of the support flange 201 are substantially parallel.

Figure 33:
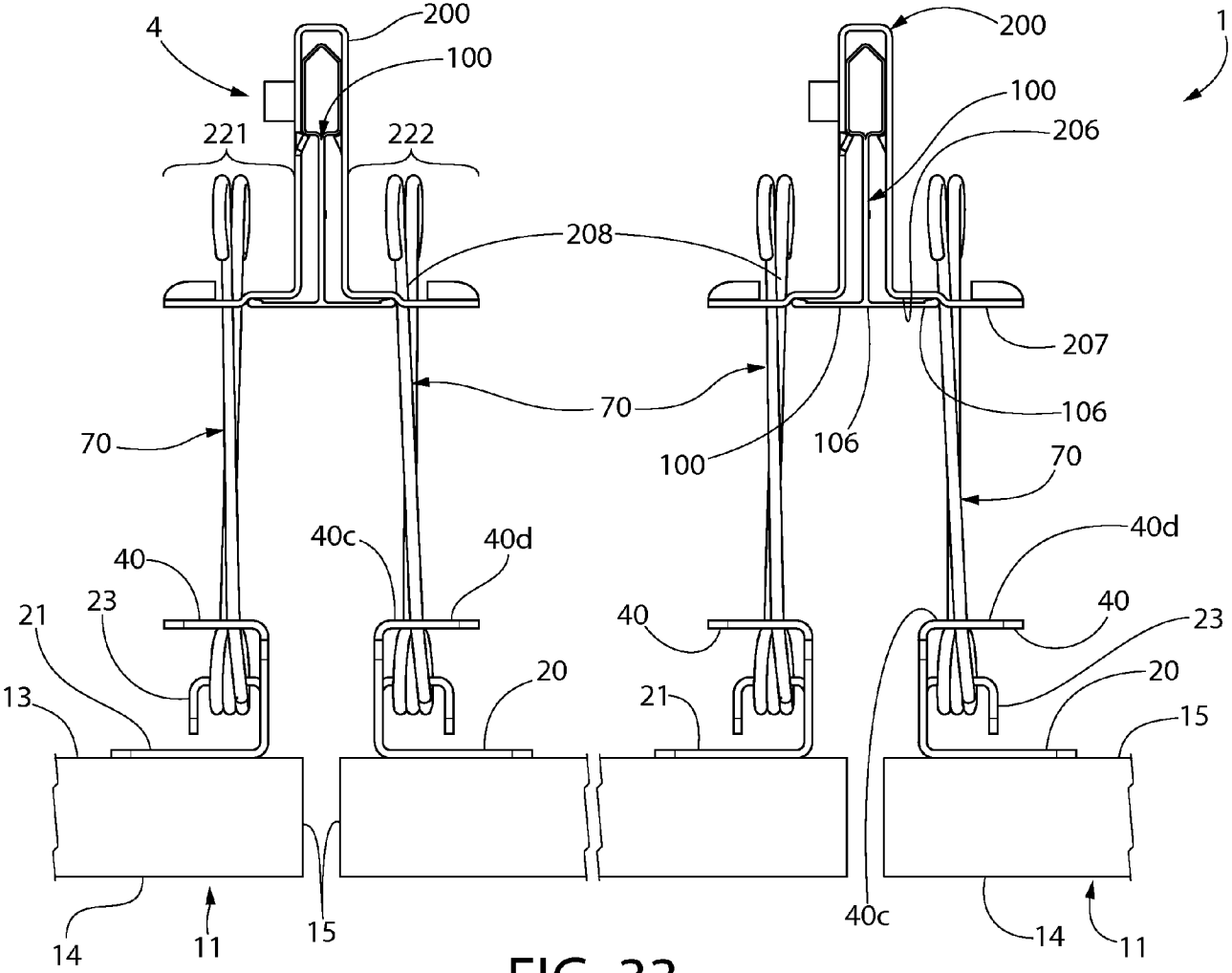
FIG. 33 is a right side view of the ceiling system in the second state according to the first embodiment of the present invention.
Figure 35:
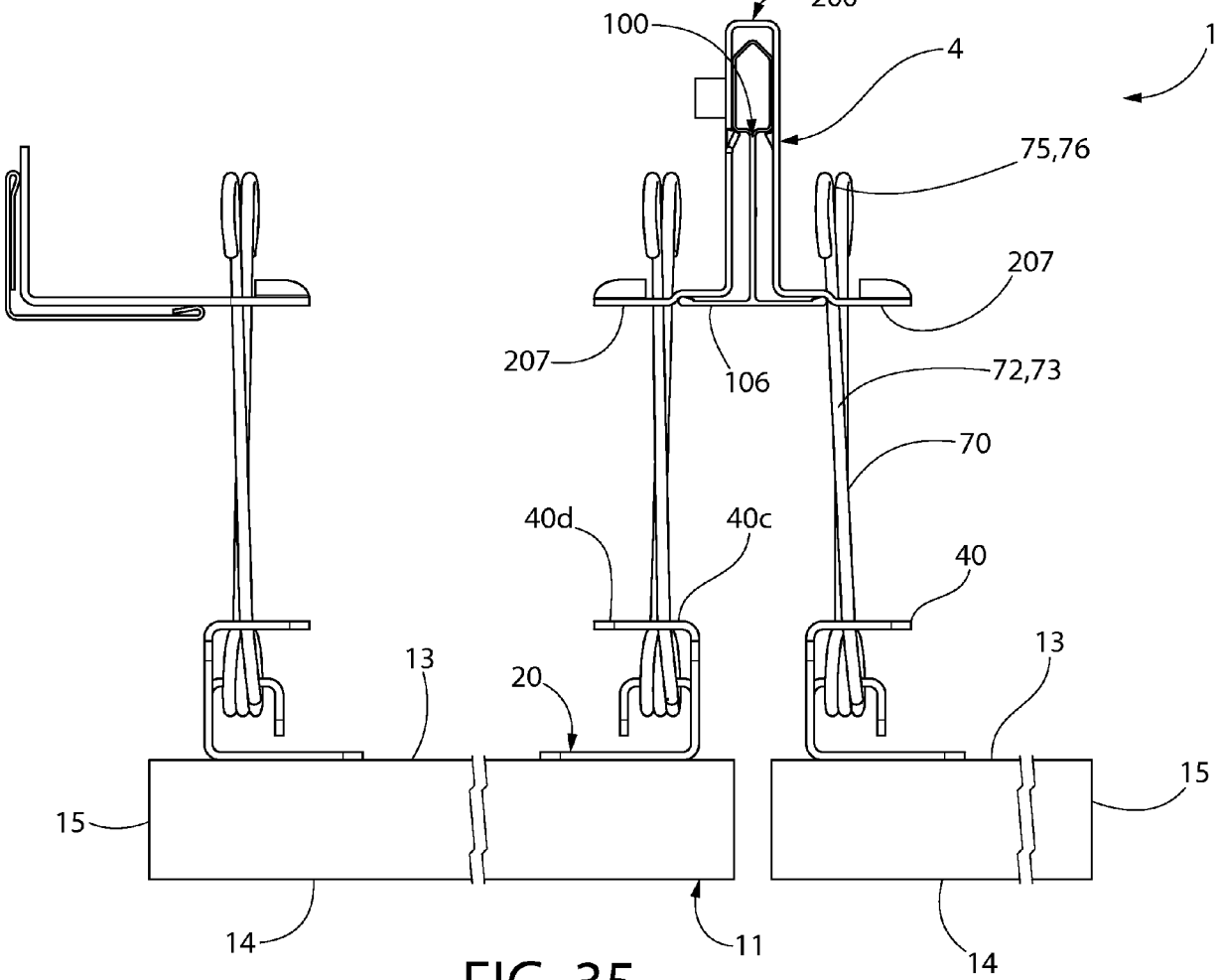
FIG. 35 is a right side view of the ceiling system in the second state according to the first embodiment of the present invention.

As shown in FIGS. 33 and 35, in the lowered state the ceiling panel apparatus 8 is repositioned relative to the grid assembly 4. Specifically, the ceiling panel 11 and mounting bracket 20 are positioned at a vertical distance below the grid assembly 4 relative to the vertical distance of the ceiling panel 11 and mounting bracket 20 in the raised state. In the lowered state, the first and second legs 72, 73 of the torsion spring 70 are still located within the mounting slot 208, however, the first and second ends 75, 76 of the first and second legs 72, 73 are vertically closer to the mounting slot 208. As the first and second legs 72, 73 pass vertically through the mounting slot 208 along the edges 250, the torsion spring 70 is compress and the first and second ends 75, 76 become closer, thereby exerting pressure on the biased torsion spring 70. The additional compressive pressure on the torsion spring 70 allows the ceiling panel apparatus 8 to remain in the lowered state and prevents the torsion spring 70 from unintentionally uncoupling from the saddle bracket 200.

In the lowered state, there is no contact between the mounting bracket 20 and the flange portion 101 of the strut 100. Additionally, in the lowered state, there is no contact between the mounting bracket 20 and the support flange 201 of the saddle bracket 200. The lowered state provides the user with access space to the crawl space 5. When installing the ceiling system 1, the lowered state may also be used to properly align the ceiling panels 11 relative to the grid support 2. Once the user has determined the appropriate horizontal position of the ceiling panel 11, the horizontal locking feature 203 can be converted to the second position using the access space create by the lowered state, and then the ceiling panel 11 can be raised from the lowered state into the raised state.

As shown in FIG. 5, the present invention further provides that the ceiling system 1 may be operated in a third state ("dropped state"). In the dropped state, the torsion springs 70 along a single edge of the ceiling panel 11 on the ceiling apparatus 8 may be uncoupled from the corresponding mounting slot 208 of the grid assembly 4.

The torsion springs 70 are decoupled by grasping or using a tool to apply pressure to the first and second spring legs 72, 73, thereby causing the first and second spring legs 72, 73 to pivot about the ring portion 71 toward each other. As the first and second spring legs 72, 73 move toward each other, the first and second ends 75, 76 of the first and second legs 72, 73 become closer. Eventually with enough pressure, the first and second ends 75, 76 of the first and second legs 72, 73 become close enough that at least a portion of the first and second spring legs 72, 73 are separated by a distorted distance that is smaller than the length LI of the insertion slot 209 of the support flange 201. At the distorted distance, at least a portion of the first and second spring legs 72, 73 can be pulled out from the mounting slot 208, past the distal edges 244 of the insertion slot 209 and free from the saddle bracket 208. This process is repeated until all relevant torsion springs 70 are decoupled to the corresponding saddle brackets 200.

Once the torsions springs 70 along the single edge of the ceiling panel 11 are decoupled from the grid assembly 4, the ceiling panel 11 is free to swing downward toward the active room environment 6. Specifically, as shown in FIG. 14, the notch 36 on the wall plate 35 of the mounting bracket 20 allows the first and second spring legs 72, 73 to clear the wall plate 35 as the wall plate 35 reorients from being substantially parallel to the web portion 102 of the strut 100 to being substantially perpendicular to the web portion 102 of the strut. In the dropped state, the uncoupled ceiling panel 11 provides a user with easy access to the crawl space 6.

Figure 37:
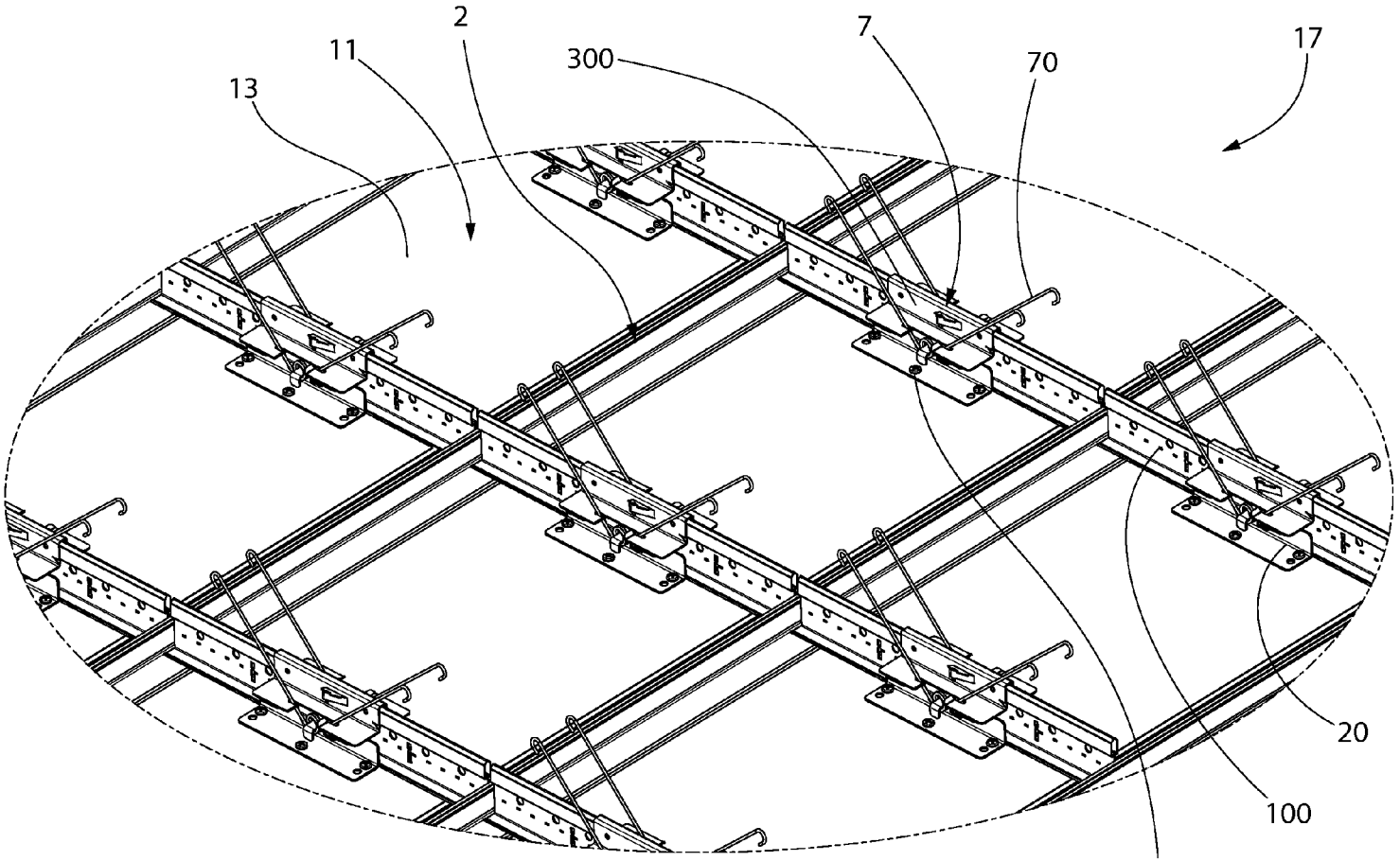
FIG. 37 is a rear partial perspective view of a ceiling system in a first state according to a second embodiment of the present invention.
Figure 38:
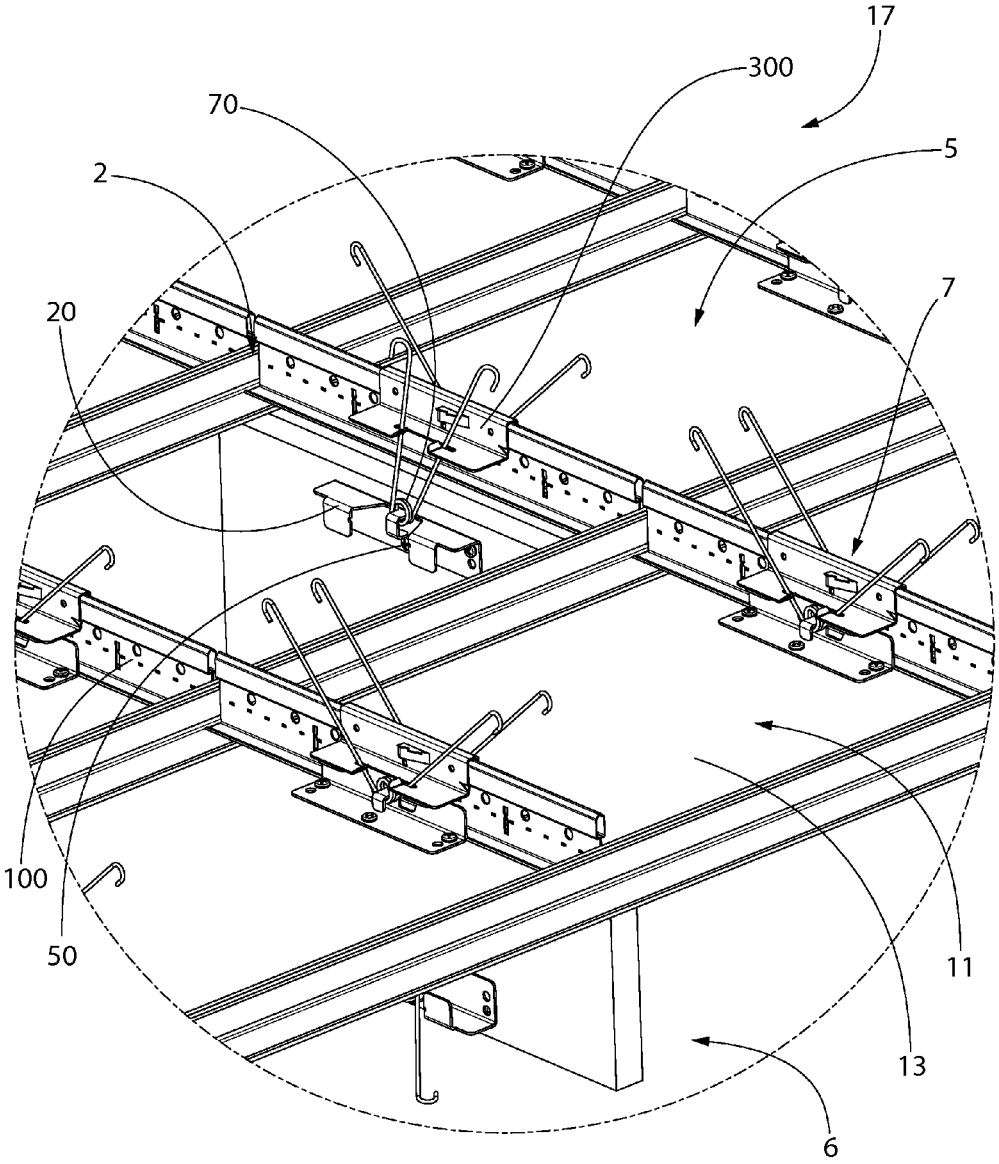
FIG. 38 is a rear partial perspective view of a ceiling system in a third state according to a second embodiment of the present invention.
Figure 39:
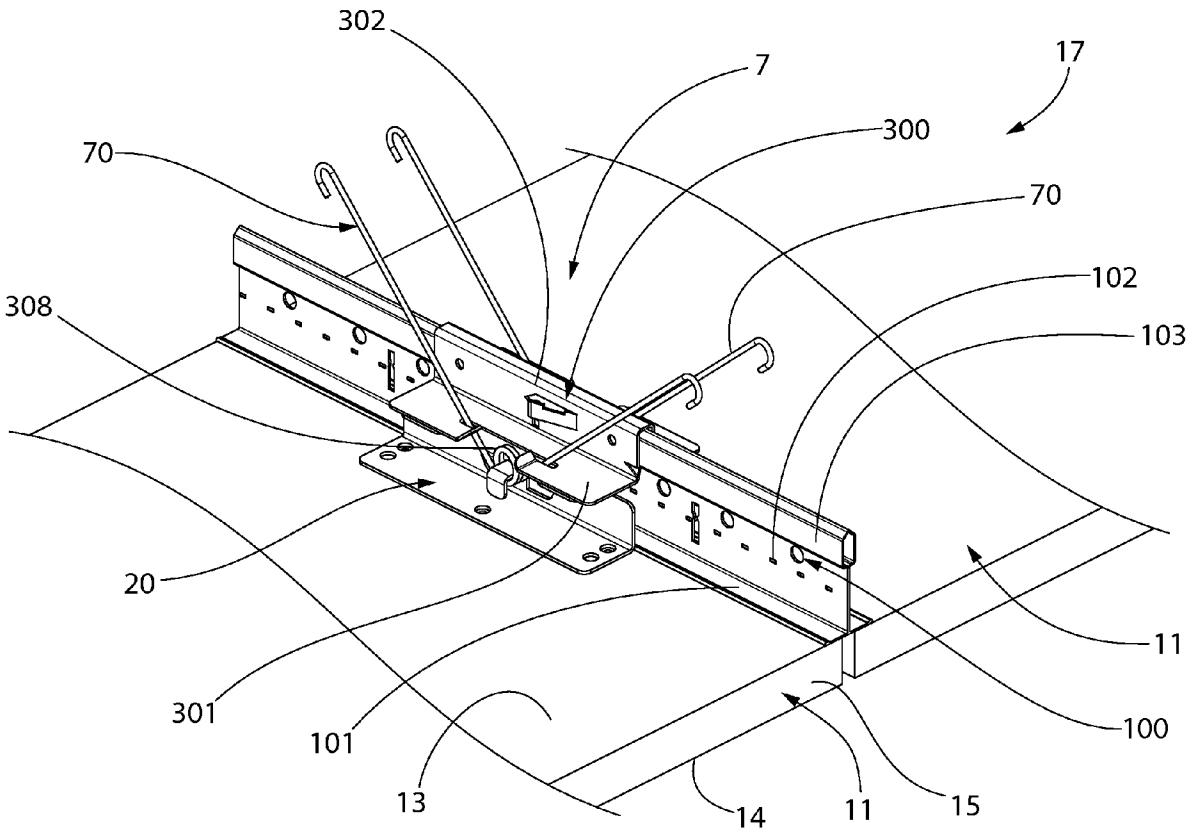
FIG. 39 is a close-up rear partial perspective view of the ceiling system in the first state according to the second embodiment of the present invention.
Figure 40:
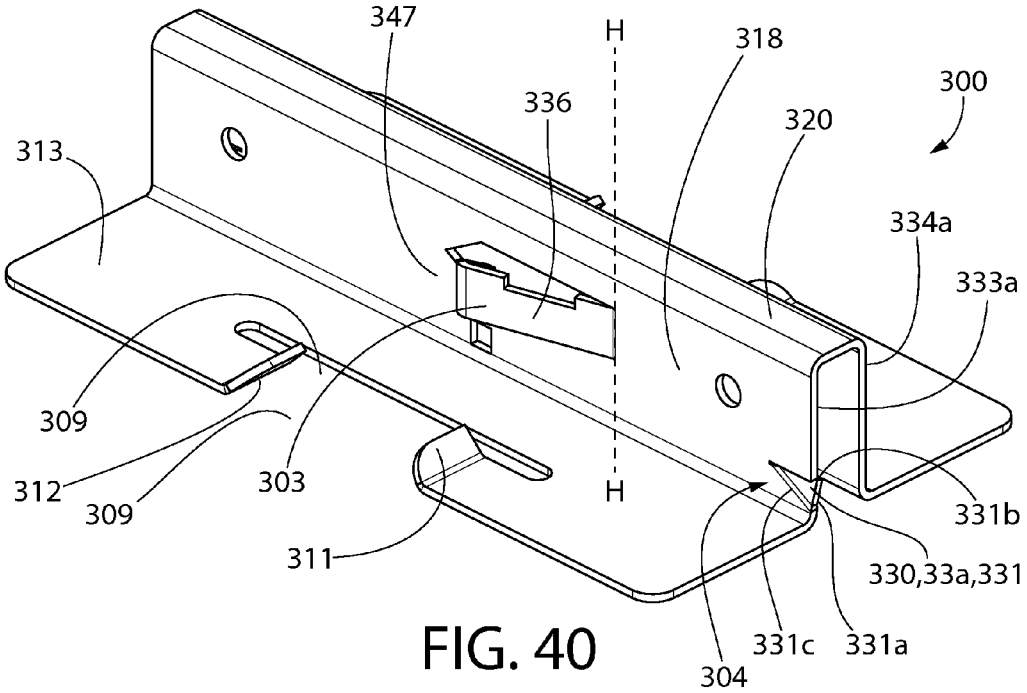
FIG. 40 is a downward front perspective view of the saddle bracket according to the second embodiment of the present invention.
Figure 41:
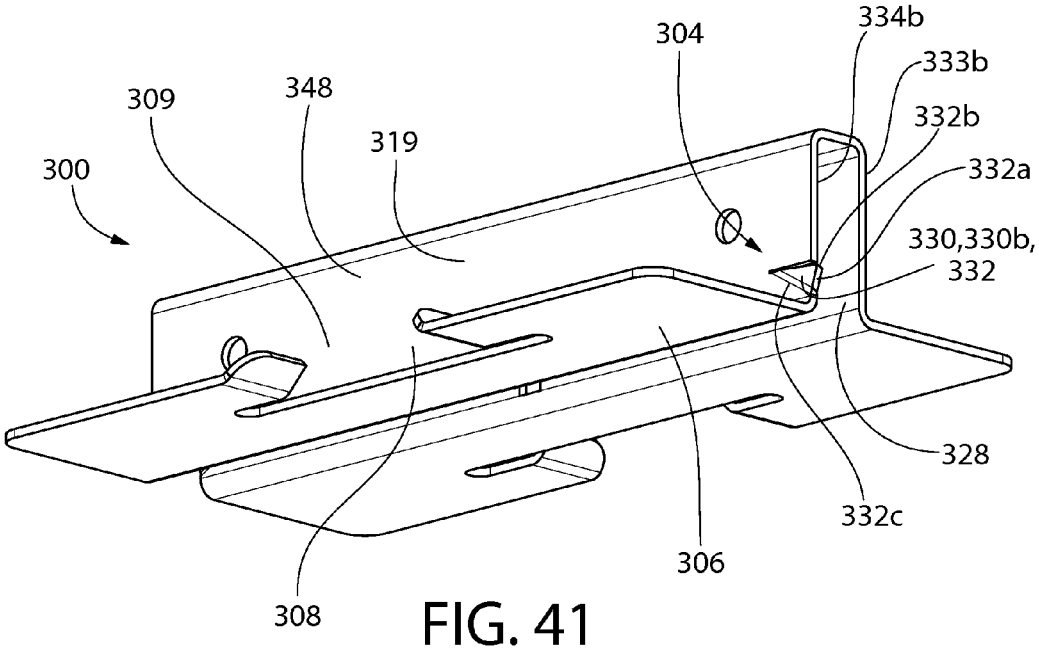
FIG. 41 is an upward rear perspective view of the saddle bracket according to the second embodiment of the present invention.
Figure 42:
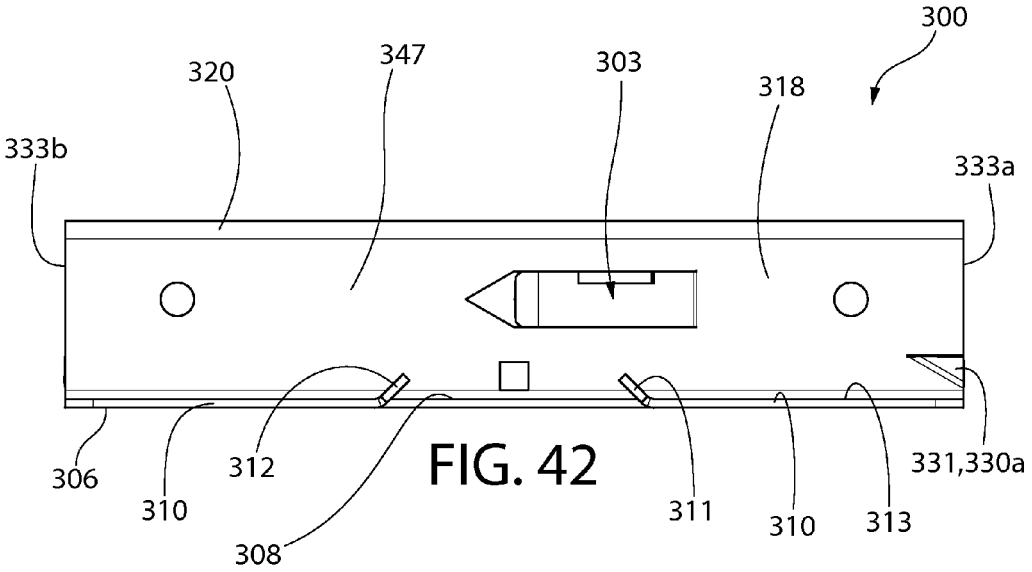
FIG. 42 is a front view of the saddle bracket according to the second embodiment of the present invention.
Figure 43:
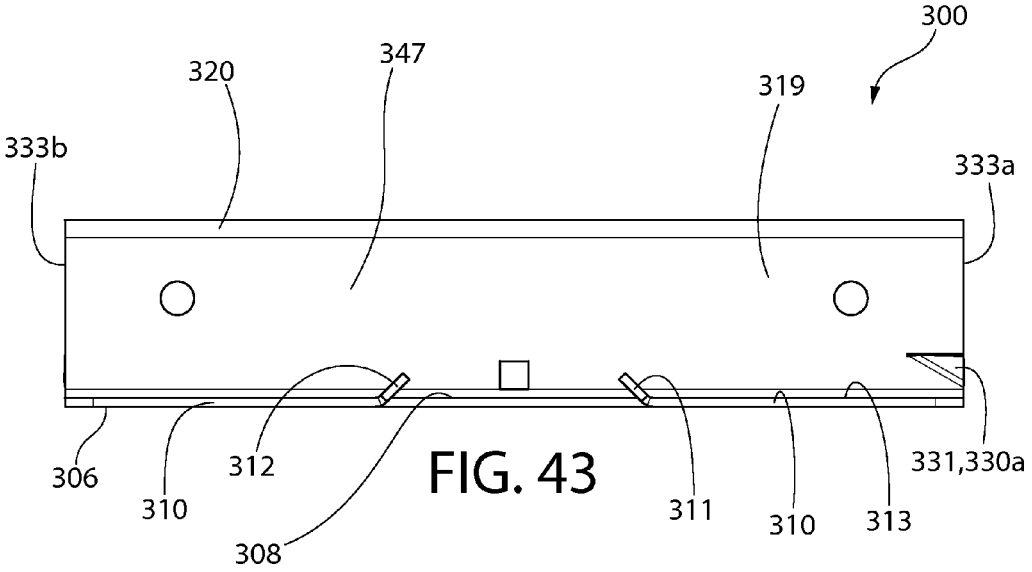
FIG. 43 is a rear view of the saddle bracket according to the second embodiment of the present invention
Figure 44:
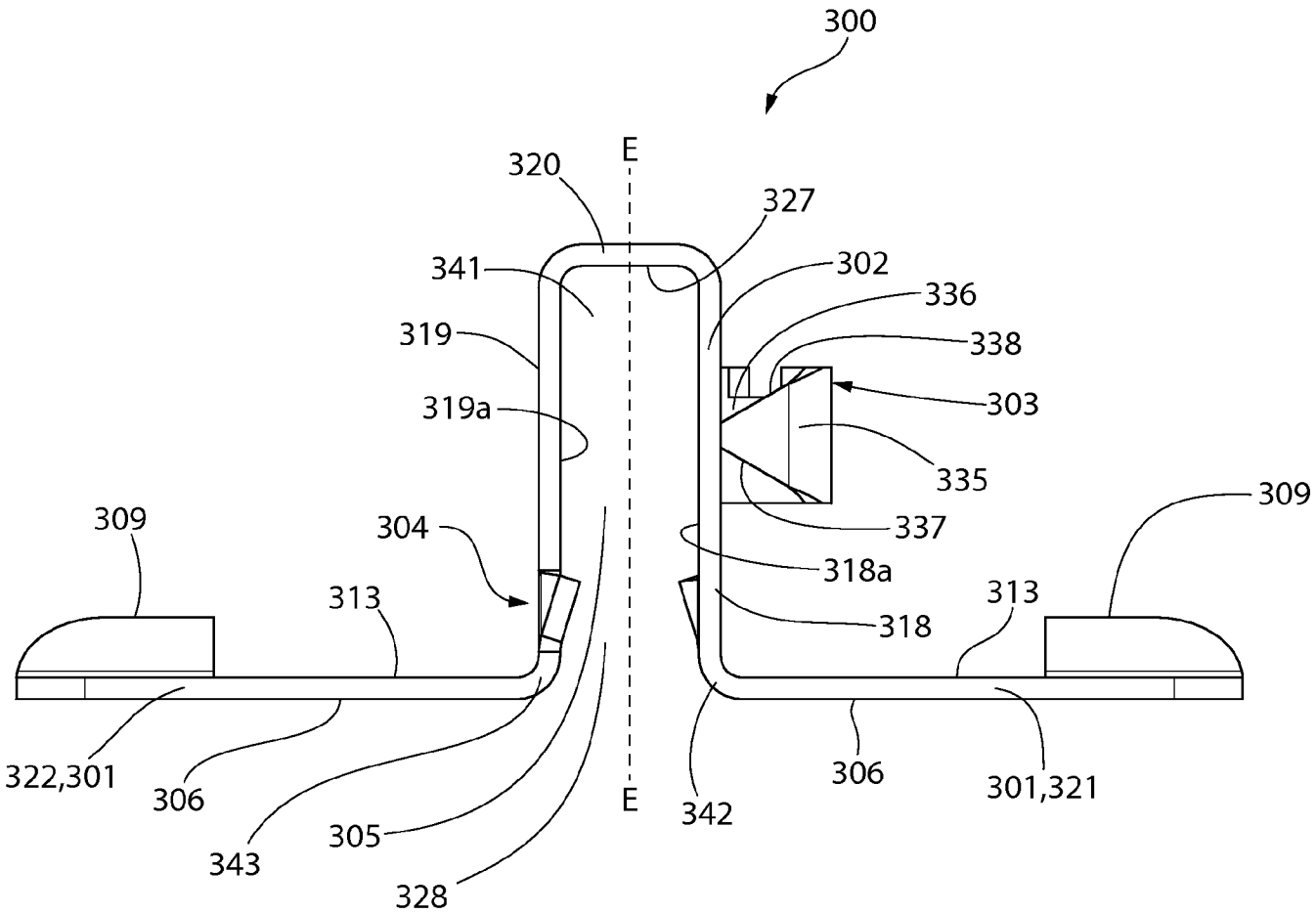
FIG. 44 is a left side view of the saddle bracket in a first saddle bracket state according to the second embodiment of the present invention.

As shown in FIGS. 37-39, in another embodiment, the ceiling system 17 may be created with using a second connection assembly 7. The second connection assembly 7 comprising essentially the same elements except a second saddle bracket 300 is used in place of the first saddle bracket 200.

The second saddle bracket 300 is an integrally formed singular component comprising a support flange 301, a saddle member 302, a horizontal locking feature 303, and a vertical locking feature 304. The saddle member 302 defines a web receiving cavity 305 for receiving the web portion 102 of the struts 100, wherein the web receiving cavity 305 has a closed top end 327 and an open lower end 328. The support flange 301 extends from the saddle member 303

As shown in FIGS. 40-48, the saddle member 302 comprises a first wall plate 318, a second wall plate 319, and a bight portion 320. The bight portion 320 connects the first and second wall plates 318, 319, and the first wall plate 318, second wall plate 319. The bight portion 320 collectively define the web receiving cavity 305 that extends along a central vertical plane E-E. The bight portion 320 encloses a top end 327 of the web receiving cavity 305. An open lower end 328 exists between the first and second wall plates 318, 319, opposite the bight portion 320 of the saddle member 302.

The first wall plate 318 comprises first and second edges 333*a*, 333*b*. The second wall plate 319 comprises first and second edges 334*a*, 334*b*. The first and second edges 333*a*, 333*b*, 334*a*, 334*b* of the first and second wall plates 318, 319 are each free edges. The first side edge 333*a* of the first wall plate 318 and the second side edge 334*b* of the second wall plate 319 are located on opposite sides of the saddle bracket 300.

The first wall plate 318 comprises an inner surface 318*a* that faces the web receiving cavity 305. The second wall plate 319 comprises an inner surface 319*a* that faces the web receiving cavity 305. The inner surfaces 318*a*, 319*a* of the first and second wall plates 318, 319 face the central vertical plane E-E as well as face each other. The first wall plate 318 and the second wall plate 319 are substantially parallel with the central vertical plane E-E.

The horizontal locking feature 303 comprises a barb portion 335 and an arm portion 336, wherein the barb portion 335 is located at the distal end of the arm portion 336. The barb portion 335 comprises a lower edge 337 and an upper edge 338 that converge at an apex 339.

The vertical locking feature 304 comprises a resilient element 330 that can be altered between a locking state and an access state. The resilient element 330 is biased into the locking state. The resilient element 330 including a first resilient element 330*a* and a second resilient element 330*b*. The first resilient element 330*a* is located on the first wall plate 318 of the saddle bracket 300 and the second resilient element 330*b* is located on the second wall plate 319 of the saddle bracket 300.

The vertical position of the resilient element 330 along the first wall plate 318 and the second wall plate 319 defines vertical position of the bulb nesting section 341. Specifically, the bulb nesting section 341 extends from the resilient element 330 to the closed top end 327 of the saddle member 302.

The first resilient element 330*a* comprises a first tab 331 that is formed into the first side edge 333*a* of the first wall plate 318. The first resilient element 330*a* protrudes from the inner surface 318*a* of the first wall plate 318. The second resilient element 330*b* comprises a second tab 332 that is formed into the second side edge 334*b* of the second wall plate 319. The second resilient element 330*b* protrudes from the inner surface 319*a* of the second wall plate 319.

The first tab 331 is an integrally formed portion of the first wall plate 318 and the second tab 332 is an integrally formed portion of the second wall plate 319. The first tab 331 is created by making a substantially perpendicular cut into the first wall plate 318 from the first side edge 333*a*. A portion of first wall plate 318 below the perpendicular cut is then bent out of plane with a main body portion 347 of the first wall plate 318 in a direction inward toward the web receiving cavity 305. The second tab 332 is created by making a substantially perpendicular cut into the second wall plate 319 from the second side edge 334*b*. A portion of second wall plate 319 below the perpendicular cut is then bent out of plane with a main body portion 348 of the second wall plate 319 in a direction inward toward the web receiving cavity 305.

The resulting first tab 331 is a triangular element having a free upper edge 331*a*, a free lateral edge 331*b*, and a bend 331*c*. The bend 331*c* integrally connects the first tab 331 to the main body portion 347 of the first wall plate 318. The free lateral edge 331*b* of the first tab 331 is a portion of the first side edge 333*a* of the first wall plate 318. The resulting second tab 332 is a triangular element having a free upper edge 332*a*, a free lateral edge 332*b*, and a bend 332*c*. The bend 232*c* integrally connects the second tab 332 to the main body portion 348 of the second wall plate 319. The free lateral edge 332*b* of the first tab 332 is a portion of the second side edge 334*b* of the second wall plate 319. The resulting vertical locking feature extends into the web receiving cavity 305.

The support flange 301 of the present invention may comprise a first support flange 321 and a second support flange 322. The first support flange 321 extends from a lower end 342 of the first wall plate 318 of the saddle member 302 in a first direction that is substantially orthogonal to the central vertical plane E-E. The second support flange 322 extends from a lower end 343 of the second wall plate 319 of the saddle member 302 in a second direction that is substantially orthogonal to the central vertical plane E-E. The first and second directions are opposite of each other. Both the first and second support flanges 321, 322 of the support flange 301 comprise an upper surface 313 and a lower surface 306.

Each of the first and second support flanges 321, 322 comprises a mounting slot 308 (also referred to as a ceiling panel mounting feature), an insertion slot 309, a flat portion 310, and first and second raised portions 311, 312. The mounting slot 308 is formed in the flat portion 310. The insertion slot 309 extends from an edge 350 of the support flange 308 to the mounting slot 308. The mounting slot 308 has a length LM and the insertion slot 309 has a length LI, wherein the length LM of the mounting slot 308 is greater than the length LI of the insertion slot 309. The raised portions 311, 312 extend upward from the flat portion 310 in an inclined manner and terminate in distal edges 344 that define the insertion slot 309.

The mounting slot 308 is configured to receive the first and second spring legs 72, 73 of the torsion spring 70. The insertion slot 309 extends from an edge 317 of each of the first and second support flanges 321, 322 to the mounting slot 308. The mounting slot 308 has a length 315 and the insertion slot 309 has a length 316, wherein the length 315 of the mounting slot 308 is greater than the length 316 of the insertion slot 309.

Figure 50:
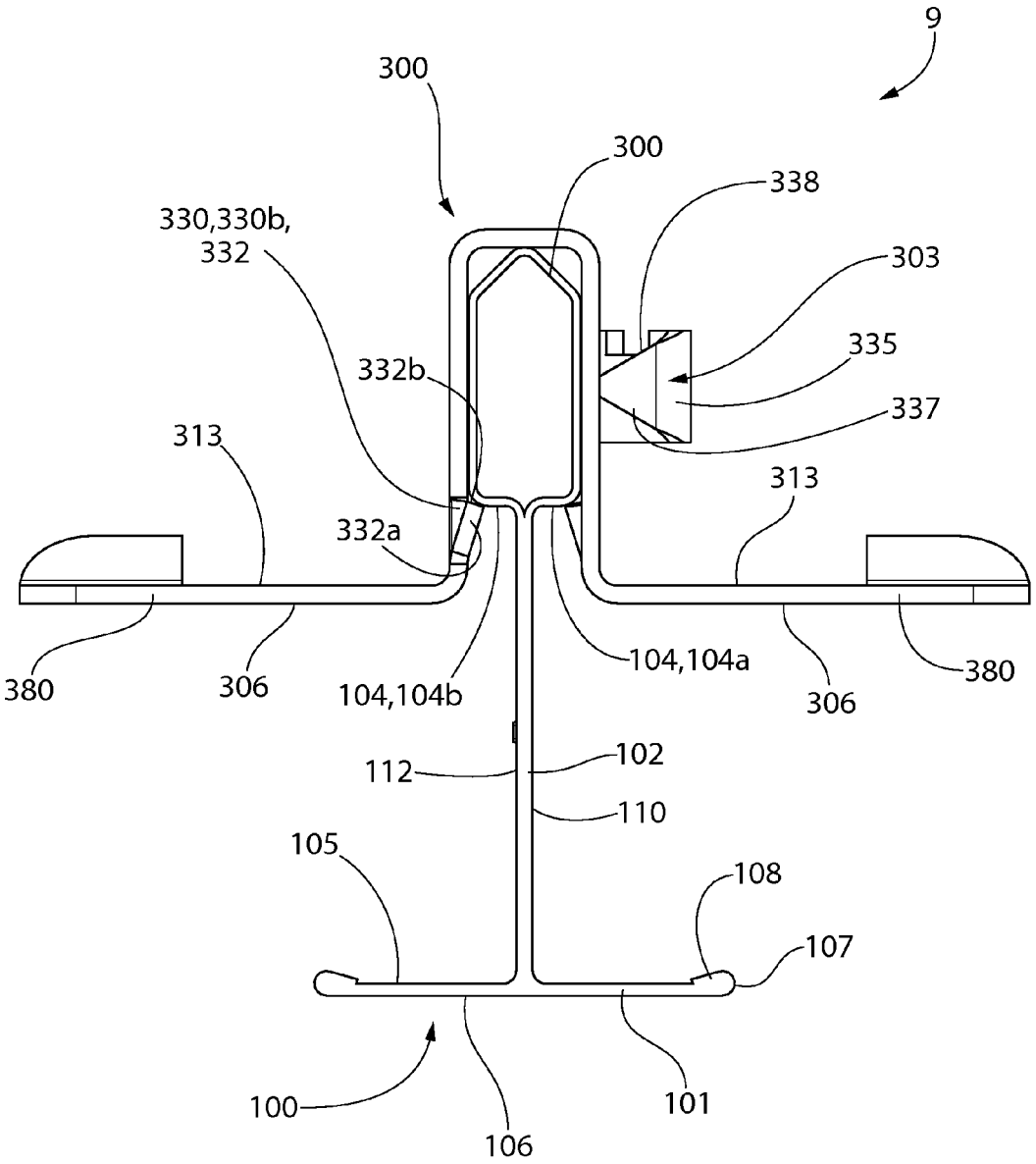
FIG. 50 is a left view of the grid assembly according to the second embodiment of the present invention.
Figure 51:
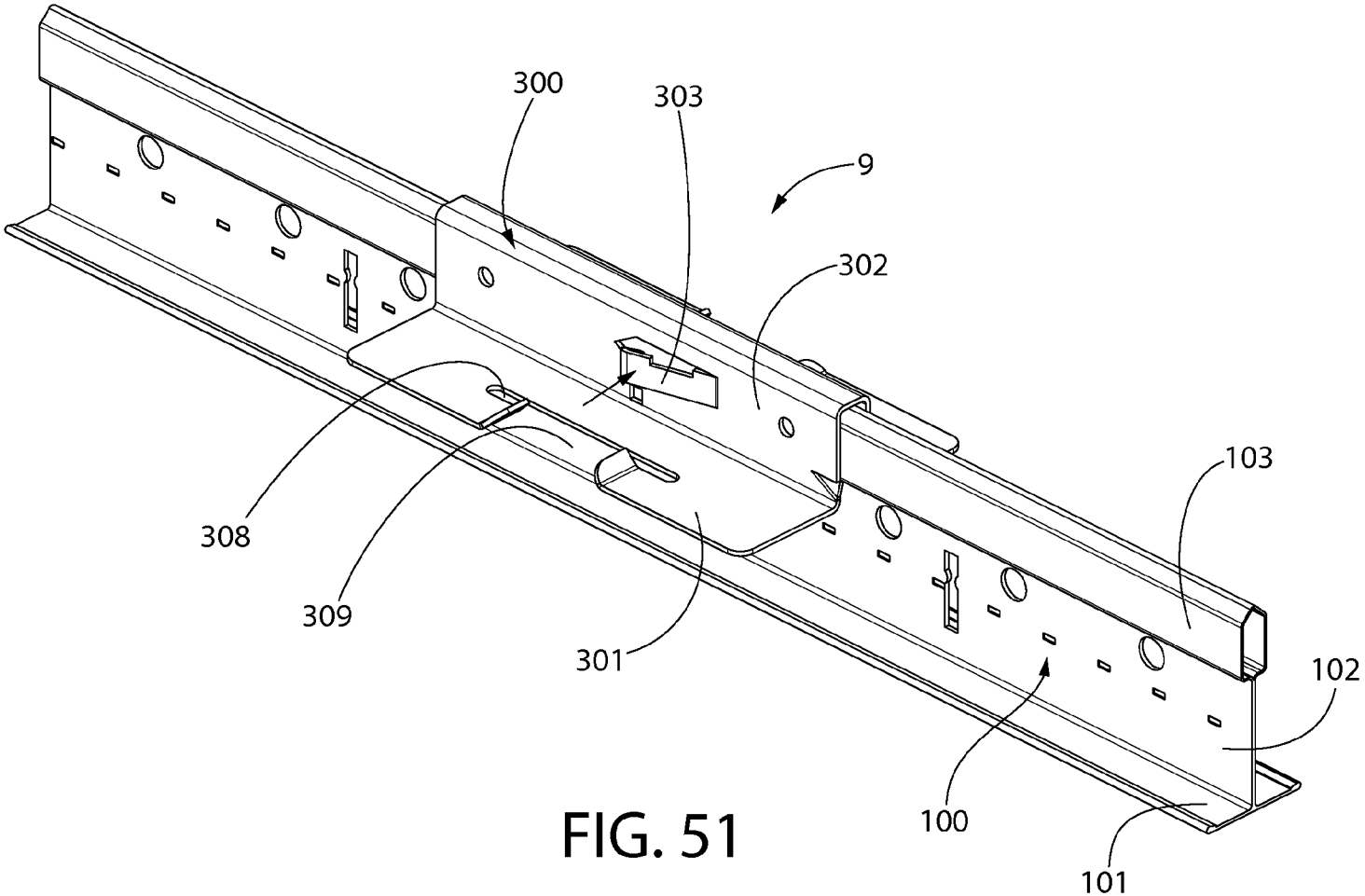
FIG. 51 is a downward front perspective view of the grid assembly according to the second embodiment of the present invention.
Figure 52:
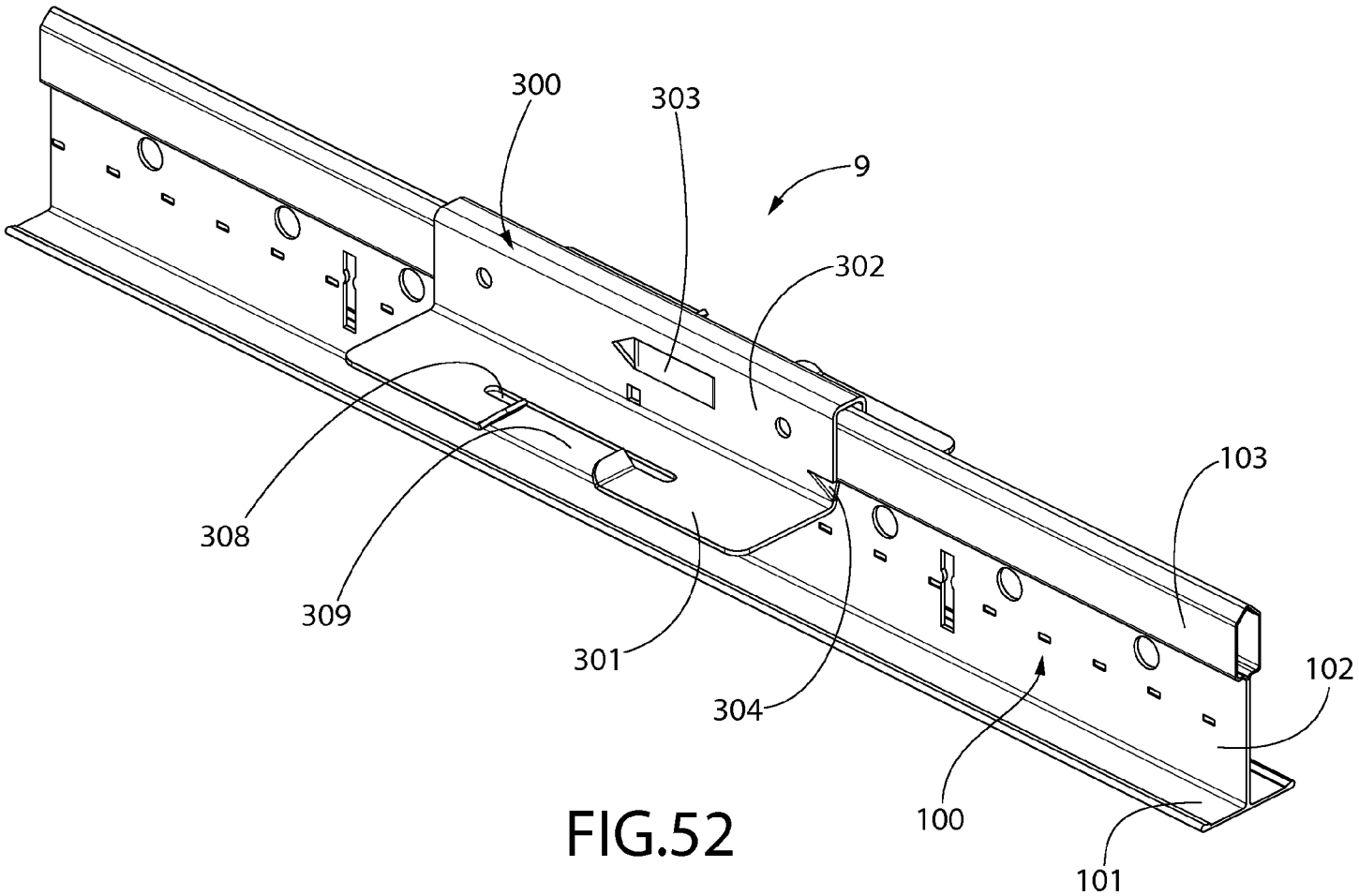
FIG. 52 is a downward front perspective view of the grid assembly according to the second embodiment of the present invention.

As shown in FIGS. 50-52, mounting the saddle bracket 300 to the strut 100 forms a grid assembly 9 of the second embodiment. During mounting, the vertical locking feature 304 alternates between at least two states: a locking state and an access state. To mount the saddle bracket 300 to the strut 100, the saddle bracket 300 is positioned above the strut 100 causing the top surface 118 of the bulb portion 103 to face the open lower end 328 of the saddle bracket 300. The bulb portion 103 of the web portion 102 passes through the open lower end 328 of the saddle member 302. The first and second resilient elements 330*a*, 330*b* contact the first and second sloped portions 115*a*, 115*b* of the upper surface 115 of the bulb portion 103. As the web portion 102 continues to travel upward relative to the saddle member 302, the vertical locking features 304 deflect into at least three access states. The three access states of saddle bracket 300 correspond to the previously discussed three access states of saddle bracket 200.

Once the bulb portion 103 has fully entered the bulb nesting portion 341 the undersurface 104, 104*a*, 104*b* of the bulb portion 103 will be positioned above the resilient members 330, 330*a*, 330*b*. With the bulb portion 103 being located entirely within the bulb nesting section 341, the undersurface 104 of the bulb section 103 engages the resilient members 330. Specifically, the first undersurface portion 104*a* of the bulb portion 103 on the first side 110 of the web portion 103 engages the free upper edge 331*a* of the first tab 331 of the first resilient member 330*a*. The second undersurface portion 104*b* of the bulb portion 103 on the second side 112 of the web portion 102 engages the free upper edge 332*b* of the second tab 332 of the second resilient member 330*b*.

The engagement between the vertical locking feature 304, specifically the resilient element 330, with the undersurface 104, 104*a*, 104*b* of the bulb portion 103 further maintains that the support flange 201 of the saddle bracket 300 is in contact with the flange portion 101 of the strut 100.

As shown in FIGS. 45A, 45B, 46, 51, and 52, after the saddle bracket 300 is mounted to the strut 100, the horizontal locking feature 303 of the saddle bracket 300 can be altered between two states. In the first state, represented by FIGS. 45A, 46, 50, and 51, the barb portion 335 is in a first position that does not extend into the web receiving cavity 305 or penetrate the bulb portion 103 of the strut 100. In the first state, the saddle bracket 300 can slide horizontally along the strut 100 while the saddle bracket 300 remains vertically locked to the strut 100. In the first state, an acute angle is formed between the barb portion 335 and the arm portion 336 and the barb portion 335 extends substantially perpendicular to the first side surface 113 of the bulb portion 103.

Figure 45A:
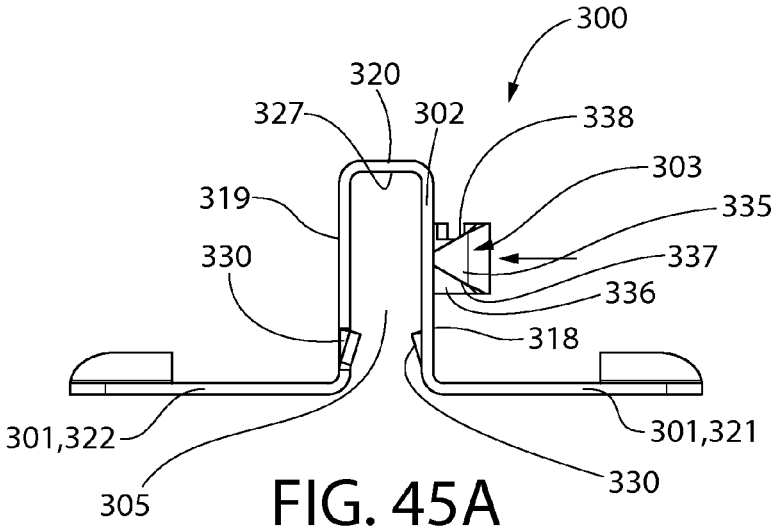
FIG. 45A is a left side view of the saddle bracket in a first horizontal locking state according to the second embodiment of the present invention.
Figure 45B:
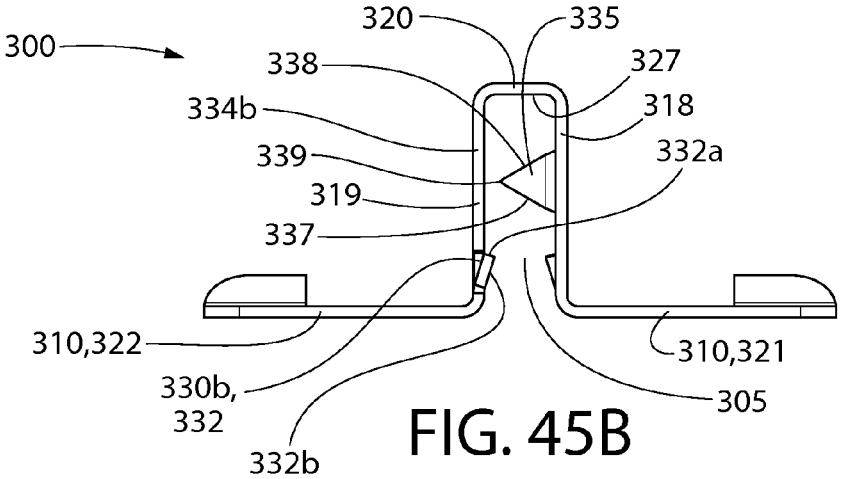
FIG. 45B is a left side view of the saddle bracket in a second horizontal locking state according to the second embodiment of the present invention.
Figure 46:
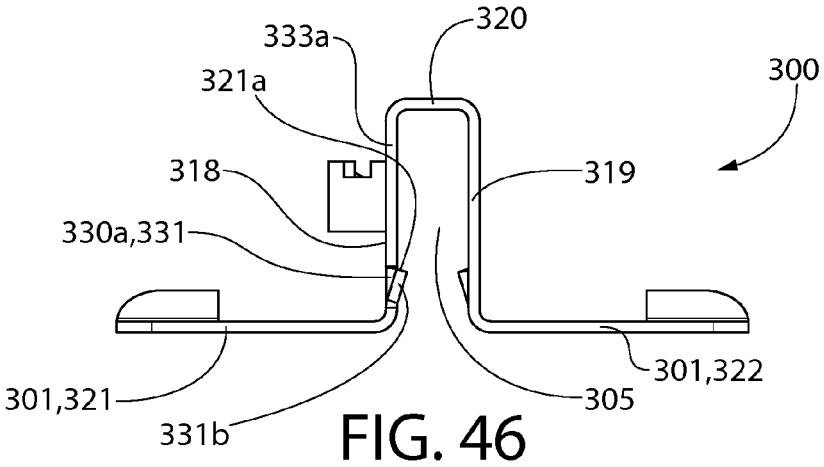
FIG. 46 is a right side view of the saddle bracket in the first horizontal locking state according to the second embodiment of the present invention.
Figure 47:
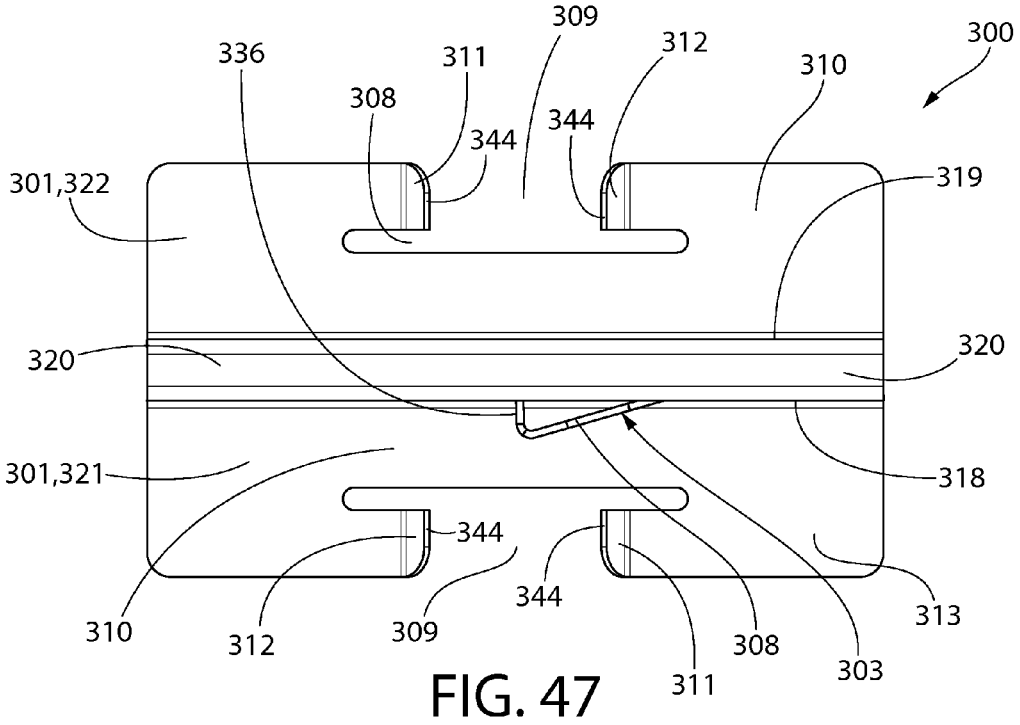
FIG. 47 is a top view of the saddle bracket in the first saddle bracket state according to the second embodiment of the present invention.
Figure 48:
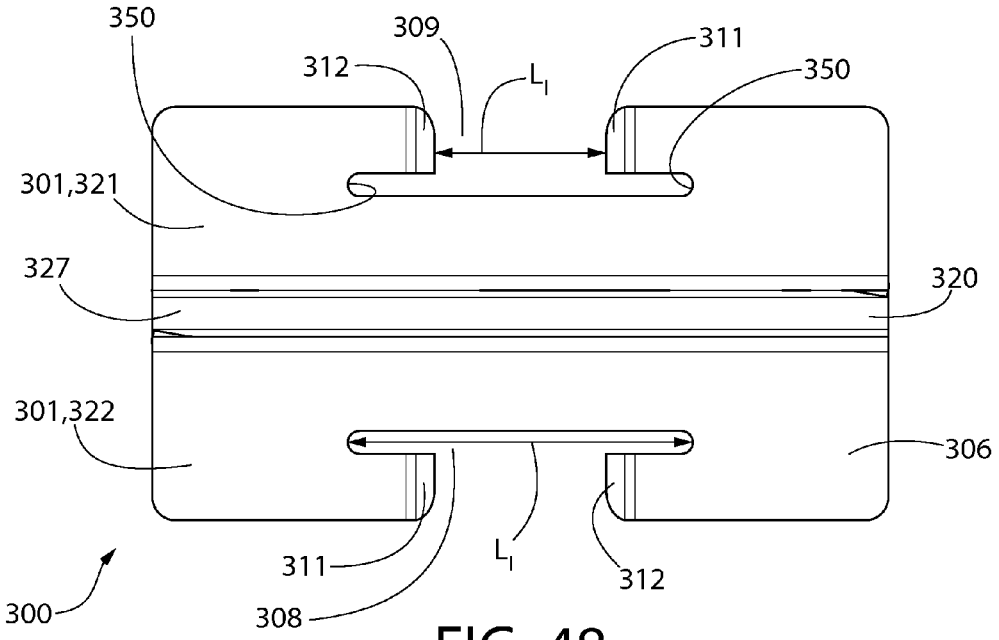
FIG. 48 is a bottom view of the saddle bracket in the first saddle bracket state according to the second embodiment of the present invention.
Figure 49:
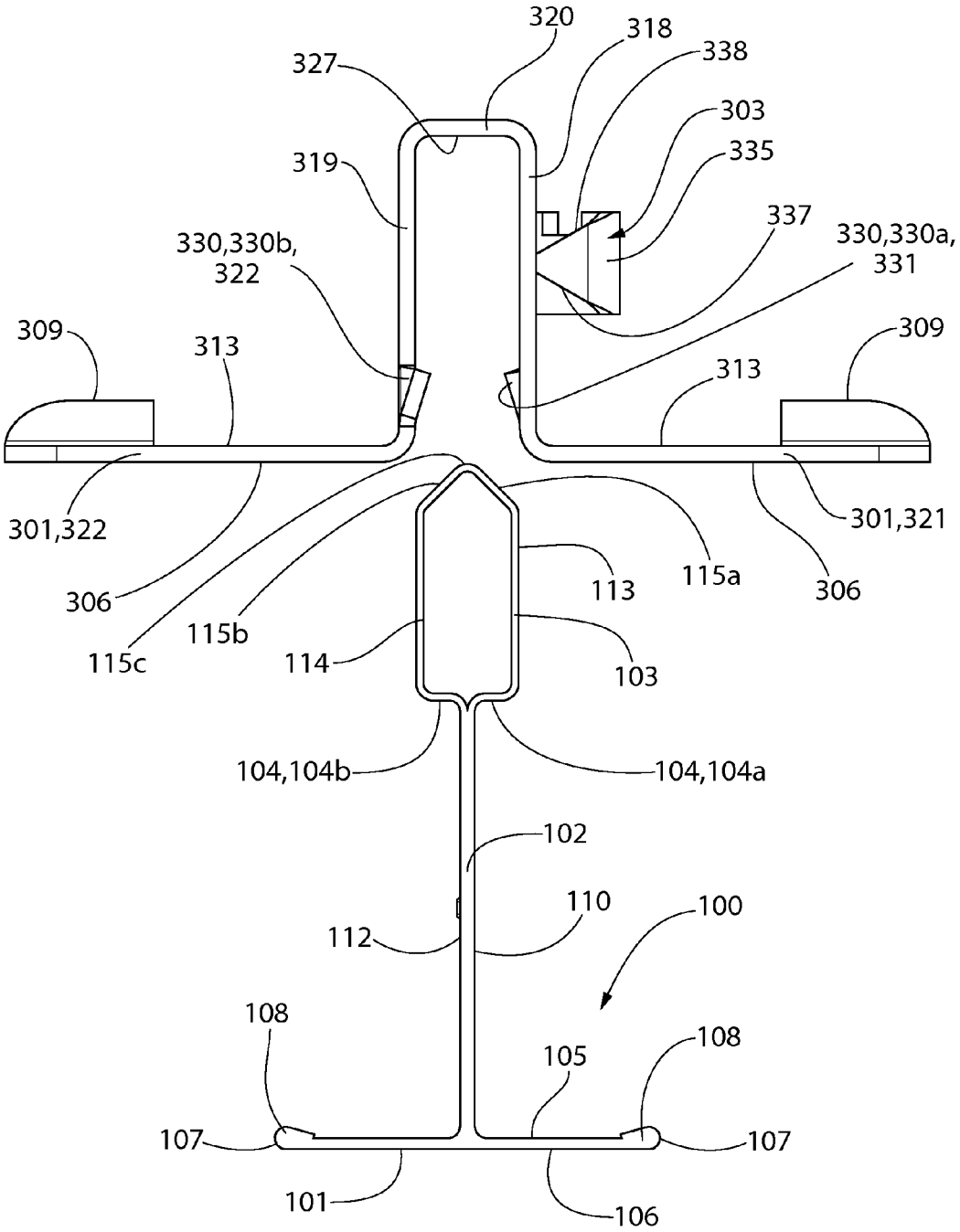
FIG. 49 is a left side view of the strut and the saddle bracket according to the second embodiment of the present invention.

In the second state, represented in FIGS. 45B and 52, the horizontal locking element 303 engages the web portion 102 of the strut 100. Specifically, the barb portion 335 of the horizontal locking feature 303 is in a second position in which the barb portion 335 punctures the bulb portion 103 of the strut 100 causing the barb portion 335 to be located at least partially within the bulb portion 103. The apex 339 of the barb portion 335 perforates the first side surface 113 of the bulb portion 103 and the upper and lower edge 338, 337 of the bar portion slice the first side surface 113 as the barb portion 335 passes through the first side surface 113 into an interior of the bulb portion 119. In the second state, the saddle bracket 300 is horizontally locked to the strut 100. Upon altering the horizontal locking feature 303 from the first state to the second state, the horizontal locking feature 203 rotates about an axis H-H that is substantially parallel to the web portion 102 of the strut 100.

After the saddle bracket 300 has been mounted to the struts 100 of the grid support, the ceiling apparatus 8 or mounting bracket assembly 12 can be attached, thereby forming the connection assemblies 7. It should be noted that the ceiling apparatus 8 or the mounting bracket assembly 12 can be attached to the saddle bracket 300 before or after the horizontal locking feature 303 has been placed in the second position. Placing the horizontal locking feature 303 in the second position after the ceiling apparatus 8 has been attached to the saddle bracket 300 allows the user to adjust the horizontal placement of the ceiling panel 11 within the ceiling system 17, thereby allowing for more accurate positioning of the ceiling panel 11.

In some embodiments, each ceiling panel 11 is attached to two mounting assemblies 12 that are positioned on opposite sides of the ceiling panel 11 in a parallel configuration, as shown in FIGS. 37 and 38. In other embodiments, each ceiling panel 11 is attached to four mounting assemblies 12 (not shown), wherein each pair of mounting assemblies 12 are positioned along a single edge of the ceiling panel 11. The two pairs of mounting assemblies 12 are positioned on opposite edges of the ceiling panel 11 in a parallel configuration. Specifically, for each of the mounting bracket assemblies 12, a first pair of the mounting bracket assemblies 12 are located adjacent to a first edge of the ceiling panel and a second pair of mounting bracket assemblies are located adjacent to a second edge of the ceiling panel, wherein the first edge of the ceiling panel is opposite the second edge of the ceiling panel. The first edge and the second edge extending in parallel directions.

In another non-limiting embodiment the plurality of connection assemblies 7 include a first one of the connection assemblies 7 located adjacent a first edge of the ceiling panel 11 and a second one of the connection assemblies 7 located adjacent a second edge of the ceiling panel 11, wherein the first edge of the ceiling panel is opposite the second edge of the ceiling panel. The first edge of the ceiling panel 11 extends parallel to the second edge of the ceiling panel 11. For each connection assembly 7, there is substantially no force exerted on the ceiling panel 11 that urges separation of the mounting bracket 20 from the ceiling panel 11.

In either embodiment, the mounting brackets 12 are positioned along parallel edges of the ceiling panel 11, thereby allowing the connection assemblies 7 to slide along the struts 100 before the horizontal locking feature 303 has been converted into the second position, thereby horizontally locking the saddle 300 to the strut 100. The mounting brackets 12 coupled to a single ceiling panel 11 are not oriented in a perpendicular manner as that would prevent the connection assemblies 7 from being able to slide horizontally along the strut 100.

When the saddle bracket 300 mounted to the strut 100—thereby forming the grid assembly 7—the saddle member 302 straddles the web portion 102 of the strut 100. Additionally, the web portion 102 of the strut 100 is disposed in the web receiving cavity 305 of the saddle bracket 300. The support flange 301 is located above and space from the flange portion 100 of the strut 100. The grid assembly 7 further comprises a portion 380 of the support flange 301 that extends beyond the edge 107 portion of the strut 100. The mounting slot 308 is located on the portion 380 of the support flange 301 that extends beyond the edge 107 of the flange portion 101 of the strut. The portion 380 of the support flange 301 that extends beyond the edge 107 of the flange portion 101 of the strut 100 further comprises the insertion slot 309. The i With the saddle bracket 300 mounted to the strut 100—thereby forming the grid assembly 7, the ceiling apparatus 8 (or mounting bracket assembly 12 if the ceiling panel 11 is not yet attached to the mounting bracket 12) is coupled to the saddle bracket 300 by the following non-limiting embodiments. The resilient element 70 (torsion spring 70) is detachably coupled to the saddle bracket 300 by the first and second spring legs 72, 73 extending through the mounting slot 308 of the saddle bracket 300. Stated otherwise, the mounting slot 208 on the saddle bracket 200 receives the torsion spring 70 of the ceiling apparatus 8. The torsion springs 70 may be detachably coupled to the saddle bracket 300 according to the same methodology previously discussed with respect to detachably coupling the torsion spring 70 to the saddle bracket 200 of the first embodiment. The differences being that the mounting slot 208, insertion slot 209, and edge 250 of the saddle bracket 200 of the first embodiment correspond to the mounting slot 308, insertion slot 309, and edge 350 of the saddle bracket 300 of the second embodiment, respectively.

Once the ceiling panels 11 have been attached to the connection assemblies 7, the corresponding ceiling system 17 may be converted between three ceiling states. The first state ("raised state") is shown in FIGS. 1, 37, 53, and 54. The second state ("lowered state") is not shown but have the same configurations discussed with respect to saddle bracket 200. The third state ("dropped state") is shown in FIG. 38 and shares the same configurations discussed with respect to saddle bracket 200.

Figure 53:
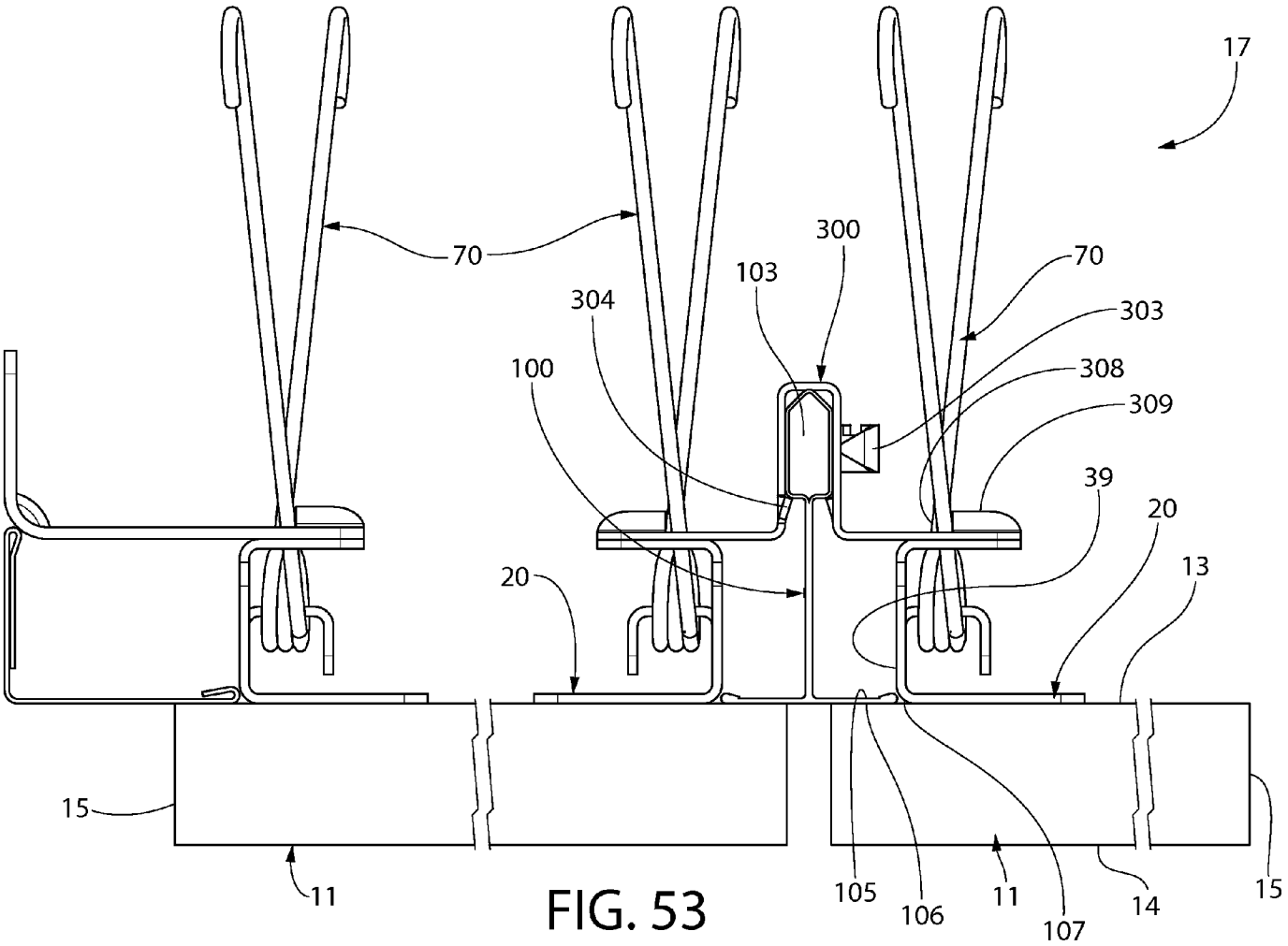
FIG. 53 is a left side view of the ceiling system in the first state according to the second embodiment of the present invention.
Figure 54:
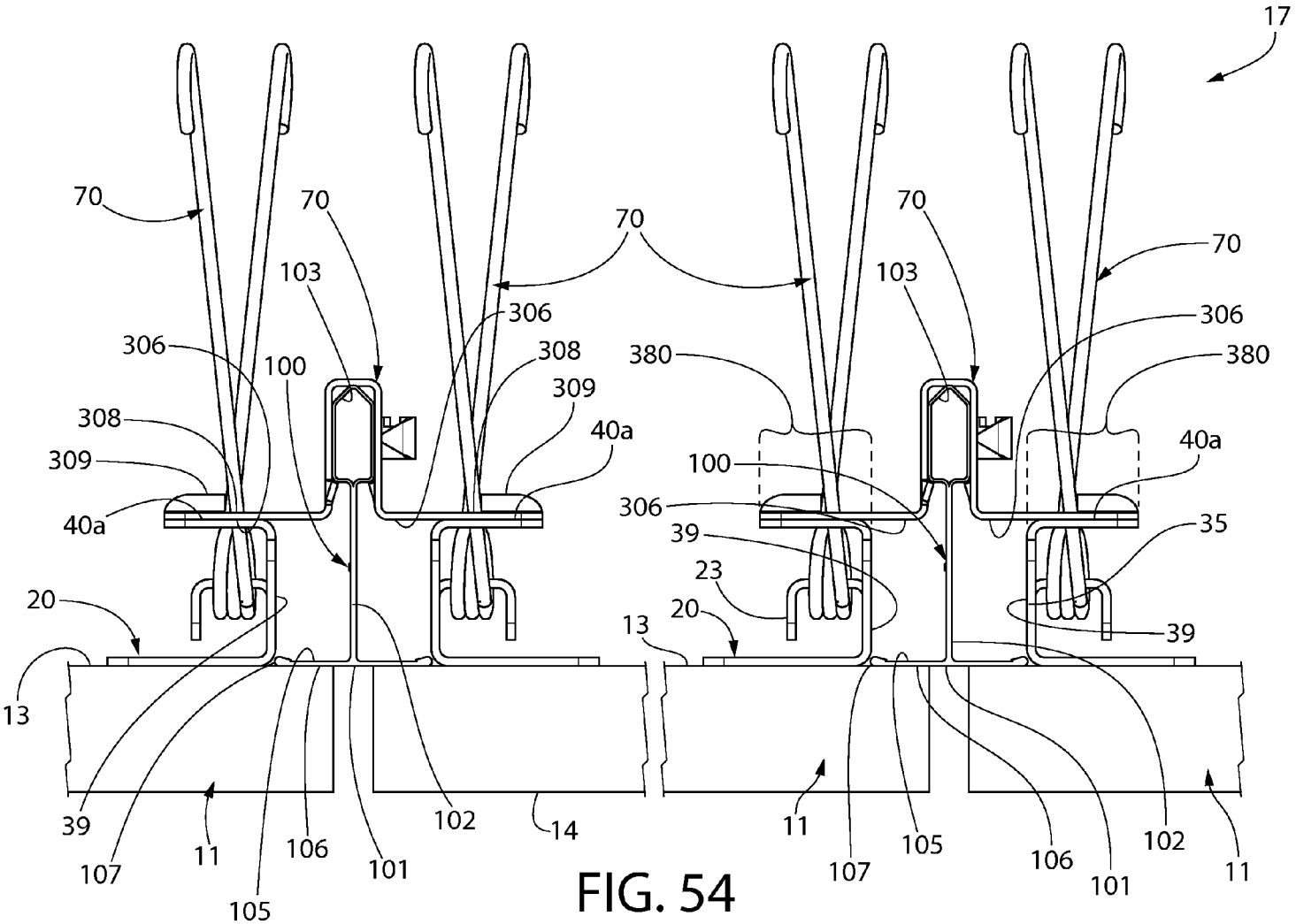
FIG. 54 is a left side view of the ceiling system in the first state according to the first embodiment of the present invention.

As shown in FIGS. 53 and 54, in the raised state, the bias of the first and second spring legs 72, 73 against the edges 350 of the mounting slot 308 of the saddle bracket 300 causes the mounting bracket 20, the upper surface of the ceiling panel 11, the flange portion 101 of the strut 100, and the support flange 301 of the saddle bracket 300 to be biased toward each other thereby creating at number of engagements and configurations.

As shown in FIGS. 53 and 54, the upper surface 40*a* of the mounting bracket 20 contacts the portion 380 of the support flange 301 that extends beyond the edge 107 of the flange portion 101 of the strut 100 to provide vertical registration between the ceiling panel 11 and the grid support 2. The wall surface 39 of the mounting bracket 20 is located adjacent to the edge of the flange portion 107 of the strut 100 to provide horizontal registration between the ceiling panel 11 and the grid support 2. The wall surface 39 of the mounting bracket 20 is in contact with the edge 107 of the flange portion 101 of the strut 100 to provide horizontal registration between the ceiling panel 11 and the grid support 2.

The resilient element/torsion spring 70 biases the upper surface 13 of the ceiling panel 11 into contact with the lower surface 106 of the flange portion 101 of the strut 100. The upper surface 40*a* of the upper plate 40 of the mounting bracket 20 contacts the lower surface 306 of the support flange 301 of the saddle bracket 300. The torsion spring 70 is detachably coupled to the saddle bracket 300 by the first and second spring legs 72, 73 extending through the mounting slot 308 of the saddle bracket 300 to operably engage the portion 380 of the support flange 301 that extends beyond the edge 107 of the flange portion 101 of the strut.

For each of the connection assemblies 7, the lower surface 306 of the support flange 301 and the upper surface 40*a* of the upper plate 40 of the mounting bracket 20 are substantially parallel to the upper surface 13 of the ceiling panel 11. The lower surface 106 of the flange portion 101 of the strut 100 is substantially parallel to the upper surface 40*a* of the upper plate 40 of the mounting bracket 20. The lower surface 106 of the flange portion 101 of the strut 100 is substantially parallel to the upper surface 13 of the ceiling panel 11.

The mount bracket 20 has a second height measured from the lower surface 21*c* of the base plate 21 of the mounting bracket 20 that is in contact with the upper surface 13 of the ceiling panel 11 and the upper surface 40*a* of the upper plate 40 of the mounting bracket 20. The saddle bracket 300 comprises a third height measured from the lower surface 306 of the support flange 301 to a lower surface 327 of the bight portion 320 of the saddle member 300 that contacts the web portion 102 of the strut 100. The first height of the strut 100 is substantially equal to the sum of the second and third heights.

Once the torsions springs 70 along the single edge of the ceiling panel 11 are decoupled from the grid assembly 4, the ceiling panel 11 is free to swing downward toward the active room environment 6. Specifically, as shown in FIG. 14, the notch 36 on the wall plate 35 of the mounting bracket 20 allows the first and second spring legs 72, 73 to clear the wall plate 35 as the wall plate 35 reorients from being substantially parallel to the web portion 102 of the strut 100 to being substantially perpendicular to the web portion 102 of the strut. In the dropped state, the uncoupled ceiling panel 11 provides a user with easy access to the crawl space 6.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A ceiling system comprising:

a grid support comprising a plurality of struts, each of the struts comprising a flange portion and a web portion extending upward from the flange portion, the flange portion having an upper surface and a lower surface;

a ceiling panel mounted to the grid support by a plurality of connection assemblies, each of the connection assemblies comprising:

a mounting bracket assembly comprising:

a mounting bracket coupled to the ceiling panel, the mounting bracket comprising an upper surface and a wall surface; and a resilient element coupled to the mounting bracket;

a saddle bracket comprising:

a saddle member defining a web receiving cavity; and a support flange extending from the saddle member; and the saddle bracket coupled to one of the struts so that: (1) the saddle member straddles the web portion of the strut and the web portion of the strut is disposed in the web receiving cavity; (2) the support flange is located above and spaced from the flange portion of the strut; and (3) a portion of the support flange extends beyond an edge of the flange portion of the strut; and the resilient element detachably coupled to the saddle bracket and biasing the mounting bracket so that: (1) the upper surface of the mounting bracket contacts the portion of the support flange that extends beyond the edge of the flange portion of the strut to provide vertical registration between the ceiling panel and the grid support; and (2) the wall surface of the mounting bracket is located adjacent the edge of the flange portion of the strut to provide horizontal registration between the ceiling panel and the grid support.

2. The ceiling system according to claim 1 wherein for each of the connection assemblies, the mounting bracket comprises a base plate coupled to an upper surface of the ceiling panel, a wall plate extending upward from an upper surface of the base plate, and an upper plate extending from the wall plate above the upper surface of the base plate, a space being formed between a lower surface of the upper plate and the upper surface of the base plate, the wall plate comprising the wall surface and the upper plate comprising the upper surface, wherein the upper plate comprises the upper surface of the mounting bracket that contacts the portion of the support flange that extends beyond the edge of the flange portion of the strut.

3. The ceiling system according to claim 2 wherein for each of the connection assemblies, the base plate of the mounting bracket comprises a lower surface that is in contact with the upper surface of the ceiling panel; and wherein the lower surface of the base plate is substantially coplanar with a lower surface of the flange portion of the strut.

4. The ceiling system according to claim 2 wherein for each of the connection assemblies:

the mounting bracket further comprises:

a hook member comprising a free end; and a receiving slot formed between the free end of the hook member and an upper surface of the base plate;

the saddle bracket further comprises a mounting slot located on the portion of the support flange that extends beyond the edge of the flange portion of the strut;

the resilient element comprising a torsion spring comprising a ring portion, a first spring leg, and a second spring leg, the hook member of the mounting bracket extending through a central opening of the ring portion of the torsion spring to mount the torsion spring to the mounting bracket; and the torsion spring detachably coupled to the saddle bracket by the first and second spring legs extending through the mounting slot of the saddle bracket to operably engage the portion of the support flange that extends beyond the edge of the flange portion of the strut.

5. The ceiling system according to claim 4 wherein for each of the connection assemblies:

the portion of the support flange that extends beyond the edge of the flange of the strut comprises an insertion slot extending from an edge of the support flange to the mounting slot; and the insertion slot having a length that is less than a length of the mounting slot.

6. The ceiling system according to claim 4 wherein for each of the connection assemblies:

the wall plate comprises a notch, the hook member extending upward from the base plate into the notch, the wall plate comprises a first wall plate section and a second wall plate section, the notch located between the first and second wall plate sections;

the upper plate comprises a first upper plate section and a second upper plate section, the hook member located longitudinally between the first and second upper plate sections; and the first and second spring legs are located between the first and second upper plate sections and extend upward beyond the first and second upper plate sections.

7. The ceiling system according to claim 2 wherein for each of the connection assemblies, the upper plate of the mounting bracket is substantially parallel to the base plate of the mounting bracket, and the upper plate of the mounting bracket is substantially perpendicular to the wall plate.

8. The ceiling system according to claim 2 wherein for each of the connection assemblies, the wall surface of the mounting bracket is in contact with the edge of the flange portion of the strut to provide horizontal registration between the ceiling panel and the grid support.

9. The ceiling system according to claim 1 wherein each of the struts further comprises a bulb portion on the web portion, and wherein for each of the connection assemblies:

the saddle bracket comprises a first wall plate, a second wall plate opposing the first wall plate, and a bight portion connecting the first and second wall plates, the bight portion, the first wall plate, and the second wall plate collectively defining the web receiving cavity; and an upper surface of the bulb portion of the strut is in contact with the bight portion.

10. The ceiling system according to claim 1 wherein for each of the connection assemblies, the resilient element biases the upper surface of ceiling panel into contact with a lower surface of the flange portion of the strut.

11. The ceiling system according to claim 1 wherein for each of the connection assemblies, the upper surface of the mounting bracket contacts a lower surface of the support flange of the saddle bracket.

12. The ceiling system according to claim 11 wherein each of struts comprises a first height measured from a lower surface of the flange portion to an uppermost surface of the web portion of the strut, and wherein for each of the connection assemblies:

the mounting bracket has a second height measured from a lower surface of the mounting bracket that is in contact with the ceiling panel and the upper surface of the mounting bracket;

the saddle bracket comprising a third height measured from the lower surface of the support flange to a lower surface of a bight portion of the saddle member that contacts the web portion; and wherein the first height is substantially equal to the sum of the second and third heights.

13. The ceiling system according to claim 1 wherein for each of the connection assemblies, the lower surface of the support flange and the upper surface of the mounting bracket are substantially parallel to the upper surface of the ceiling panel.

14. The ceiling system according to claim 13 wherein for each of the connection assemblies, the lower surface of the flange portion of the strut is substantially parallel to the upper surface of the mounting bracket and the upper surface of the ceiling panel.

15. The ceiling system according to claim 1 wherein the plurality of connection assemblies comprises a first one of the connection assemblies located adjacent a first edge of the ceiling panel and a second one of the connection assemblies located adjacent a second edge of the ceiling panel, the first edge of the ceiling panel being opposite the second edge of the ceiling panel.

16. The ceiling system according to claim 1 wherein for each of the connection assemblies, there is substantially no force exerted on the ceiling panel that urges separation of the mounting bracket from ceiling panel.

* * * * *